US011130549B2

(12) United States Patent
Dombois

(10) Patent No.: US 11,130,549 B2
(45) **Date of Patent: *Sep. 28, 2021**

(54) SELF-PROPELLING HYDROFOIL DEVICE

(71) Applicant: Markus Dombois, Stockton, CA (US)

(72) Inventor: Markus Dombois, Stockton, CA (US)

(73) Assignee: Dombois Designs, Inc., Stockton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/872,287

(22) Filed: May 11, 2020

(65) Prior Publication Data

US 2020/0331562 A1 Oct. 22, 2020

Related U.S. Application Data

(63) Continuation-in-part of application No. 16/152,355, filed on Oct. 4, 2018, now Pat. No. 10,647,387, which is a continuation of application No. 15/679,149, filed on Aug. 16, 2017, now Pat. No. 10,118,668.

(60) Provisional application No. 62/376,329, filed on Aug. 17, 2016.

(51) Int. Cl.

| | |
|---|---|
| ***B63B 1/28*** | (2006.01) |
| ***B63B 1/24*** | (2020.01) |
| ***B63B 32/60*** | (2020.01) |

(52) U.S. Cl.

CPC ..... *B63B 1/286* (2013.01); *B63B 1/242* (2013.01); *B63B 1/248* (2013.01); *B63B 32/60* (2020.02)

(58) Field of Classification Search

CPC .. B63B 32/60; B63B 1/00; B63B 1/24; B63B 1/242; B63B 1/248; B63B 1/26; B63B 1/28; B63B 1/286; B63B 35/73; B63B 35/79; B63B 35/7923; B63B 35/7953

USPC ..... 114/39.15, 39.24, 274, 280

See application file for complete search history.

(56) References Cited

U.S. PATENT DOCUMENTS 10,118,668 B2 * 11/2018 Dombois ..... B63B 32/60
10,647,387 B2 * 5/2020 Dombois ..... B63B 32/60

* cited by examiner

*Primary Examiner* — Lars A Olson

(57) ABSTRACT

The present disclosure provides generally for a hydrofoil system that may allow a surfboard to glide above the water surface. According to the present disclosure, a rider may be able to manipulate a hydrofoil device attached to a surfboard with limited training and athletic ability. The present disclosure provides for a hydrofoil system that may allow riders to use a light leaning motion to adjust the angle of a front wing to create forward thrust to produce a flow for creating lift. In some aspects, the front wing may tilt to reduce downward drag force in a lifting phase while locking into place during a glide to provide a sustained lift of the surfboard out of the water.

20 Claims, 52 Drawing Sheets

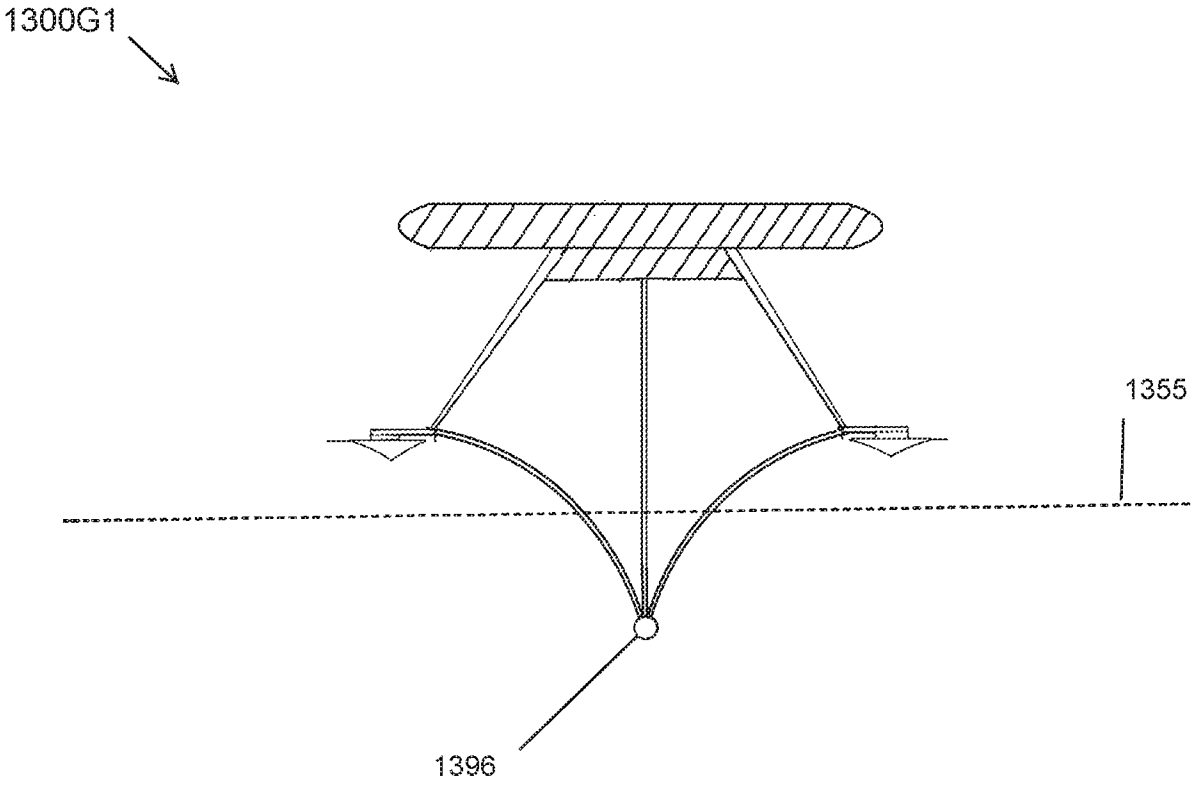
FIG. 13G1

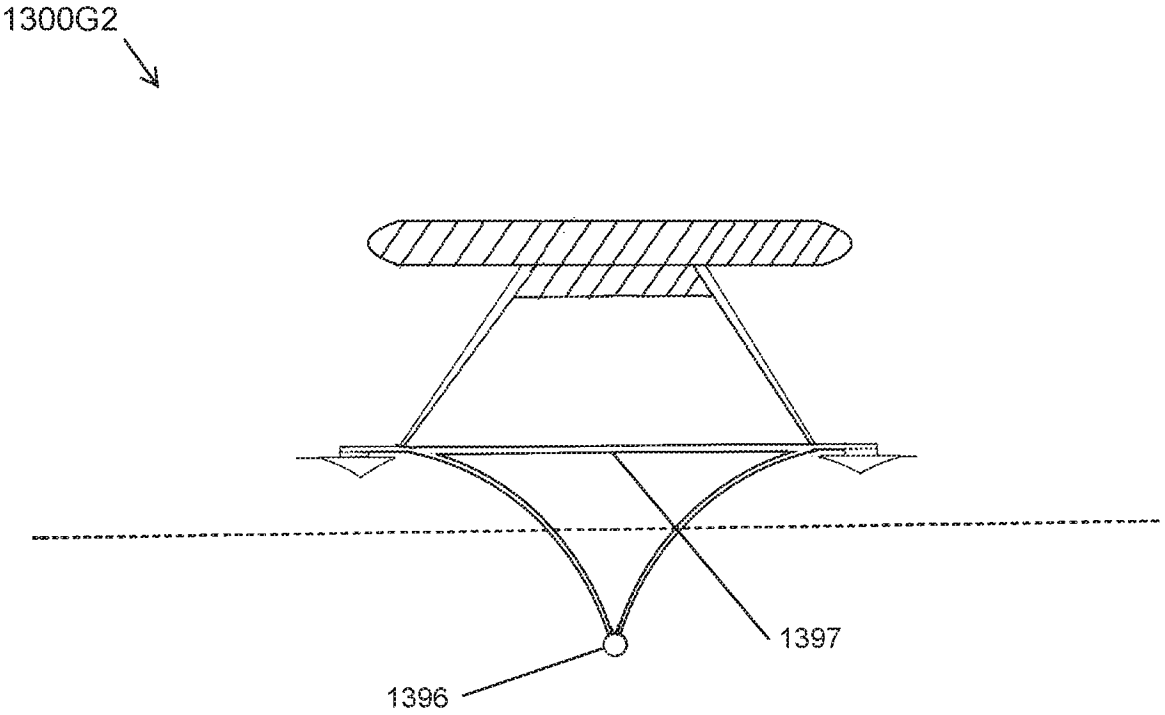
FIG. 13G2

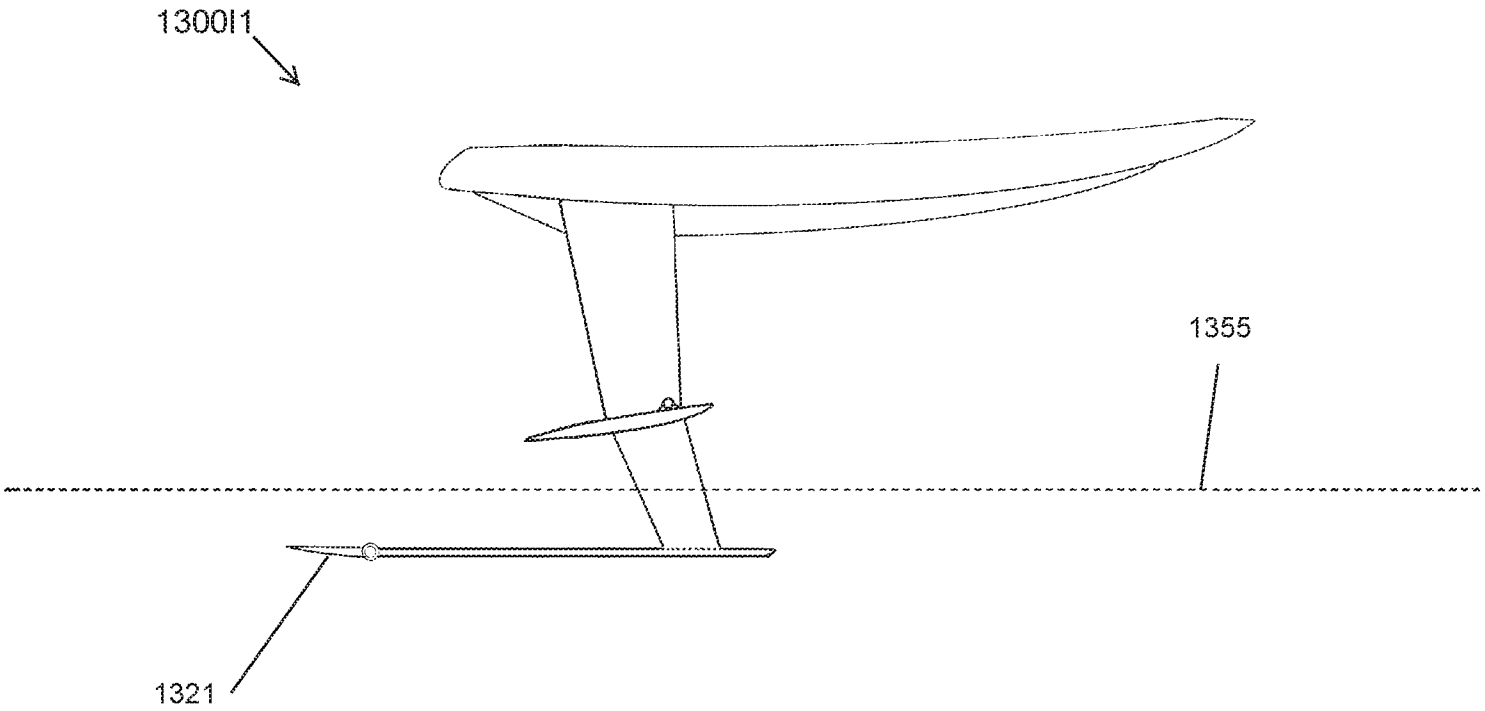
FIG. 13I1

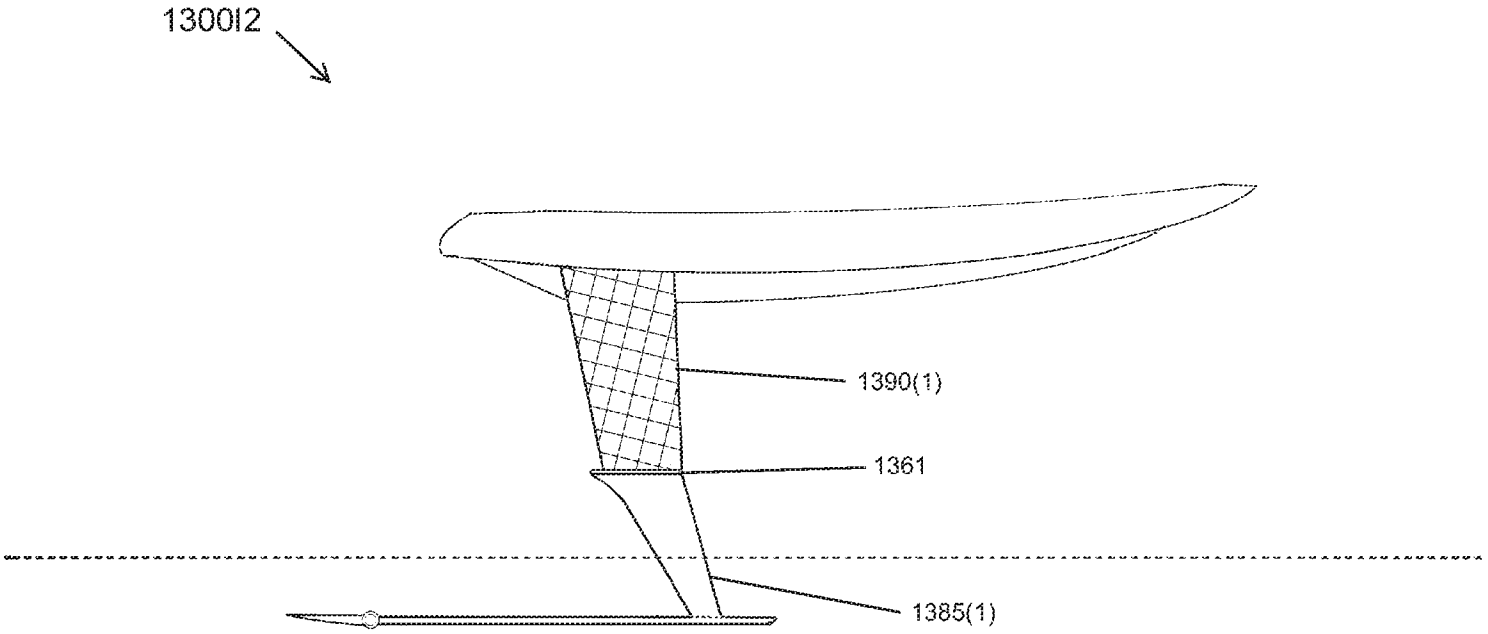
FIG. 13I2

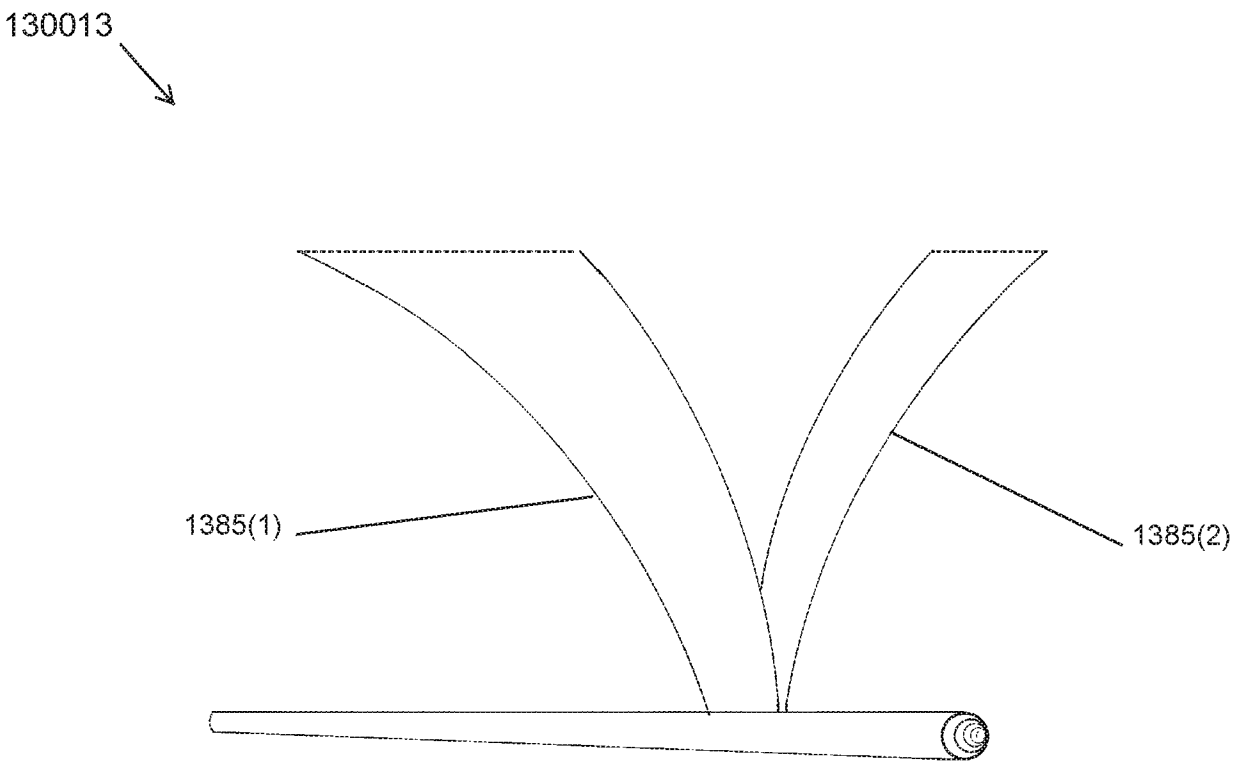
FIG. 13I3

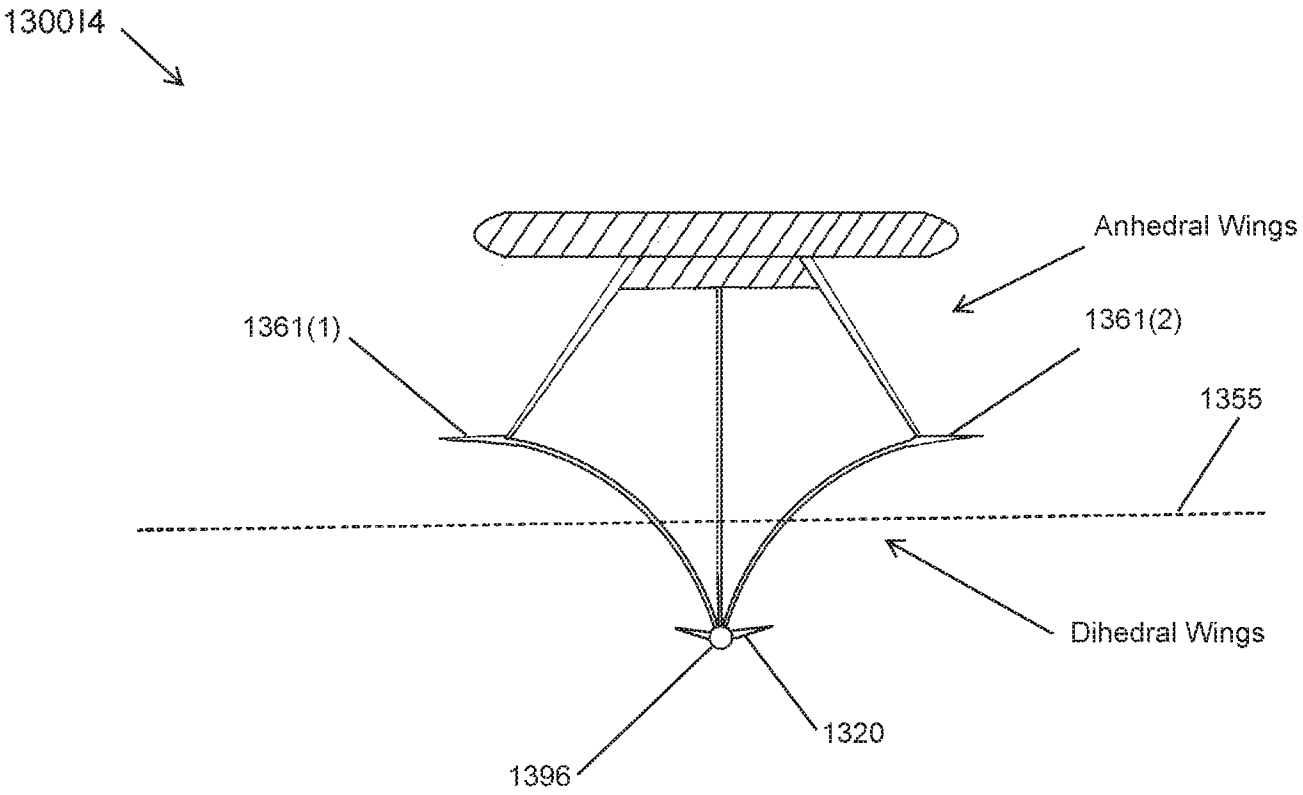
FIG. 13I4

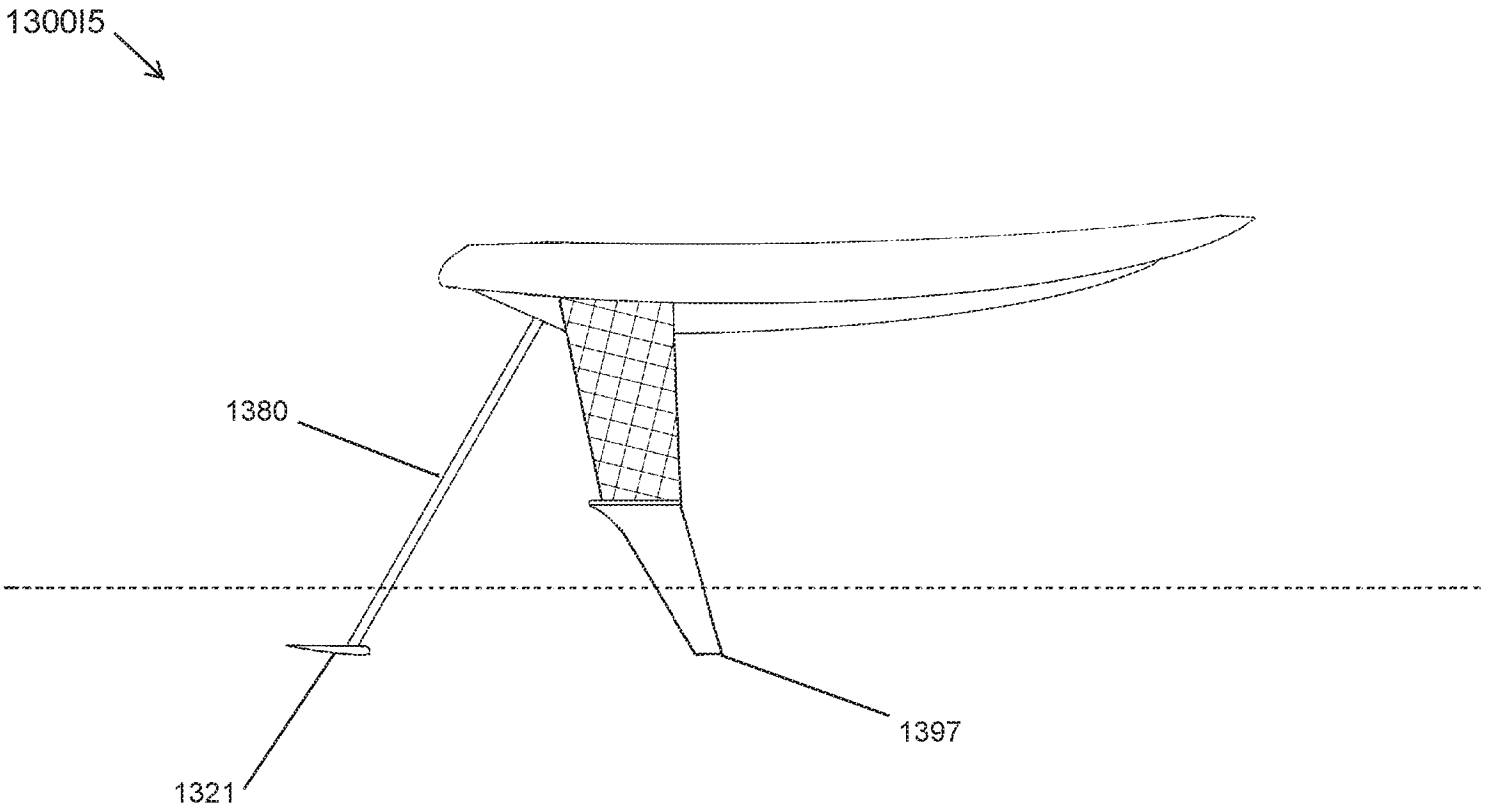
FIG. 1315

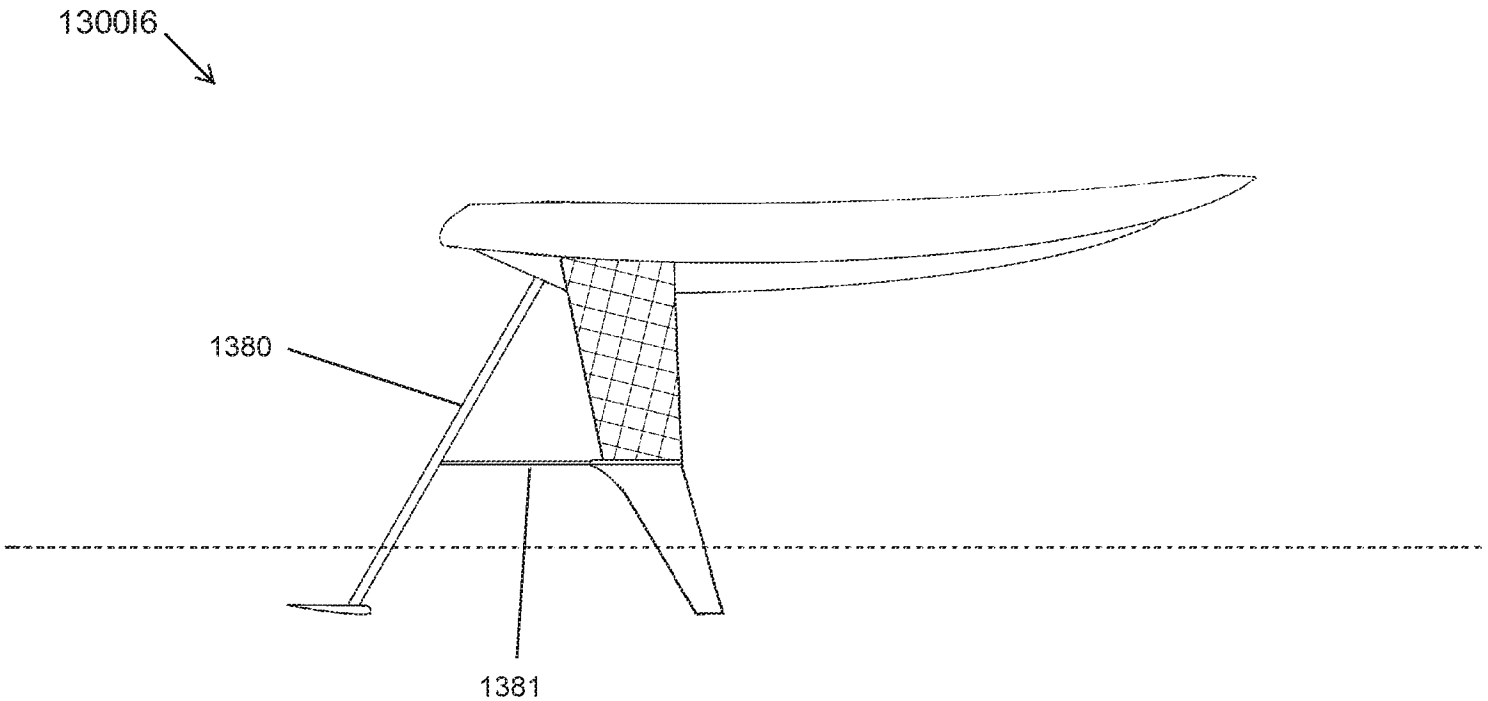
FIG. 13I6

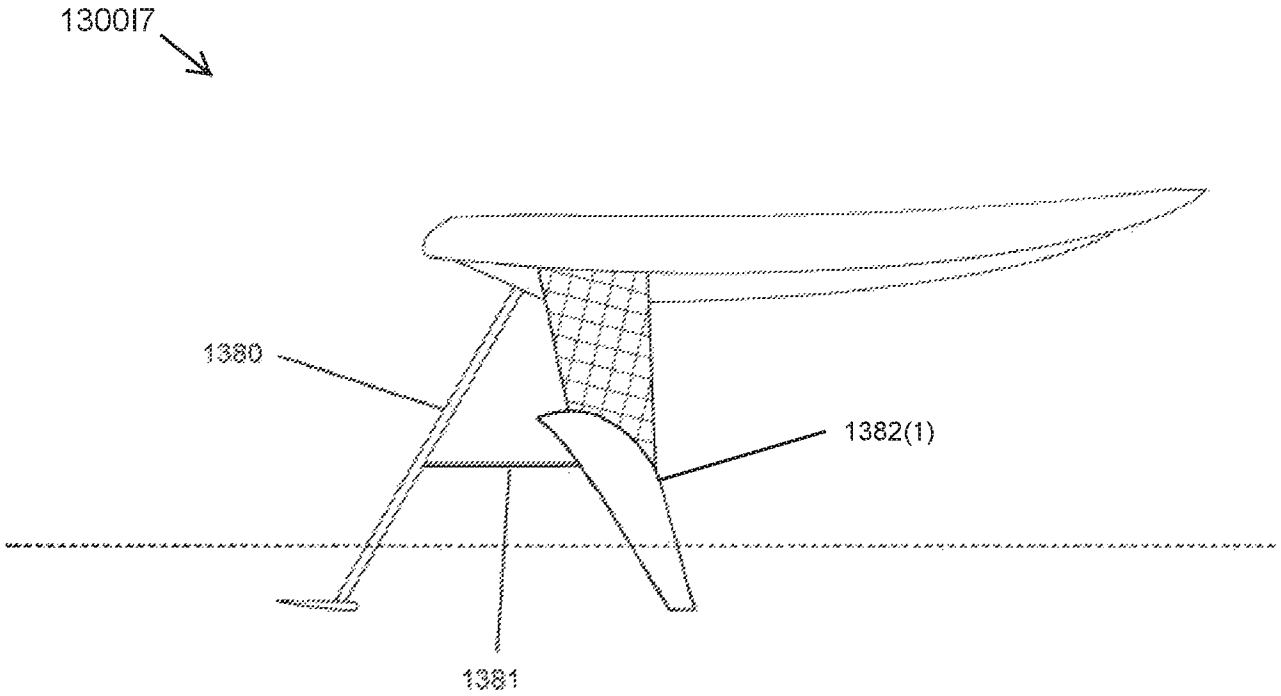
FIG. 13I7

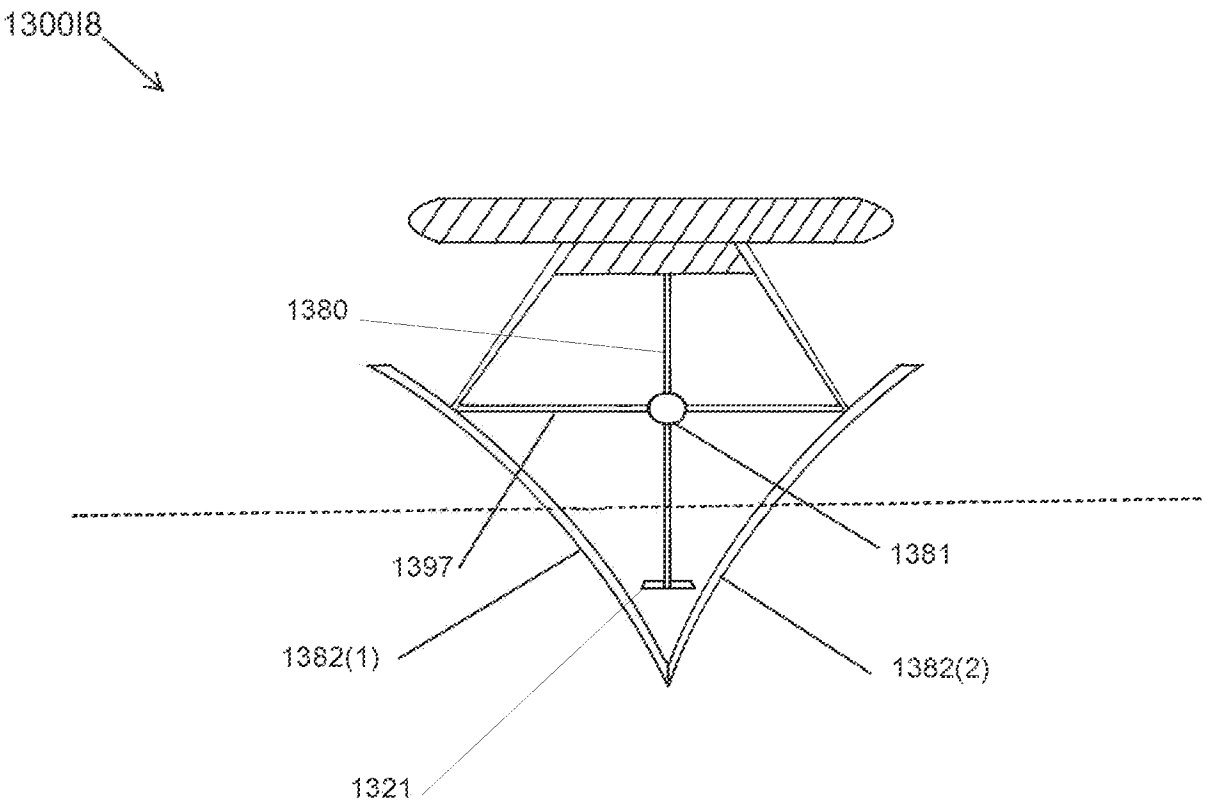
FIG. 13I8

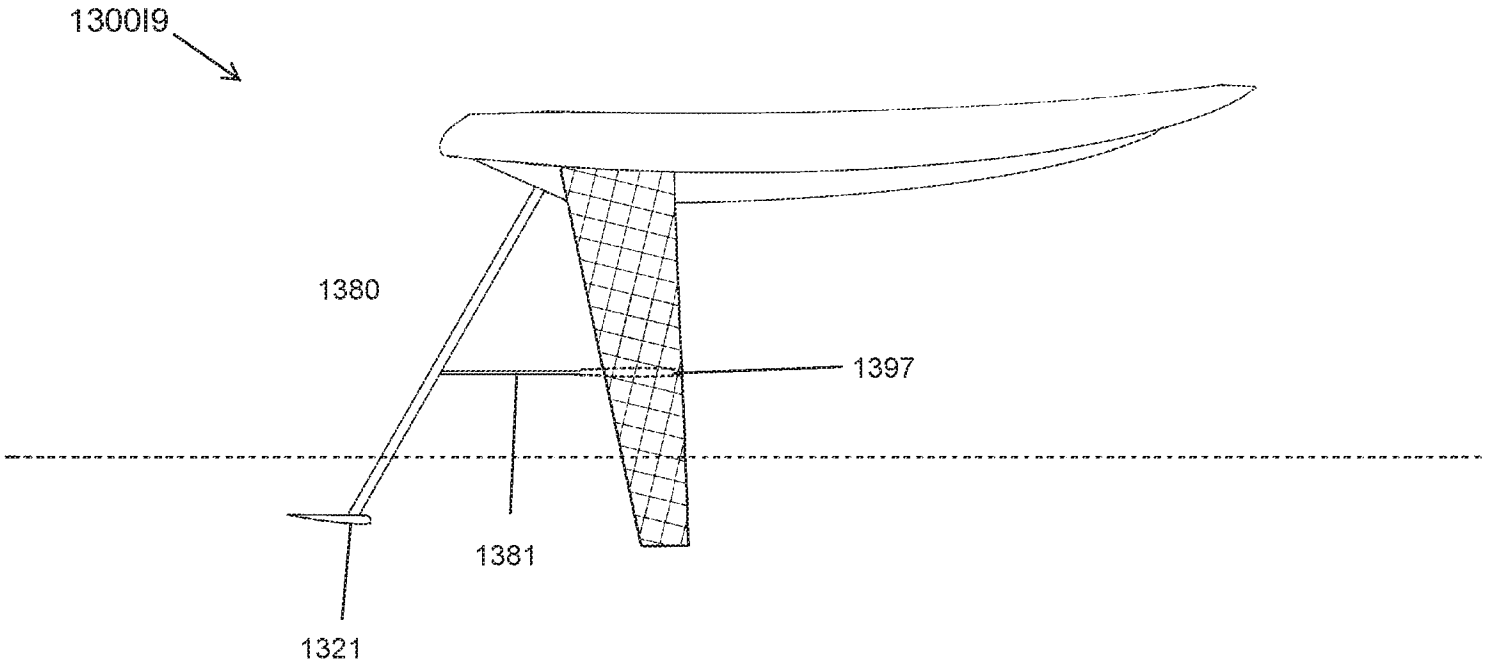
FIG. 13I9

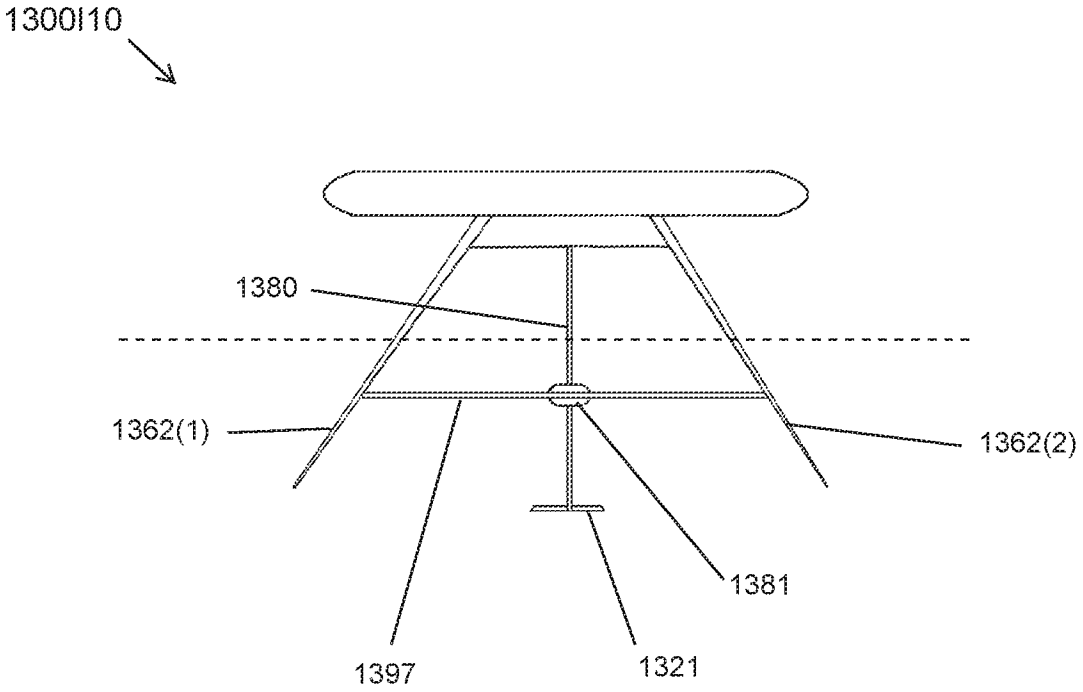
FIG. 13I10

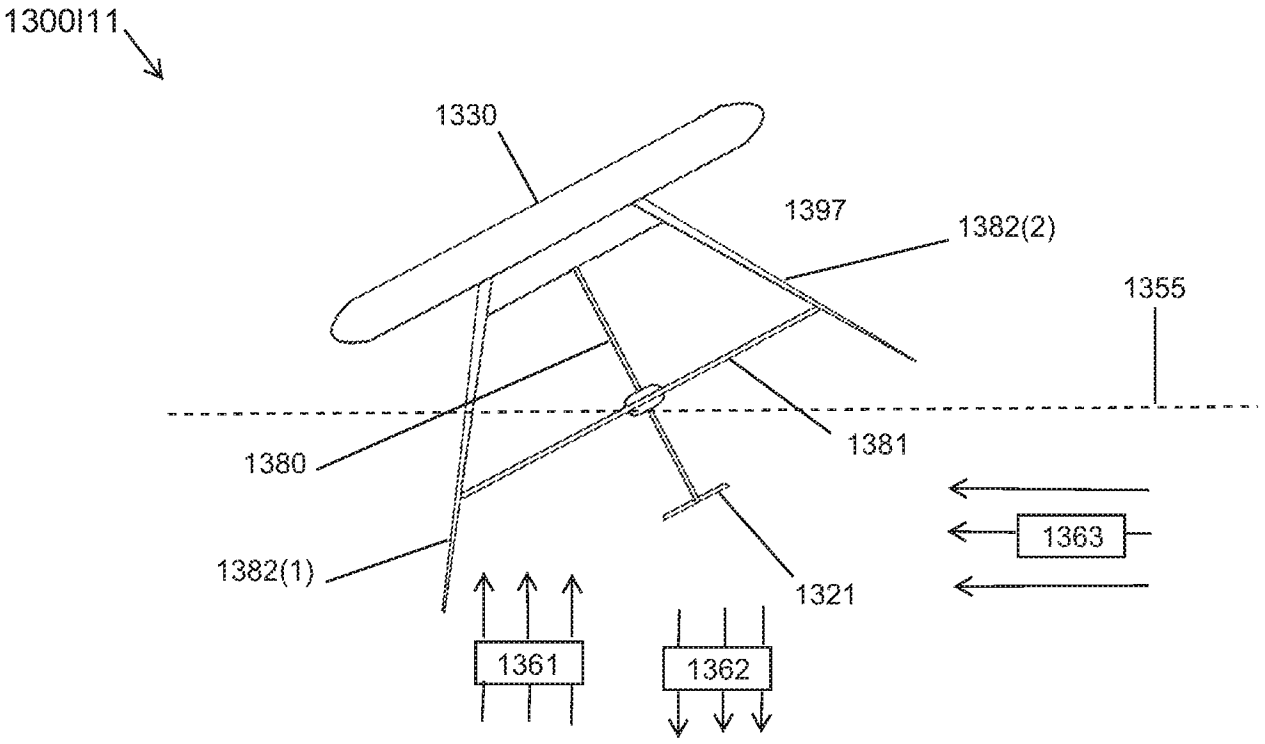
FIG. 13I11

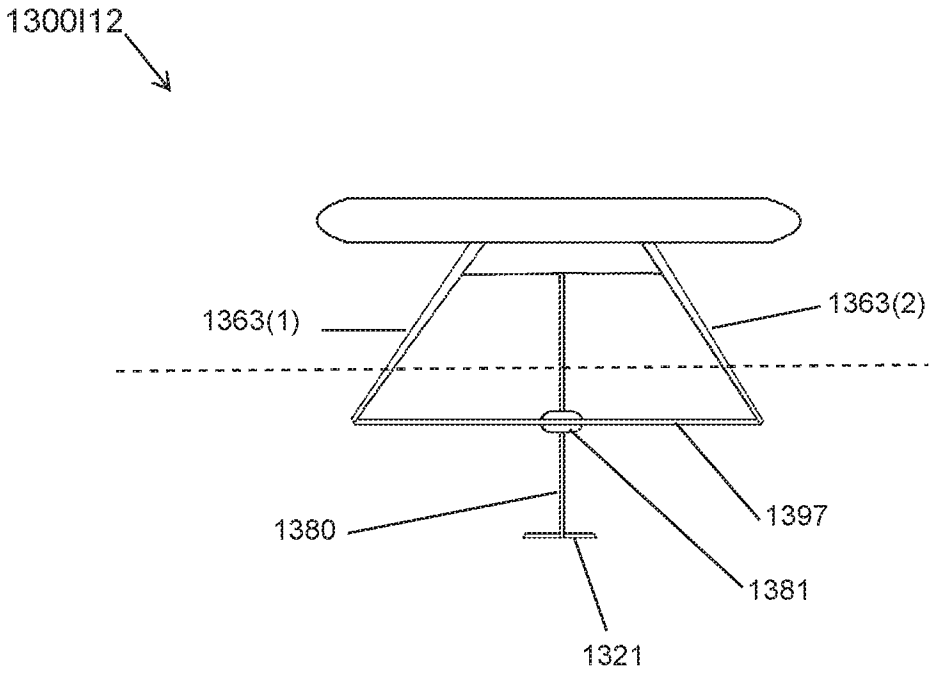
FIG. 13I12

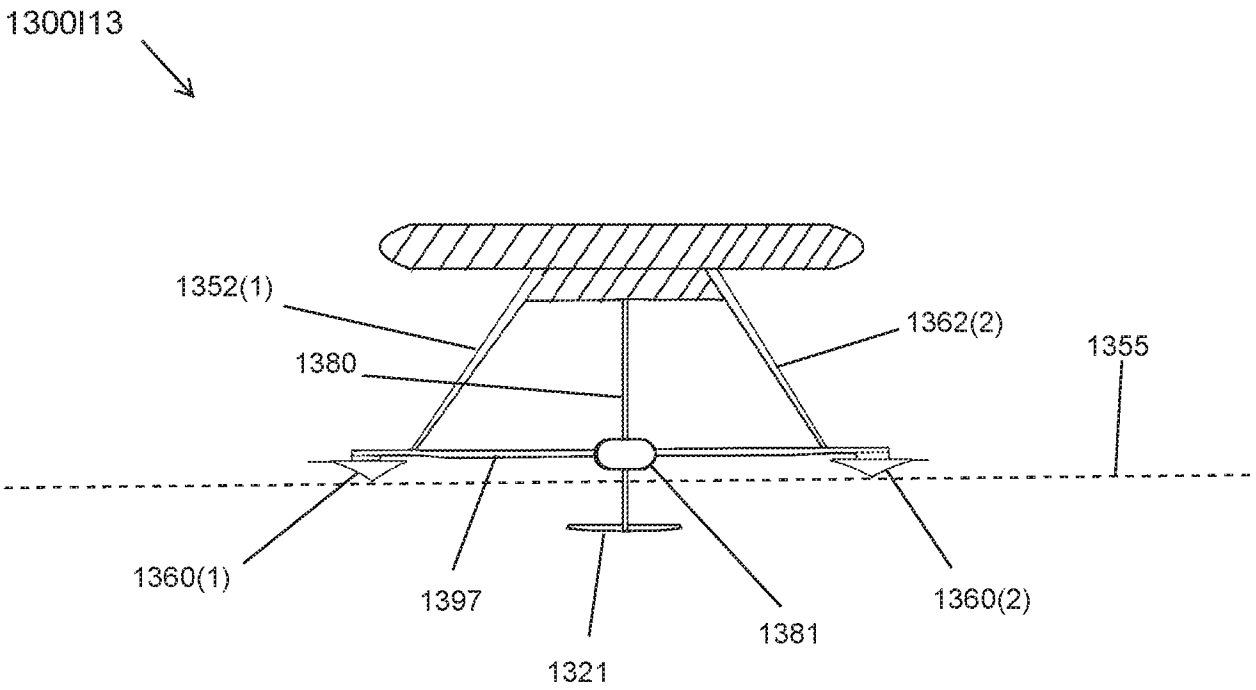
FIG. 13I13

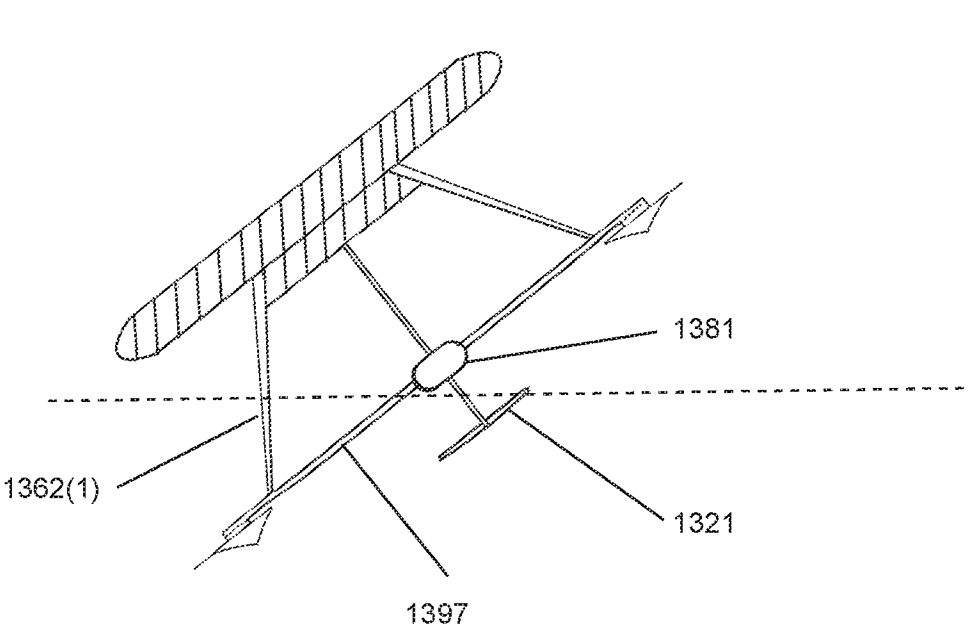
FIG. 13I14

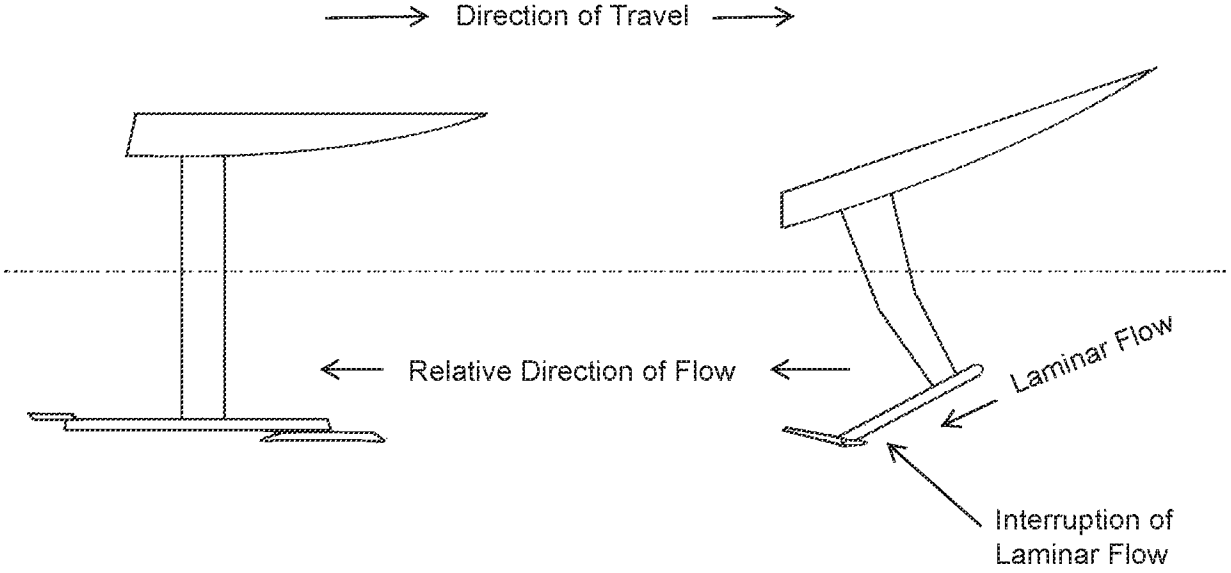
FIG. 13J2
FIG. 13J1

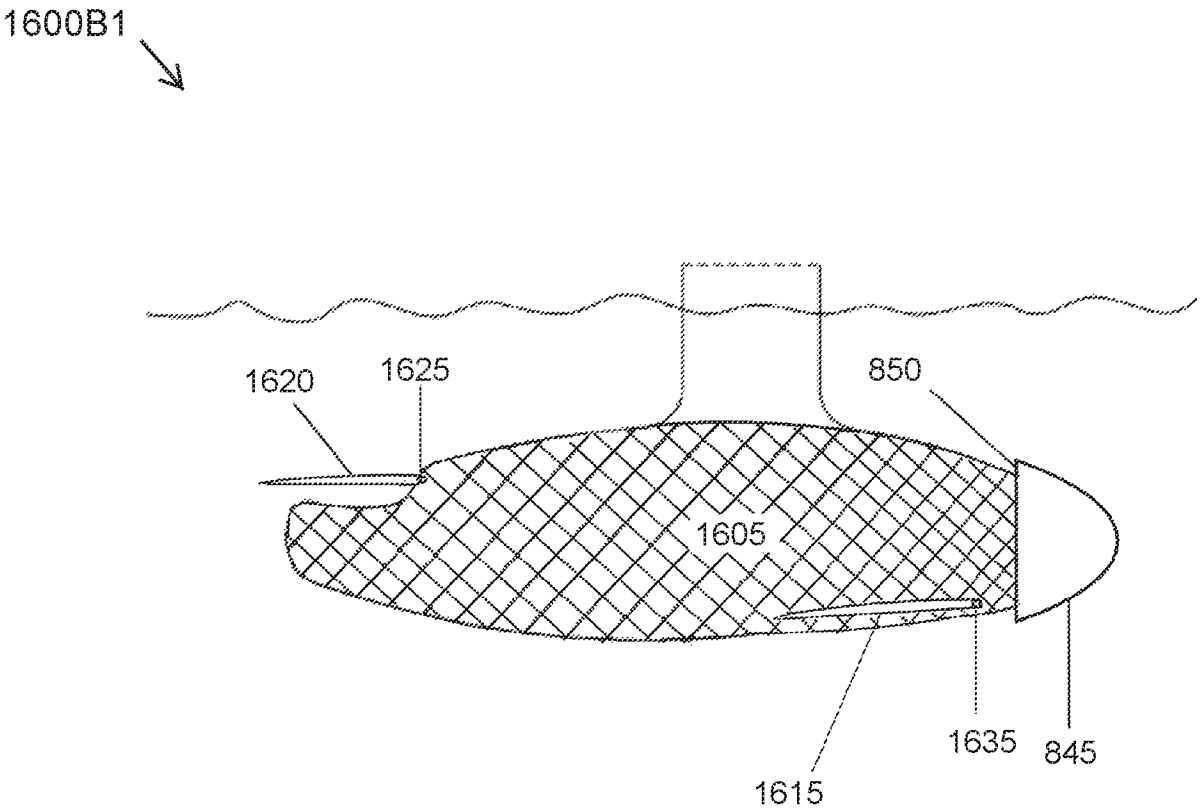
FIG. 16B1

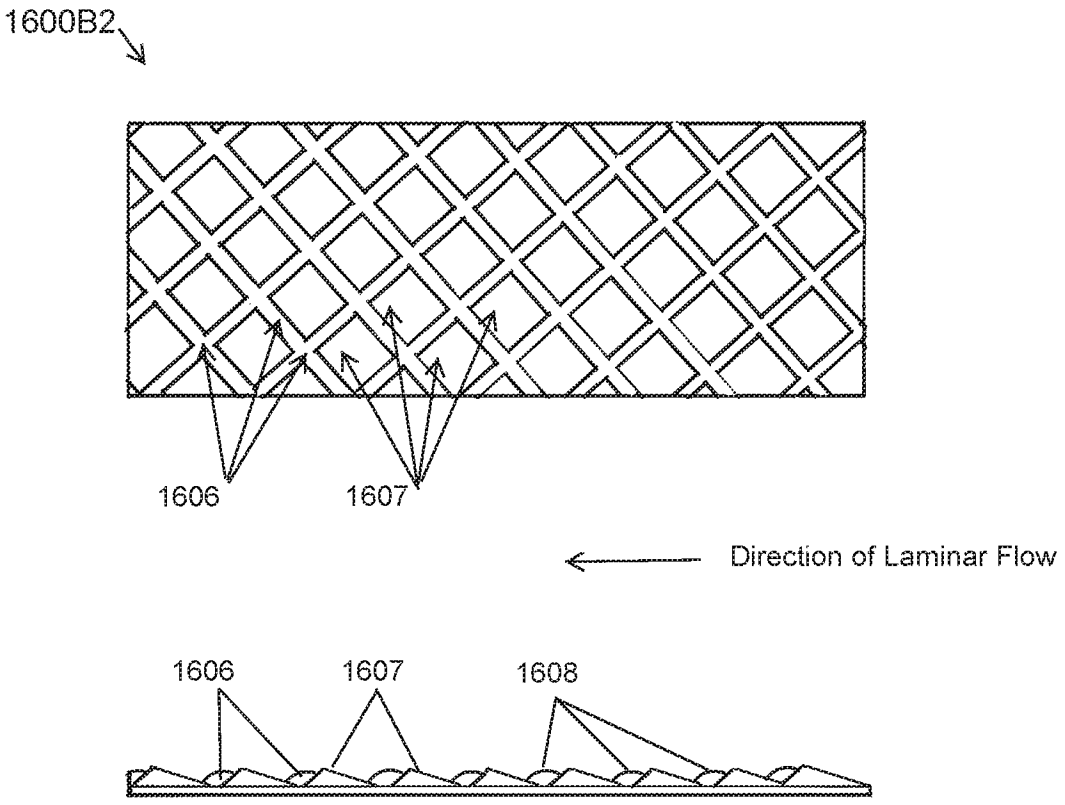
FIG. 16B2

SELF-PROPELLING HYDROFOIL DEVICE

CROSS-REFERENCE TO RELATED APPLICATIONS

This application is a continuation-in-part of, and claims the benefit of priority to U.S. Nonprovisional patent application Ser. No. 16/152,355, (filed Oct. 4, 2018, and titled "SELF-PROPELLING HYDROFOIL DEVICE"), which is a continuation of U.S. Nonprovisional patent application Ser. No. 15/679,149 (filed Aug. 16, 2017, and titled "SELF-PROPELLING HYDROFOIL DEVICE"), which claims the benefit of priority to U.S. Provisional Patent Application Ser. No. 62/376,329 (filed Aug. 17, 2016, and titled "SELF-PROPELLING HYDROFOIL DEVICE"), the entire contents of which applications are incorporated herein by reference, for all purposes.

TECHNICAL FIELD

This disclosure relates to water-borne vessels, and more particularly to water-borne vessels having hydrofoils.

COPYRIGHT NOTICE

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

BACKGROUND OF THE DISCLOSURE

In ancient Hawaii, surfboards were originally used as a luxury and a status symbol. Nobles rode boards that could be as long as 25 feet, referred to as Alii boards, while others used seven-foot long boards, referred to as Alaia boards. These boards were usually made of wood, which made the boards incredibly heavy.

Over time, changes were made to the original surfboard to reduce its size and its weight. This lead to the creation of the hollow surfboard. One of the very first hollow surfboards was the Cigar Board, which had holes drilled into a redwood board with an additional wood encasing. The Cigar Board went on to become the first surfboard to be mass-produced. Eventually, balsa wood reduced the weight of a surfboard by a precipitous amount, which allowed for increased portability. Redwood and plywood would also be substituted when balsa wood was not otherwise available.

The next innovation in the surfboard sphere was reshaping the design to make it more hydrodynamic. Surfers began tapering the tail end of their boards to help maneuverability on the ocean surface. This increased maneuverability helped riders navigate on the curl of a wave and allowed riders to maneuver in the "pipe" of a wave, leading these boards to be referred to as "hot curl" boards. A fin redesign created the fixed-tail fin, which increased maneuverability and directional stability. This was further iterated on and lead to the creation of the double fin and the triple fin.

After World War II, fiberglass was used to create lighter boards for riding waves, as was plastics and STYROFOAM. Eventually fiberglass was layered over an expanded polystyrene core to create a board that was stronger and lighter. A shortboard was eventually created, reducing the length of a surfboard to around 6 feet, allowing surfers to more easily ride in the pocket of a wave. The shortboard further increased maneuverability, allowed for greater performance style surfing, with sharper turns and greater acceleration.

As a result, surfboards are now made of relatively light material to support an individual standing on them on an ocean surface. Additionally, the material is strong enough to withstand breaking waves. Modern surfboards are made of polyurethane or polystyrene foam covered with layers of fiberglass cloth, with a polyester or epoxy resin, though some boards are experimenting with carbon fiber and Kevlar composites. Incremental, quality of life changes to the surfing experience, like combining a suction cup with a surgical cord to create a surf leash, also helped adapt surfboards to modern needs and increase portability. Surfboards now exist for almost every type of wave and skill level.

For example, standup paddle boarding ("SUP") is an extension of prone surfing. A SUP allows boarders to stand on their boards and use a paddle to propel themselves through water. Some have combined the SUP with a hydrofoil, a lifting surface that operates in water, to create a foilboard. A foilboard is a surfboard with a hydrofoil that extends below the board into the water. This design causes the board to leave the surface of the water at variable speeds. The hydrofoil uses a stand-up design that allows a rider to glide with a moving wave.

However, a foilboard relies on harnessing swell energy to propel a rider. As speed increases, a foilboard creates lift. Instead of creating drag, speed is increased because the foilboard is lifted out of the water. If attached to a craft, such as a boat, the craft must be moving fast enough to achieve enough fluid flow speed over the hydrofoil to create lift. For an individual on a board, this requires high athletic ability to operate. Novices who have little experience on a SUP, or who otherwise have little athletic ability, may not be able to easily use a foilboard.

Athletic riders of foilboards have learned to reduce the length of the SUP to shorten the SUP to almost the size of prone surfboards, with some riders eliminating paddles. By using an energetic rocking and pumping motion, these riders are able to ride these boards through flat water between the waves once they have initiated some speed by taking off on a wave or sometimes an ocean swell. Through this vigorous rocking and pumping, these riders are able to propel the board onto the next wave and across considerable distances. Others use a boat to get pulled to start initiating some speed. Once they let go of the rope, they use the pumping and rocking motion to sustain the distance of their ride.

SUMMARY OF THE DISCLOSURE

What is needed is a hydrofoil system that can be used in relatively calm waters like a lake or serene ocean. Further what is needed is a hydrofoil system that may allow amateurs and those with little athletic capability to effectively use a hydrofoil system with limited training or use. This may require a hydrofoil system that may greatly reduce the energy needed to propel the device on flat water by adding buoyancy to the hydrofoil, increasing the lifting wing size, and adding a hinge that allows the wing to reduce downward drag force in a lifting mode. Accordingly, the present disclosure provides for a hydrofoil system that may allow riders to use a light leaning motion to adjust the angle of a front wing to create forward thrust to produce a flow for creating lift. In some aspects, the front wing may tilt to reduce downward drag force in a lifting phase while locking into place during a glide to provide a sustained lift of the paddleboard out of the water. Different materials may be used to enhance the lifting effect.

By reducing the drag force, the energy needed to propel the device forward will be greatly reduced since it reduces the friction of the foil in lifting mode. In some embodiments, this allows a large concave front foil to lock into place to facilitate forward thrust from a pumping action. In some implementations, the larger forward wing with a concave undersurface may allow for more efficient pumping of water to create a forward thrust. In some aspects, a larger wing may greatly increase the device's gliding ability.

In some embodiments, a rear wing may direct an angle of attack of the forward lifting foil while in glide or take-off mode. In some implementations, a skimming sensor may affect a change in the angle of the rear, or hinged, wing to change the angle of attack on the forward lifting foil. In some aspects, this may shift the foil from take-off mode to gliding mode. In some embodiments, a skimming sensor may reduce the angle of the rear foil to reduce the overall friction by putting the fuselage of the hydrofoil in a horizontal mode while gliding with a front foil in a locked position.

In some general aspects, a hydrofoil device may comprise a front wing may include a convex upper surface, a concave lower surface, a front wing curved leading edge; a back wing including an upper surface, a lower surface, a back wing curved leading edge; a fuselage including an elongated body with a recess on a forward portion of the elongated body, wherein the front wing fits within the recess and is connected to a forward portion of the elongated body within the recess and the back wing is connected to an aft portion of the elongated body, a hinge connecting a portion of one or both the convex upper surface and the front wing curved leading edge to the recess, wherein the hinge allows the front wing to pivot within a predefined range; and a strut connected perpendicular to the elongated body, wherein the strut is connectable to a surfboard.

Implementations may include one or more of the following features. In some aspects, the back wing further may include a hinge. In some embodiments, the hinge may be manually adjustable to control an angle of the back wing to the fuselage. In some implementations, the hinge may allow the back wing to fluctuate within a predefined angle range of the back wing to the fuselage depending on one or both a position or motion of the hydrofoil device within water. In some aspects, the front wing may include flexible hydrons. In some implementations, at least a portion of the hydrofoil device may include a buoyant material. In some aspects, the fuselage may comprise carbon fiber. In some embodiments, at least a portion of one or both the front wing and the back wing may include a semi-flexible material. In some implementations, the back wing may include a concave upper surface and a convex lower surface.

In some general aspects, a hydrofoil system may comprise a surfboard; a hydrofoil device may include a front wing that may include a convex upper surface, a concave lower surface, a front wing curved leading edge; a back wing may include an upper surface, a lower surface, a back wing curved leading edge; a fuselage may include an elongate body with a recess on a forward portion of the elongate body, wherein the front wing fits within the recess and is connected to a forward portion of the elongate body within the recess and the back wing is connected to an aft portion of the elongate body, a hinge connecting a portion of one or both the convex upper surface and the front wing curved leading edge to the recess, wherein the hinge allows the front wing to pivot within a predefined range; and a strut connected perpendicular to the elongate body; and a base connecting the strut to the surfboard, wherein the strut connects perpendicular to the surfboard.

Implementations may include one or more of the following features. In some aspects, the strut further may include a hinge mechanism that connects the strut to the fuselage. In some embodiments, the base of the strut may comprise a saddle shape. In some implementations, the surfboard may be comprised of a foam core. In some embodiments, the surfboard may comprise a stand-up paddleboard. In some embodiments, the surfboard may include one or more channels located at the distal end of the surfboard. In some aspects, the strut may comprise a teardrop shape. In some implementations, the back wing many further include a hinge, which may be manually adjustable to control an angle of the back wing to the fuselage. In some aspects, the hinge may allow the back wing to fluctuate within a predefined angle range of the back wing to the fuselage depending on one or both of: (1) a position, and/or (2) motion of the hydrofoil device within water. In some implementations, the hinge further may include a reinforcement region that stabilizes and strengthens the connection between the front wing and the fuselage.

BRIEF DESCRIPTION OF THE DRAWINGS

The accompanying drawings, that are incorporated in and constitute a part of this specification, illustrate several embodiments of the disclosure and, together with the description, serve to explain the principles of the disclosure.

FIG. 13G1 illustrates a front view of an exemplar of a hydrofoil system with a minimum volume fuselage according to some embodiments of the present disclosure.

FIG. 13G2 illustrates a front view of an exemplar of a hydrofoil system with a minimum volume fuselage according to some embodiments of the present disclosure.

FIG. 13I1 illustrates a side view of an exemplar of a hydrofoil system with a minimum volume fuselage according to some embodiments of the present disclosure.

FIG. 13I2 illustrates a side view of an exemplar of a hydrofoil system with a minimum volume fuselage according to some embodiments of the present disclosure.

FIG. 13I3 illustrates an elevated close-up side view of an exemplar of an anhedral wing with minimum volume fuselage according to some embodiments of the present disclosure.

FIG. 13I4 illustrates a front view of an exemplar of a hydrofoil system with a minimum volume fuselage according to some embodiments of the present disclosure.

FIG. 13I5 illustrates a side view of an exemplar of a hydrofoil system with a minimum volume fuselage according to some embodiments of the present disclosure.

FIG. 13I6 illustrates a side view of an exemplar of a hydrofoil system with a minimum volume fuselage according to some embodiments of the present disclosure.

FIG. 13I7 illustrates a side view of an exemplar of a hydrofoil system with a minimum volume fuselage according to some embodiments of the present disclosure.

FIG. 13I8 illustrates a front view of an exemplar of a hydrofoil system with a minimum volume fuselage according to some embodiments of the present disclosure.

FIG. 13I9 illustrates a side view of an exemplar of a hydrofoil system with a minimum volume fuselage according to some embodiments of the present disclosure.

FIG. 13I10 illustrates a front view of an exemplar of a hydrofoil system with a minimum volume fuselage according to some embodiments of the present disclosure.

FIG. 13I11 illustrates a front view of an exemplar of a hydrofoil system with a minimum volume fuselage where it is raked over to starboard according to some embodiments of the present disclosure.

FIG. 13I12 illustrates a front view of an exemplar of a hydrofoil system with a minimum volume fuselage according to some embodiments of the present disclosure.

FIG. 13I13 illustrates a front view of an exemplar of a hydrofoil system with a minimum volume fuselage according to some embodiments of the present disclosure.

FIG. 13I14 illustrates a front view of an exemplar of a hydrofoil system where it is raked over to starboard according to some embodiments of the present disclosure.

FIG. 13J1 illustrates a side view of a legacy hydrofoil system without any braking element.

FIG. 13J2 illustrates a side view of an exemplar of a hydrofoil system with a braking element, according to some embodiments of the present disclosure.

FIG. 16B1, which illustrates a side view of a hydrofoil device with a wide fuselage according to some embodiments of the present disclosure.

FIG. 16B2, which illustrates both a top-down close up view and a side view cross-section of the combined hydrophobic and hydrophilic coating element, according to some embodiments of the present disclosure.

DETAILED DESCRIPTION

The present disclosure provides generally for a hydrofoil system that may allow a surfboard to glide above the water surface. According to the present disclosure, a rider may be able to manipulate a hydrofoil device attached to a surfboard with limited training and athletic ability.

In the following sections, detailed descriptions of examples and methods of the disclosure will be given. The description of both preferred and alternative examples, though thorough, are exemplary only, and it is understood to those skilled in the art that variations, modifications, and alterations may be apparent. It is therefore to be understood that the examples do not limit the broadness of the aspects of the underlying disclosure as defined by the claims.

Figure 1:
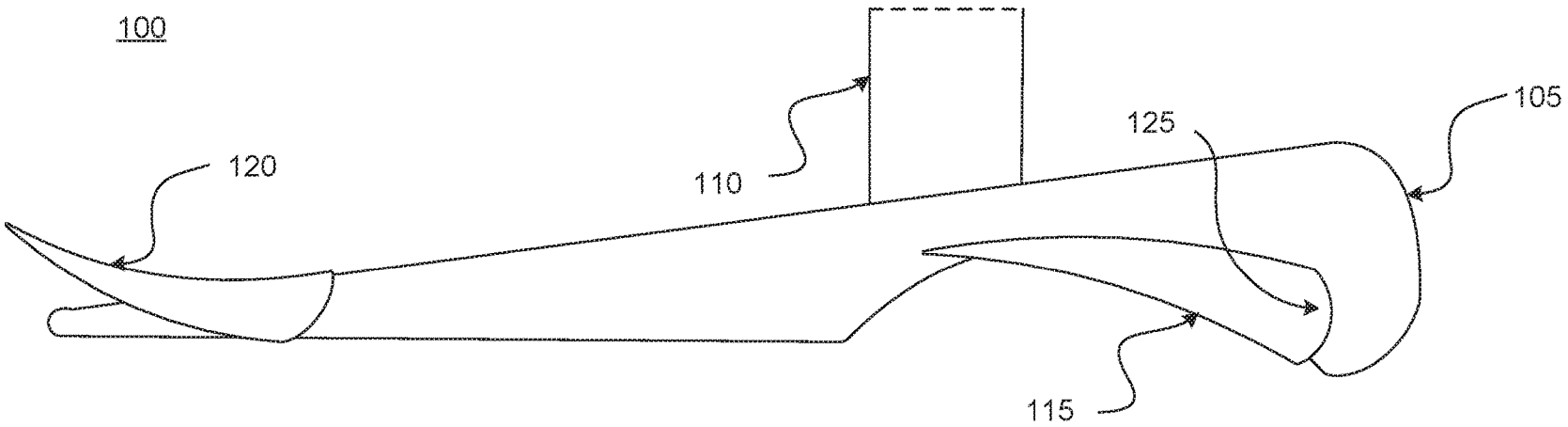
FIG. 1 illustrates an exemplary hydrofoil device, according to some embodiments of the present disclosure.

Referring now to FIG. 1, an exemplary hydrofoil device 100 is illustrated. In some aspects, the hydrofoil device 100 may comprise a fuselage 105 that may be connected to a surfboard (not shown) by a strut 110. Surfboard: as used herein refers to any watercraft device that may be ridden and operated by an individual. As non-limiting examples, a surfboard may comprise a surfboard, a boogie board, a catamaran, a trimaran, a stand-up paddleboard, a canoe, a paddleboat, a raft, a rowboat, or other watercraft vessel capable of being ridden and operated by an individual.

In some embodiments, the hydrofoil device 100 may comprise a front wing 115 and a back wing 120. In some implementations, the front wing 115 may be connected to the fuselage 105 at a hinge point 125. In some embodiments, the back wing 120 may comprise a concave upper surface, which may direct water flow quickly allowing for a faster lift. In some aspects, components of a hydrofoil device may be comprised of a single material or combination of materials, such as polymer foam, wood, fiberglass, carbon fiber, composite, or any other known or convenient materials. In some embodiments, a portion of the hydrofoil device 100 may comprise a buoyant material, which may enhance stability.

In some embodiments, riders may have the ability to choose different models based on level of experience. For example, for children or first-time riders, the hydrofoil device 100 may comprise components with soft edges and materials that may not cause significant damage to other swimmers. As another example, for experienced riders, the hydrofoil device 100 may comprise carbon fiber components to allow for higher speeds.

Figure 2:
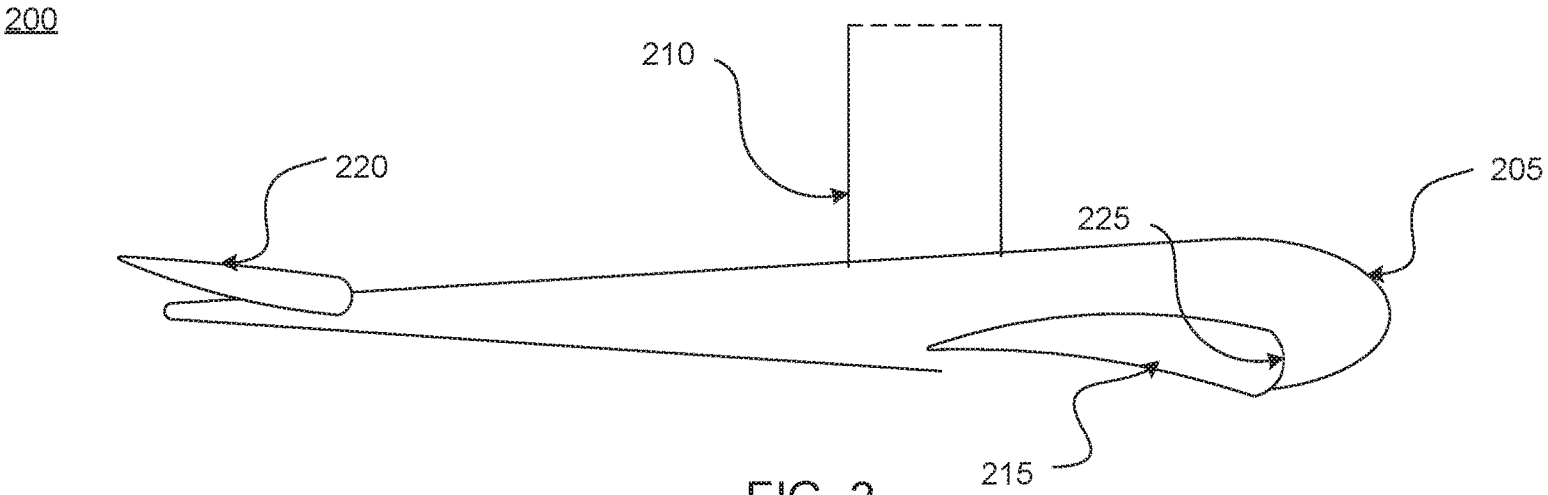
FIG. 2 illustrates an alternate exemplary hydrofoil device, according to some embodiments of the present disclosure.

Referring now to FIG. 2, an alternate exemplary hydrofoil device 200 is illustrated. In some embodiments, the hydrofoil device 200 may comprise a fuselage 205 that may be connected to a surfboard (not shown) by a strut 210. In some aspects, the hydrofoil device 200 may comprise a front wing 215 and a back wing 220. In some implementations, the front wing 215 may be connected to the fuselage 205 at a hinge point 225. In some embodiments, the back wing 220 may comprise a flat upper surface, which may direct water flow more slowly that a curved surface allowing for a slower lift. In some aspects, a slower lift may allow for easier control of the hydrofoil device 200.

Figure 3A:
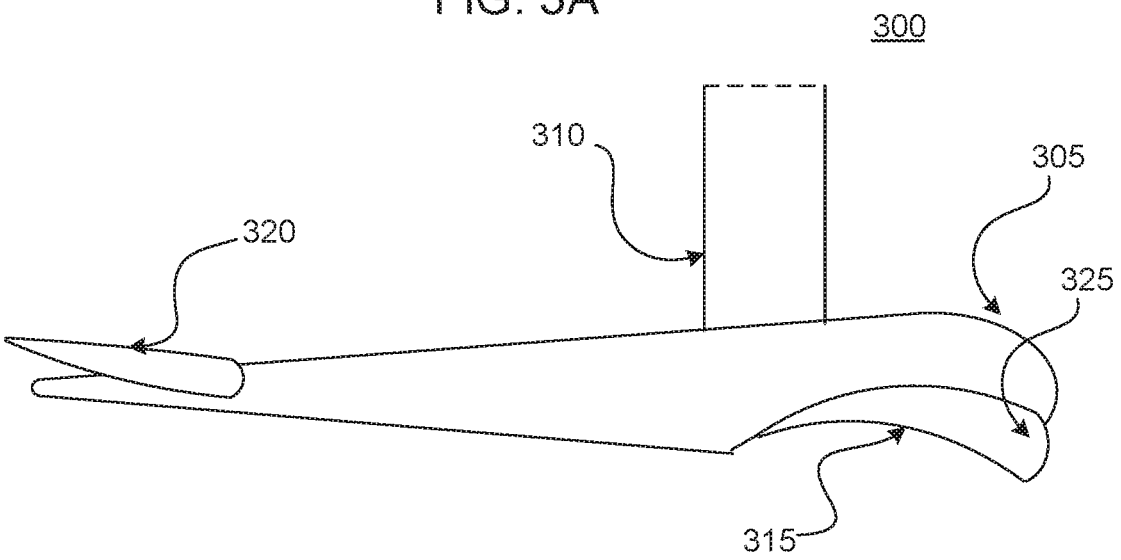
FIG. 3A illustrates an exemplary hydrofoil device in a resting state, according to some embodiments of the present disclosure.
Figure 3B:
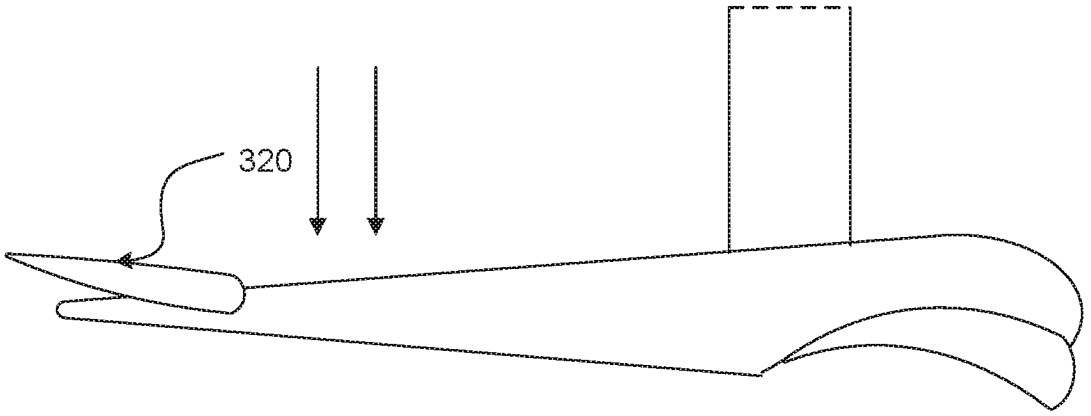
FIG. 3B illustrates an exemplary hydrofoil device in a downward state, according to some embodiments of the present disclosure.
Figure 3C:
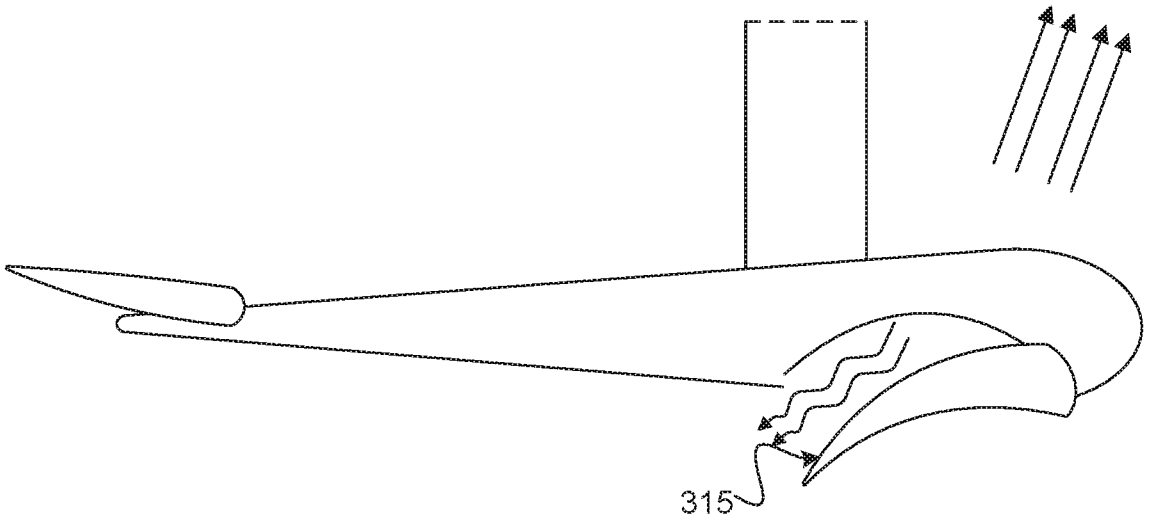
FIG. 3C illustrates an exemplary hydrofoil device in a lifting state, according to some embodiments of the present disclosure.

Referring now to FIG. 3A, FIG. 3B and FIG. 3C, an exemplary hydrofoil device 300 is illustrated in a range of states in the water. In some aspects, a hydrofoil device 300 may comprise a fuselage 305 with a back wing 320 and front wing 315. In some embodiments, the fuselage 305 may comprise an elongated body with a recess, wherein the front wing 315 may fit under the recess. In some implementations, the front wing 315 may be attached to the fuselage 305 by a hinge 325, which may allow the front wing 315 to pivot within a predefined range. In some embodiments, the fuselage 305 may be connected to a strut 310 that may extend perpendicular from the elongated body, wherein the strut 310 may connect the hydrofoil device 300 to a surfboard (not shown).

In some aspects, such as illustrated in FIG. 3A, in a resting position, the front wing 315 may be located within the recess. In some embodiments, such as illustrated in FIG. 3B, when downward pressure is placed on the hydrofoil device 300, the hydrofoil device 300 may thrust downward and water may flow over the back wing 320, which may cause the hydrofoil device 300 to lift within the water. In some implementations, such as illustrated in FIG. 3C, the lift may cause the front wing 315 to pivot away from the fuselage 305, which may cause the water to flow over the front wing 315, and the water flow may propel the hydrofoil device 300 forward. In some aspects, the rider may provide the balance weight to prevent the hydrofoil device 300 from rising above the water level.

Figure 4A:
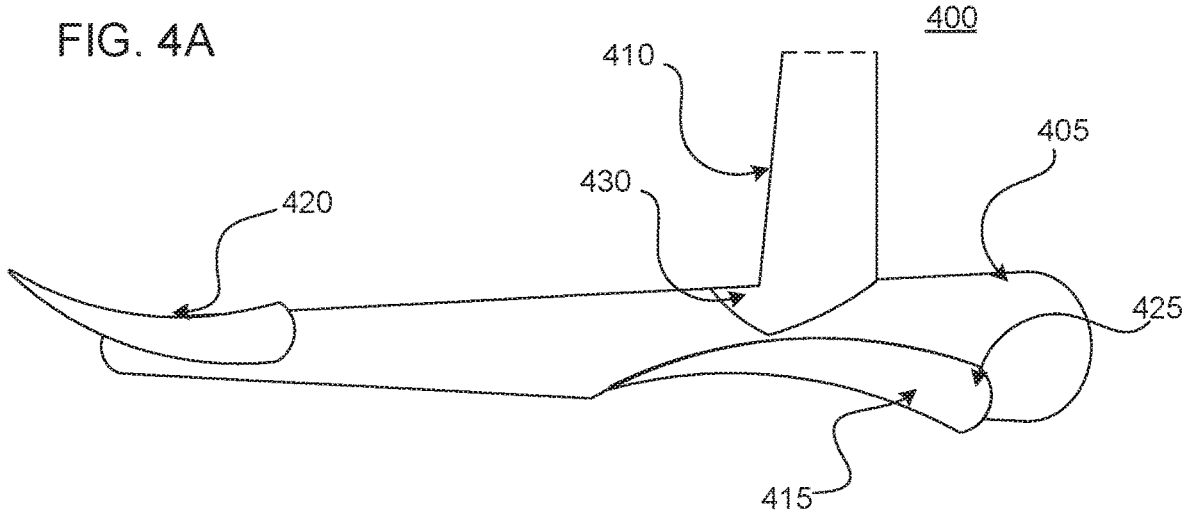
FIG. 4A illustrates an exemplary hydrofoil device in a resting state, according to some embodiments of the present disclosure.
Figure 4B:
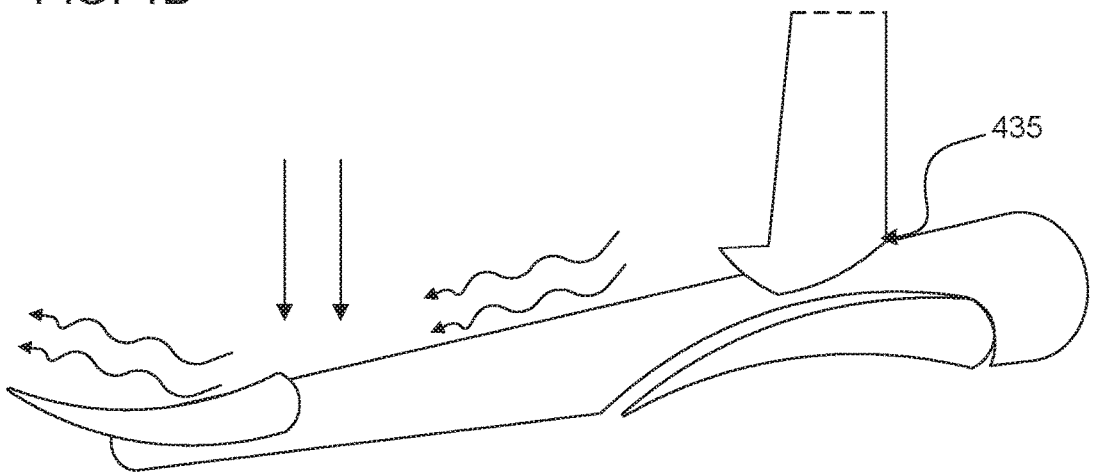
FIG. 4B illustrates an exemplary hydrofoil device in a downward state, according to some embodiments of the present disclosure.
Figure 4C:
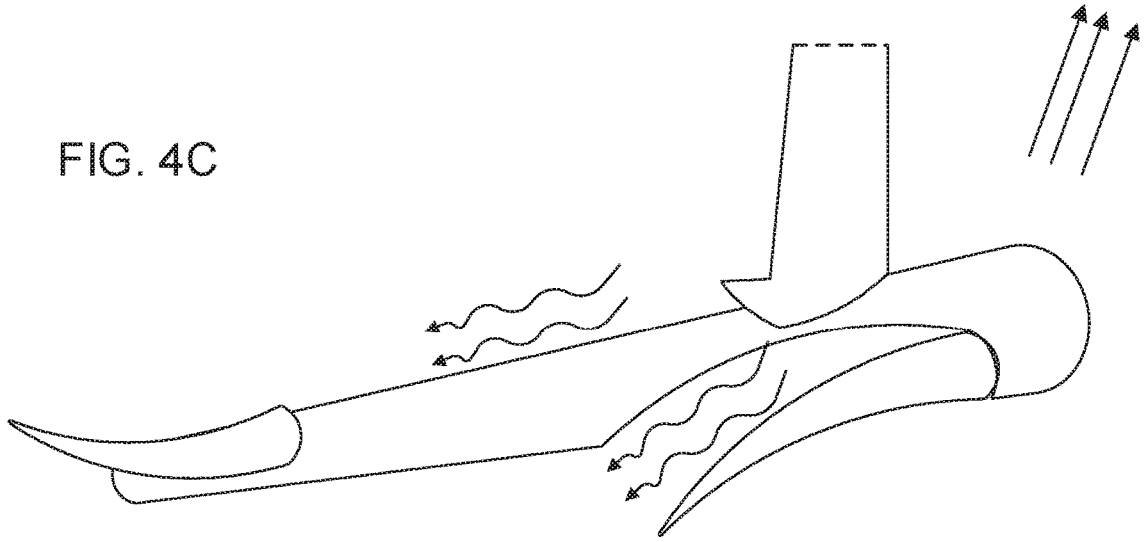
FIG. 4C illustrates an exemplary hydrofoil device in a lifting state, according to some embodiments of the present disclosure.

Referring now to FIG. 4A, FIG. 4B and FIG. 4C, an alternate exemplary hydrofoil device 400 is illustrated in a range of states in the water. In some aspects, a hydrofoil device 400 may comprise a fuselage 405 with a back wing 420 and front wing 415. In some embodiments, the fuselage 405 may comprise an elongated body with a recess, wherein the front wing 415 may fit under the recess. In some implementations, the front wing 415 may be attached to the fuselage 405 by a hinge 425, which may allow the front wing 415 to pivot within a predefined range.

In some embodiments, the fuselage 405 may be connected to a strut 410 that may extend perpendicular from the elongated body, wherein the strut 410 may connect the hydrofoil device 400 to a surfboard (not shown). In some aspects, the strut 410 may comprise a saddle base 430 connected to the fuselage 405 by a strut hinge 435. In some implementations, the saddle base 430 may provide stability and increase the surface area for the strut hinge 435, which may increase durability. In some embodiments, the strut hinge 435 may replace the front wing hinge 425, wherein the front wing 415 may be stationary.

In some aspects, such as illustrated in FIG. 4A, in a resting position, the front wing 415 may be located within the recess. In some embodiments, such as illustrated in FIG. 4B, when downward pressure is placed on the hydrofoil device 400, the hydrofoil device 400 may thrust downward and water may flow over the back wing 420, which may cause the fuselage 405 to pivot at the strut hinge 435. The speed of the water flow over the back wing 420 may increase, which may cause the hydrofoil device 400 to lift within the water. In some implementations, such as illustrated in FIG. 4C, the lift may cause the front wing 415 to pivot away from the fuselage 405, which may cause the water to flow over the front wing 415, and the water flow may propel the hydrofoil device 400 forward. In some aspects, the rider may provide the balance weight to prevent the hydrofoil device 400 from rising above the water level.

Figure 5A:
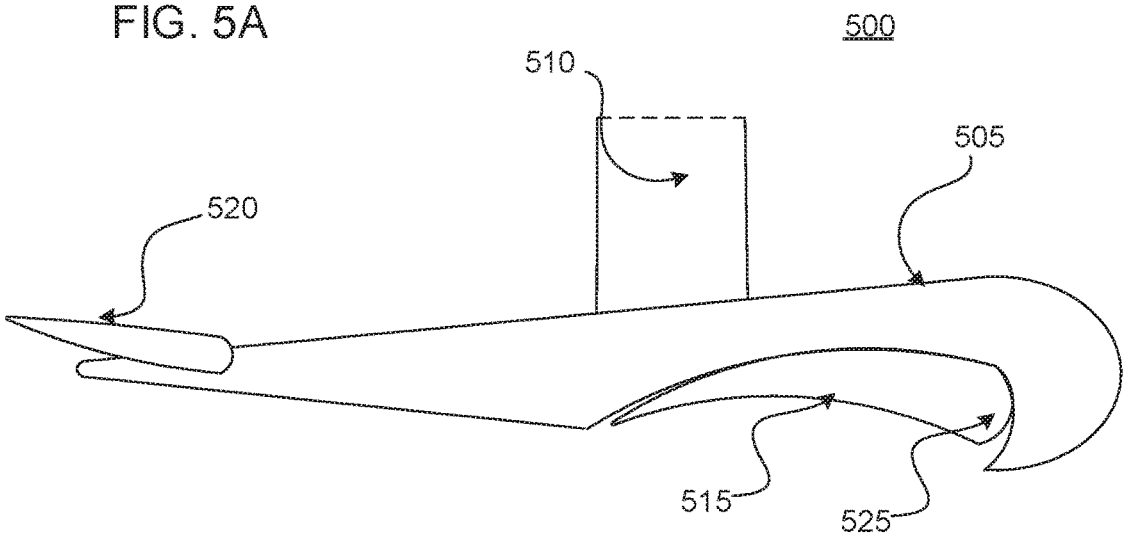
FIG. 5A illustrates an exemplary hydrofoil device in a resting state, according to some embodiments of the present disclosure.
Figure 5B:
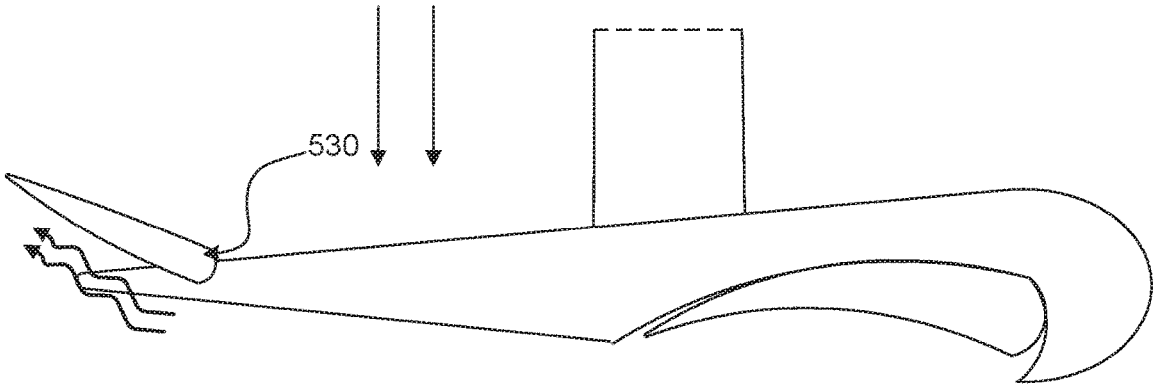
FIG. 5B illustrates an exemplary hydrofoil device in a downward state, according to some embodiments of the present disclosure.
Figure 5C:
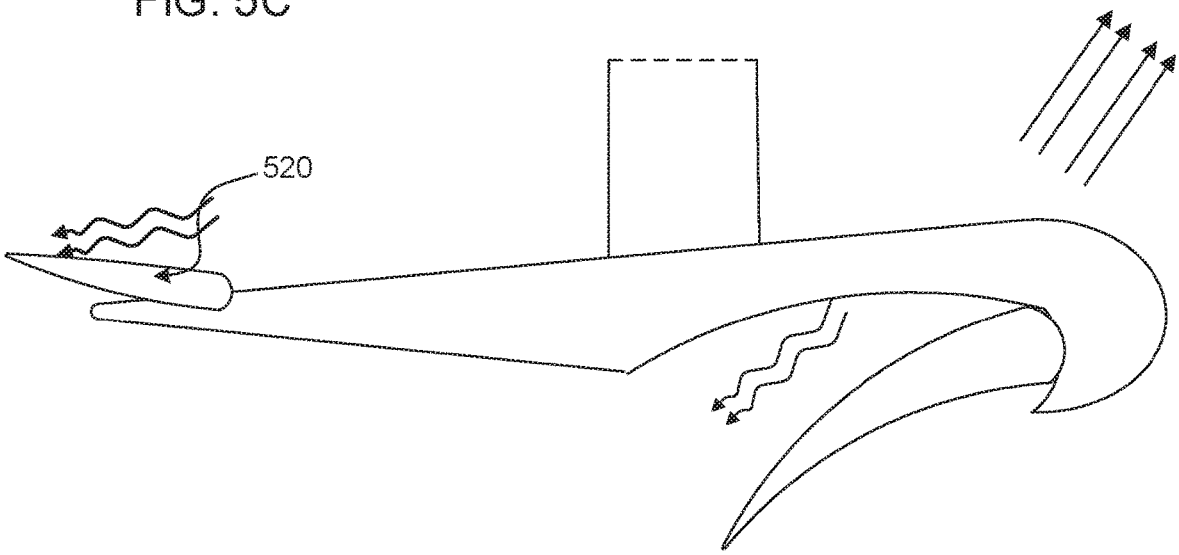
FIG. 5C illustrates an exemplary hydrofoil device in a lifting state, according to some embodiments of the present disclosure.

Referring now to FIG. 5A, FIG. 5B and FIG. 5C, an alternate exemplary hydrofoil device 500 is illustrated in a range of states in the water. In some aspects, a hydrofoil device 500 may comprise a fuselage 505 with a back wing 520 and front wing 515. In some embodiments, the fuselage 505 may comprise an elongated body with a recess, wherein the front wing 515 may fit under the recess. In some implementations, the front wing 515 may be attached to the fuselage 505 by a front hinge 525, which may allow the front wing 515 to pivot within a predefined range. In some embodiments, the back wing 520 may be attached to the fuselage 505 by a back hinge 530, which may allow the back wing 520 to pivot within a predefined range. In some embodiments, the fuselage 505 may be connected to a strut 510 that may extend perpendicular from the elongated body, wherein the strut 510 may connect the hydrofoil device 500 to a surfboard (not shown).

In some aspects, such as illustrated in FIG. 5A, in a resting position, the front wing 515 may be located within the recess. In some embodiments, such as illustrated in FIG. 5B, when downward pressure is placed on the hydrofoil device 500, the hydrofoil device 500 may thrust downward and water may flow under the back wing 520, which may initially cause the back wing 520 to pivot increasing the speed of water flow under the back wing 520, which may cause the hydrofoil device 500 to lift within the water. In some implementations, such as illustrated in FIG. 5C, the lift may cause the back wing 520 to lower, and the front wing 515 to pivot away from the fuselage 505, which may cause the water to flow over the front wing 515. The water flow may propel the hydrofoil device 500 forward. In some aspects, the rider may provide the balance weight to prevent the hydrofoil device 500 from rising above the water level.

Figure 6:
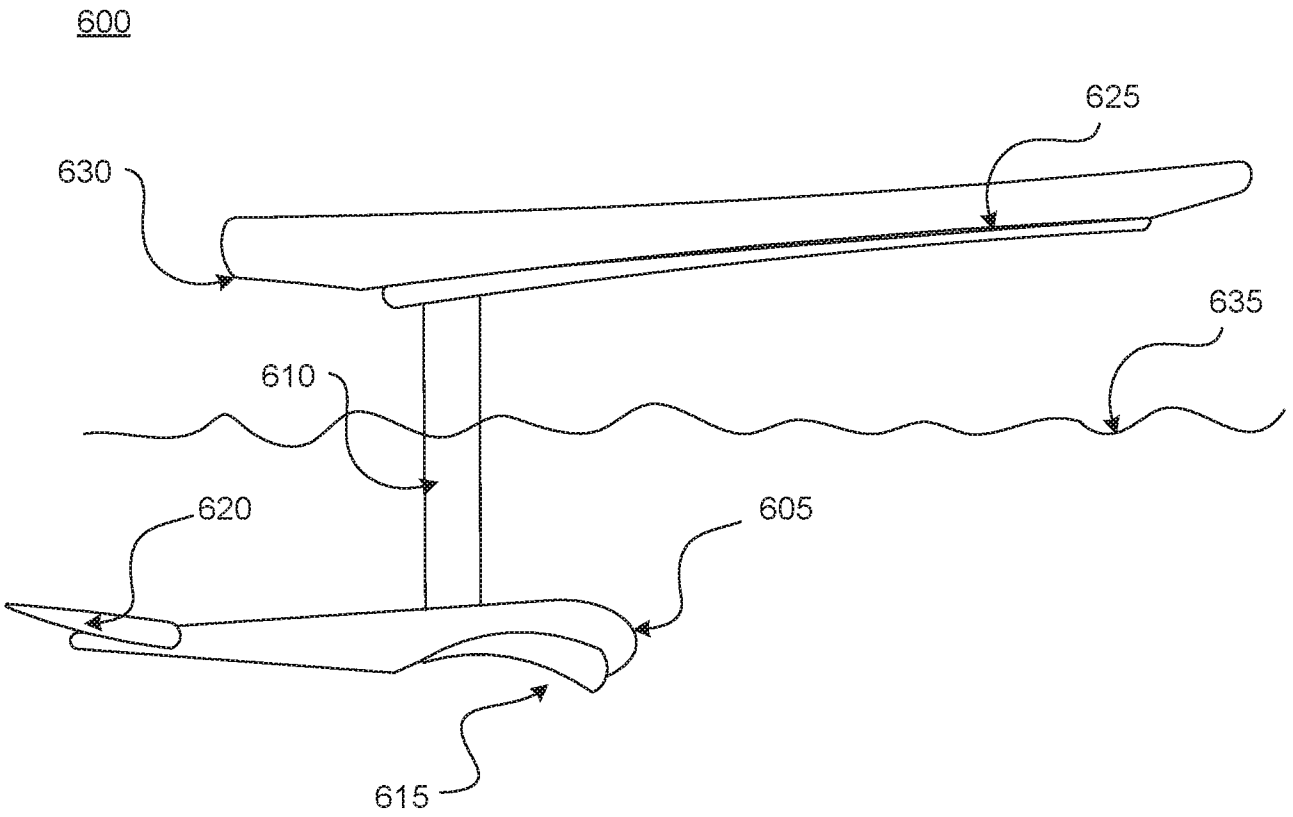
FIG. 6 illustrates an exemplary hydrofoil system, according to some embodiments of the present disclosure.

Referring now to FIG. 6, an exemplary hydrofoil system 600 is illustrated, wherein the hydrofoil system 600 comprises a hydrofoil device 605-620 connected to a surfboard 630. In some aspects, the hydrofoil device 605-620 may connect to the surfboard 630 through a base 625 attached to the surfboard 630. In some embodiments, the base 625 may be configured to accept the strut 610. In some implementations, the base 625 may extend for a portion of the surfboard 630, which may increase the stability of the hydrofoil system 600. In some aspects, the hydrofoil system 600 may allow the surfboard 630 to hover above the water line 635 as the hydrofoil device 605-620 propels through the water. In some aspects, the surfboard may comprise polyurethane or polystyrene foam covered with layers of fiberglass cloth, a polyester or epoxy resin, carbon fiber, or Kevlar composites, as non-limiting examples. In some embodiments, one or more components of the hydrofoil system 600 may be molded, such as with a foam or resin, or machined, such as with wood.

Figure 7A:
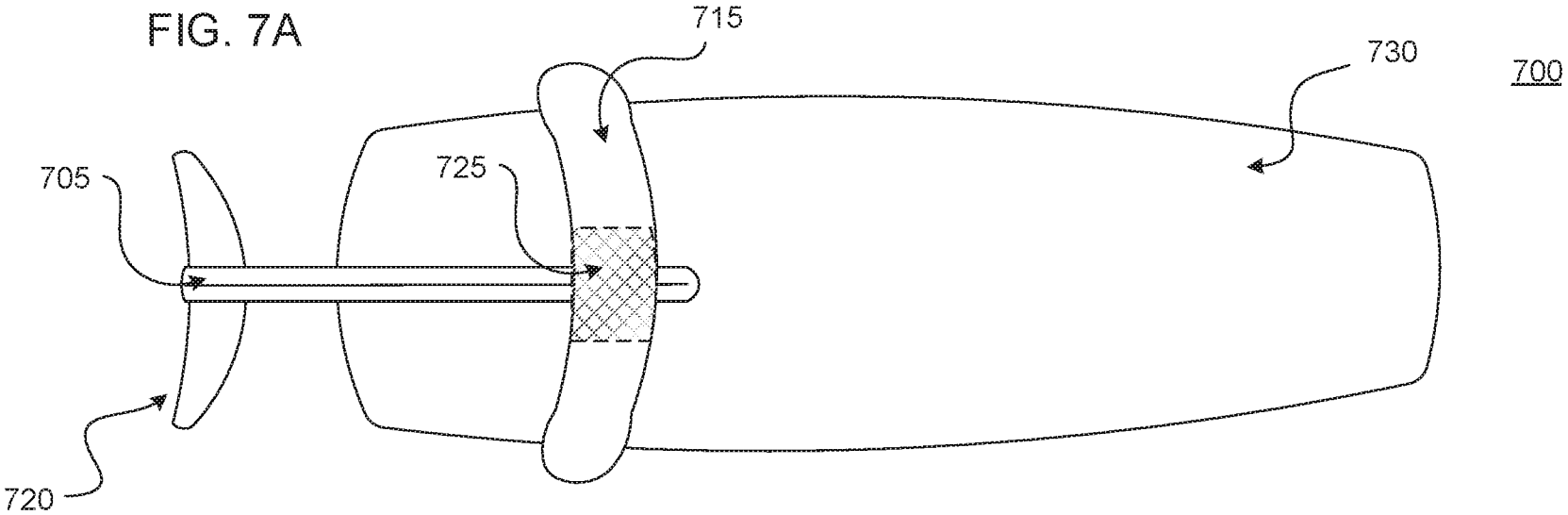
FIG. 7A illustrates a bottom-up view of an exemplary hydrofoil system, according to some embodiments of the present disclosure.
Figure 7B:
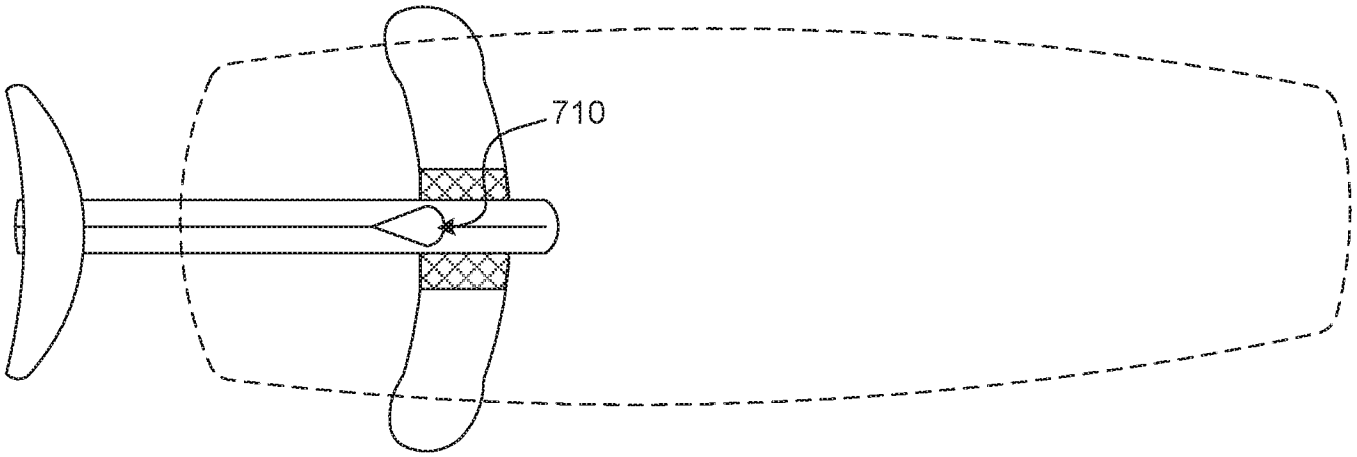
FIG. 7B illustrates a top-down view of an exemplary hydrofoil system, according to some embodiments of the present disclosure.

Referring now to FIG. 7A and FIG. 7B, a bottom-up view of an exemplary hydrofoil system 700 and a top-down view of an exemplary hydrofoil system 700 are illustrated, respectively. In some aspects, the hydrofoil system 700 may comprise a fuselage 705 that runs parallel to a surfboard 730 when connected through a strut 710 that may run perpendicular to one or both the fuselage 705 and surfboard 730. In some embodiments, the hydrofoil system 700 may further comprise a front wing 715 and a back wing 720, wherein the front wing 715 may connect to the lower surface of the fuselage 705 by a hinge 725. In some implementations, the hinge 725 may extend beyond the hinge point, which may increase durability and longevity of the hinge mechanism.

Figure 8A:
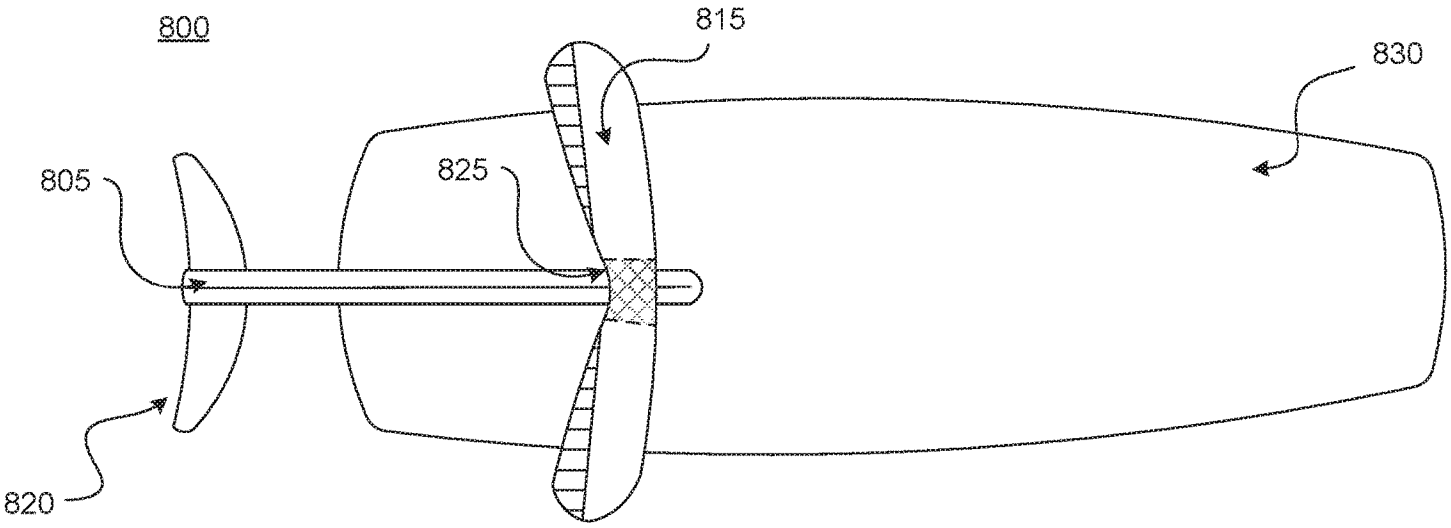
FIG. 8A illustrates a bottom-up view of an alternate exemplary hydrofoil system, according to some embodiments of the present disclosure.
Figure 8B:
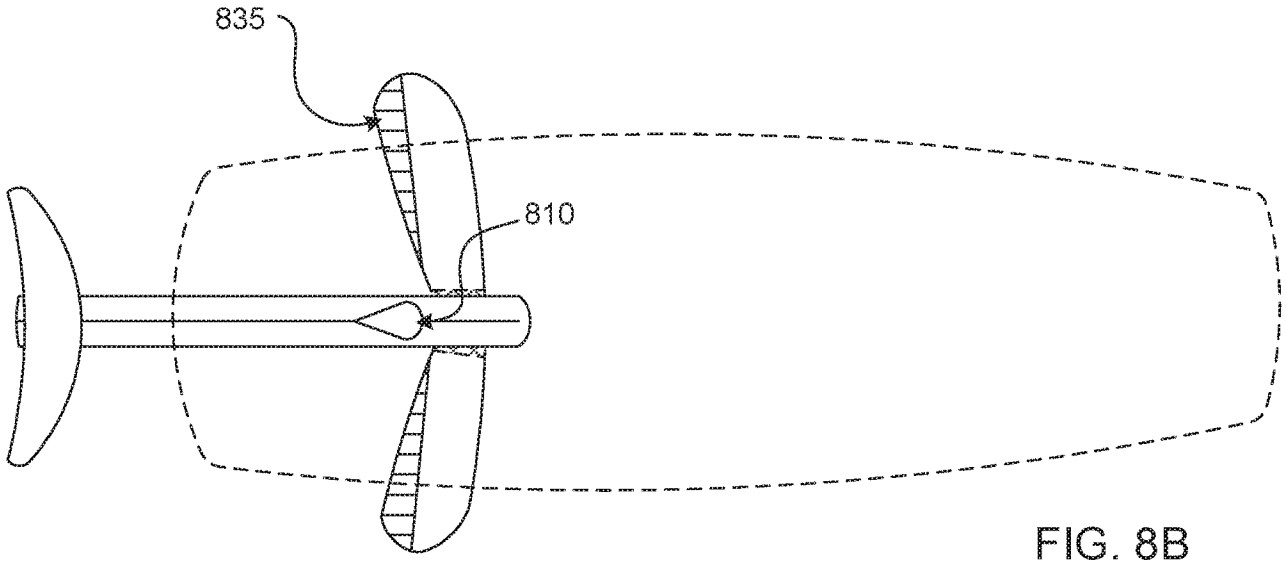
FIG. 8B illustrates a top-down view of an alternate exemplary hydrofoil system, according to some embodiments of the present disclosure.

Referring now to FIG. 8A and FIG. 8B, a bottom-up view of an alternate exemplary hydrofoil system 800 and a top-down view of an alternate exemplary hydrofoil system 800 are illustrated, respectively. In some aspects, the hydrofoil system 800 may comprise a fuselage 805 that runs parallel to a surfboard 830 when connected through a strut 810 that may run perpendicular to one or both the fuselage 805 and surfboard 830. In some embodiments, the hydrofoil system 800 may further comprise a front wing 815 and a back wing 820, wherein the front wing 815 may connect to the lower surface of the fuselage 805 by a hinge 825. In some aspects, the front wing 815 may comprise flexible hydrons 835, which may increase hydrodynamics of the front wing 815 as it glides through water. Hydron: as used herein refers to a hinged surface on a trailing edge of a wing in a hydrofoil, wherein the hinged surface may provide lateral balance control. In some aspects, a hydron may be a hydrofoil equivalent to an aileron, which may be typical of fixed-wing aircraft.

In some aspects, the surfboard may comprise a trimaran, with holes running along the longitudinal axis on both sides of the center pontoon, such that the entire surfboard 830 or at least a portion of the surfboard 830 may be momentarily plunged below the surface of the water to enable a longer stroke needed to pump the forward wings and thus accelerate the foil while in take-off mode. Once there is some speed the trimaran may be completely out of the water, and it may take much shallower pumps to maintain speed in the gliding and pumping phases.

Figure 8C:
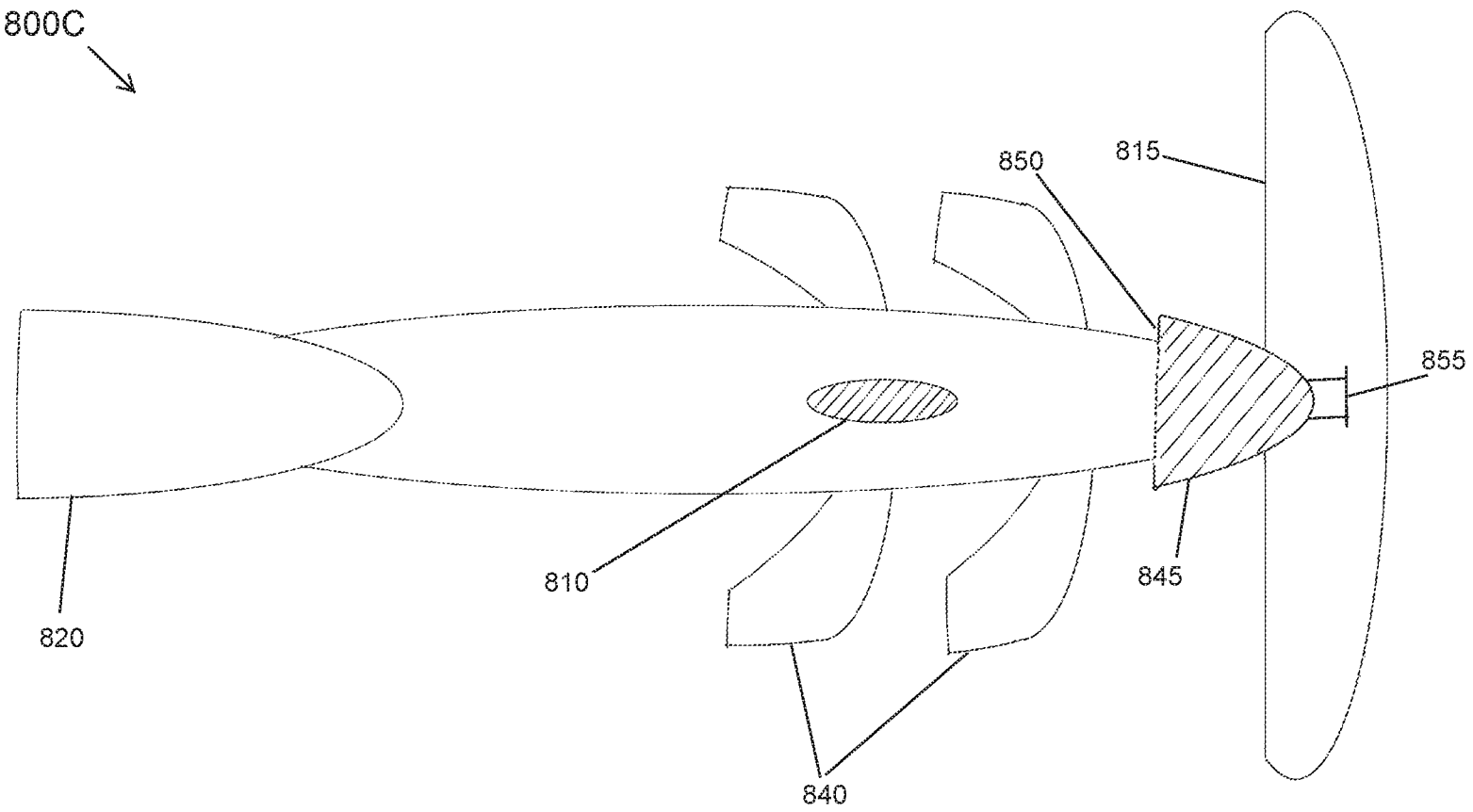
FIG. 8C illustrates a top-down view of an alternate exemplar of a hydrofoil system, according to some embodiments of the present disclosure.

FIG. 8C illustrates a top-down view of an alternate exemplar of a hydrofoil system, according to some embodiments of the present disclosure. From right to left as depicted in this exemplar; the primary wing 815 in the present disclosure may be attached to the fuselage by a hinge 855 on the top forward portion of the wing. This wing may provide the primary lifting force to allow the hydrofoil system to glide, while also providing a propelling force. Directly behind the primary wing 815, an exemplary nose cone 845 is shown which has a circumference that is larger than the fuselage immediately behind it. This may allow for a low-pressure zone 850 to develop as the hydrofoil system is propelled forward through the water. This low-pressure area may allow air to be introduced where it may coat the fuselage to reduce friction, much like a penguin coats it's outer feathers with air when launching itself onto the ice. Behind the exemplary nose cone 845, two sets of propelling wings are depicted 840. These may be hinged or may be mounted in a fixed position with a rigid composition along the leading edges and tapered towards the trailing edges to allow the propelling wings to flex within a predetermined range. These propelling wings 840 may also provide additional lifting force as the hydrofoil system glides, along with the primary wing 815. The strut 810 that attaches the fuselage to the vessel above (not shown) may be attached as depicted between the propelling wings (840). The back wing 820 may comprise a longer low-aspect wing which may resemble a tail fluke of a marine mammal such as a sea lion. Legacy hydrofoil systems generally comprise a high-aspect lifting front wing and a high-aspect stabilizing back wing mounted on a planar fuselage. The present disclosure depicted in this exemplar improves on the state of the art because the low-aspect stabilizing back wing as depicted in this exemplar reduces friction through the water which would otherwise result from a high-aspect wing with wider leading edge.

Figure 8D:
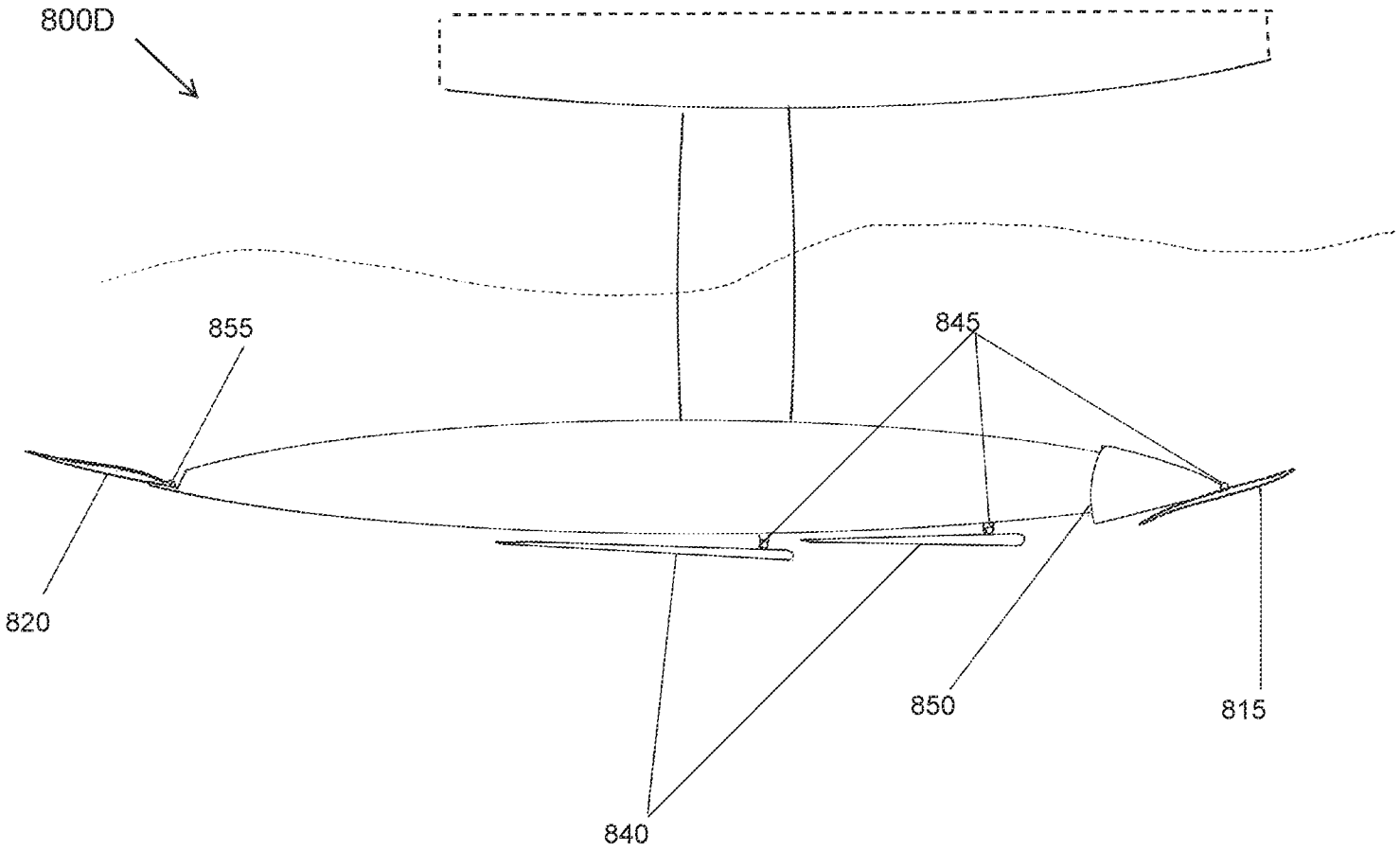
FIG. 8D illustrates a side-view of an alternate exemplar of a hydrofoil system, according to some embodiments of the present disclosure

FIG. 8D illustrates a side-view of an alternate exemplar of a hydrofoil system, according to some embodiments of the present disclosure. From right to left, this exemplar illustrates the primary gliding and propelling wing 815 mounted on the nose cone at the front of the fuselage. This primary wing may be also be rigidly attached without a hinge, as the hinged propelling wings 840 would provide the propelling force by themselves. Directly behind the primary wing 815, an exemplary nose cone 845 is shown which has a circumference that is larger than the fuselage immediately behind it. This may allow for a low-pressure zone 850 to develop as the hydrofoil system is propelled forward through the water. This low-pressure area may allow air to be introduced where it may coat the fuselage to reduce friction, much like a penguin coats it's outer feathers with air when launching itself onto the ice. The back wing 820 as shown in this exemplar may be attached with a hinge 855 to the fuselage.

Figure 9:
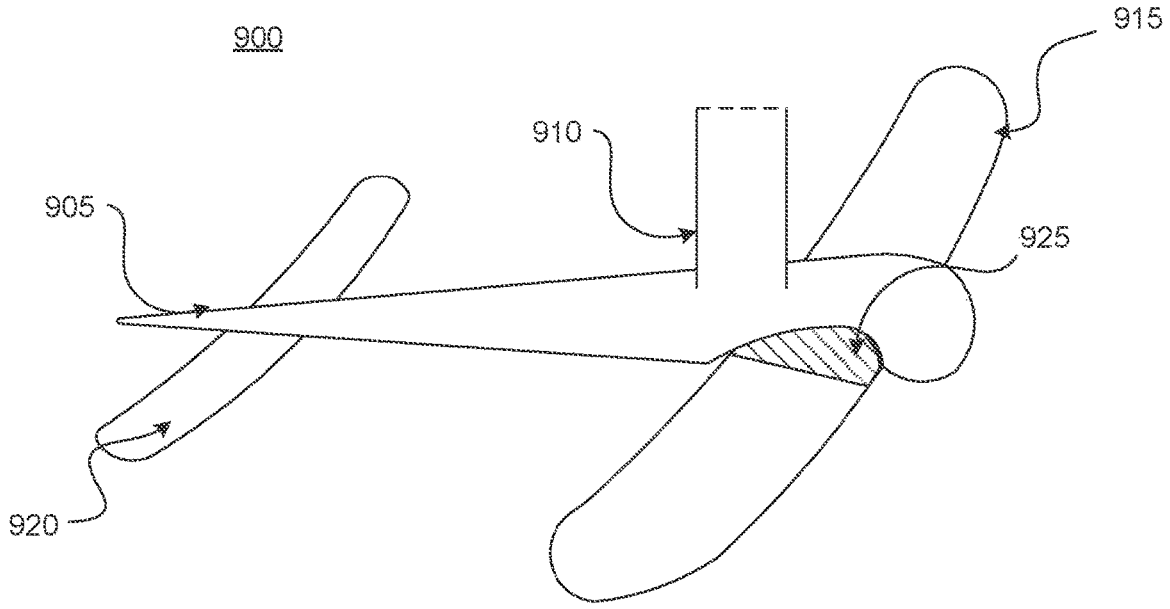
FIG. 9 illustrates a perspective view of an exemplary hydrofoil device, according to some embodiments of the present disclosure.

Referring now to FIG. 9, a perspective view of an exemplary hydrofoil device 900 is illustrated. In some aspects, the hydrofoil device 900 may comprise a fuselage 905 connected to a strut 910, which may extend perpendicular to the fuselage 905. In some embodiments, the hydrofoil device 900 may further comprise a back wing 920 attached to the upper surface of the fuselage 905, and a front wing 915 attached to the lower surface of the fuselage 905, wherein the front wing 915 may attach within a recess by a hinge 925.

Figure 10A:
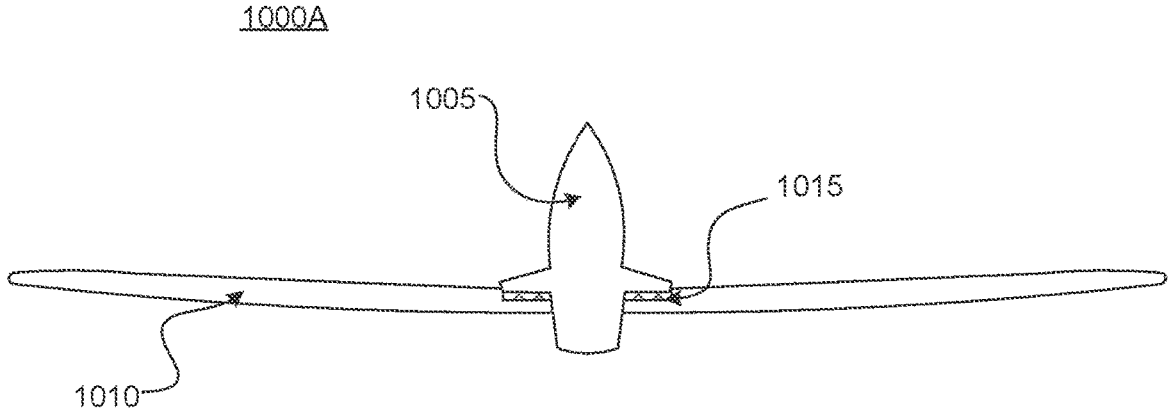
FIG. 10A illustrates a front view of an exemplary hydrofoil device, according to some embodiments of the present disclosure.

Referring now to FIG. 10A, a front view of an exemplary hydrofoil device 1000 is illustrated. In some aspects, the hydrofoil device 1000 may comprise a front wing 1010, which may connect to the fuselage 1005 by a hinge 1015. In some embodiments, the fuselage 1005 may have a body shape similar to some fish, such as a tuna, marlin, el dorado, barracuda, as non-limiting examples, which may provide a hydrodynamic shape for glide through water.

Figures 10B, 10C:
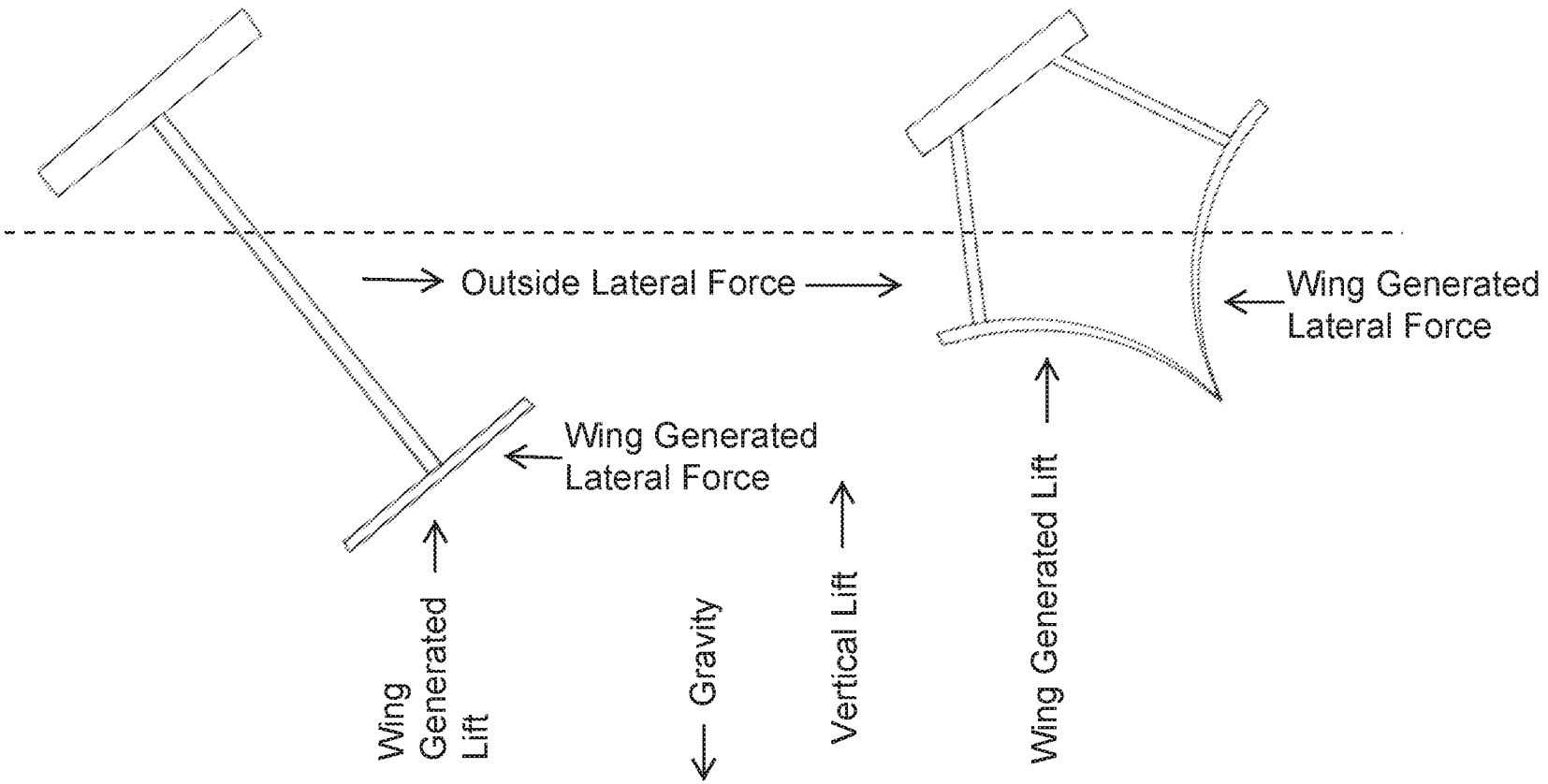
FIG. 10B illustrates a front view of an exemplar or a hydrofoil system, according to some embodiments of the present disclosure.
FIG. 10C illustrates a front view of an exemplar or a hydrofoil system, according to some embodiments of the present disclosure.

Referring now to FIG. 10B and FIG. 10C, front views of two different types of hydrofoils are illustrated. FIG. 10B illustrates a legacy hydrofoil system, utilizing the legacy horizontal lifting wing shown while angled against the outside lateral force created when carving a turn, or when resisting the lateral pull of a boat or a kite. FIG. 10C illustrates an embodiment of the disclosed hydrofoil system utilizing both a pair of anhedral wings above and a pair of dihedral lifting wings below. Here, shown with the starboard dihedral wing fully submerged, and the port side dihedral wing partially submerged. Also, as with the legacy hydrofoil system depicted in FIG. 10B, FIG. 10C demonstrates the disclosed hydrofoil system at an angle necessary to resist the same outside lateral forces as would be applied to the legacy hydrofoil system. There are many inherent defects in legacy hydrofoil systems. Unfortunately, for systems that utilize single struts and horizontal lifting wings, when a foilboard rider leans into a carving turn, whether being self-propelled or while surfing; or when being towed by a boat or a kite, the physics involved often require a very long strut to keep the board above the water. This is because the amount of vertical wing generated lift provided by the now angled horizontal wing decreases as it is angled away from the vertical downward force of gravity and it must also be angled against the outside lateral forces created when carving a turn, or as when resisting the lateral pull of a boat or a kite. As the wing-generated vertical lift provided by the wing decreases, the wing is angled away from the downward force of gravity, and the board might unwantedly contact the surface of the water and thereby cause substantial friction, as shown by its close proximity to the surface in FIG. 10B. Additionally, as the hydrofoil system begins to carve through a turn, in order to resist the increasing outside lateral forces, the horizontal wing which is parallel to the board must correspondingly be angled away from its optimal lifting attitude in direct opposition to the force of gravity, to also oppose increasing lateral forces. In contrast to the single lifting wing of the legacy hydrofoil system FIG. 10B, the disclosed hydrofoil system with the pair of dihedral wings FIG. 10C, simultaneously creates both wing generated lifting force in direct opposition to the downward force of gravity as shown here with the starboard dihedral wing, while concurrently generating lateral force in opposition to the outside lateral forces as shown here with the portside dihedral wing. Moreover, when a foilboard operator is sailing upwind and needs to resist the powerful lateral pull of a kite, the operator must angle the normally horizontal wing to direct lift away from the pull of the kite, and thus a long strut is necessary to avoid having the rail of the board contact the water. Additionally, a single long strut creates structural weaknesses that are not present with multiple wings and struts with multiple contact points between board and fuselage, in that the single strut must sustain the full torqueing loads created by the fuselage and attached underwater wings. The present disclosure FIG. C resolves the structural problems and the limited lifting characteristics of the horizontal wings by introducing vee-shaped curved dihedral lifting wings. Moreover, since the pairs of anhedral and dihedral wings replace a non-lifting strut, as is inherent in the design of the legacy hydrofoil systems, there is no parasitic friction. As depicted, even when the disclosed hydrofoil system is raked over as shown, the starboard side dihedral wing is generating a direct vertical lift. The submerged portion of the port side dihedral wing is generating a solid force in opposition to any lateral pull because it is at ninety degrees to the lateral pull.

Figures 10D, 10E:
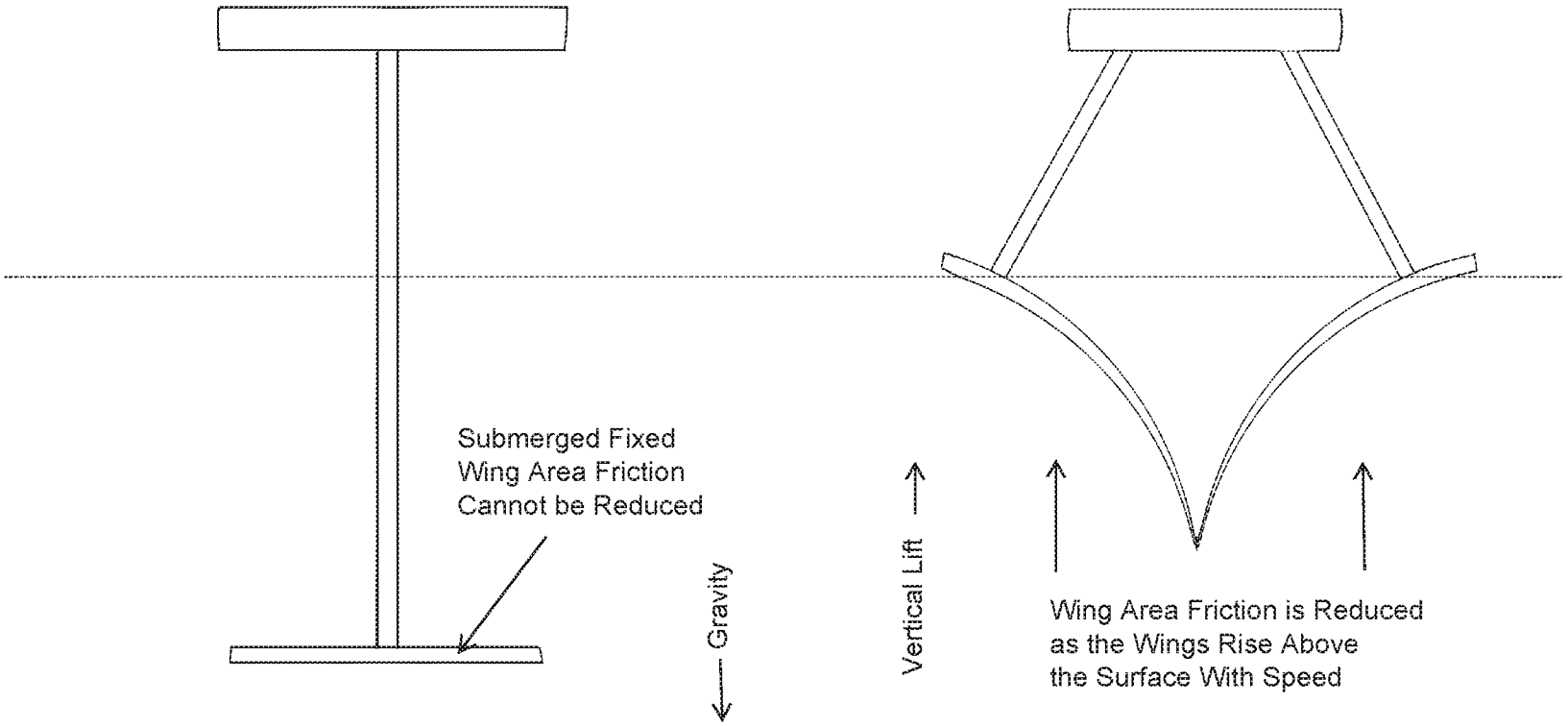
FIG. 10D illustrates a front view of an exemplar or a hydrofoil system, according to some embodiments of the present disclosure.
FIG. 10E illustrates a front view of an exemplar or a hydrofoil system, according to some embodiments of the present disclosure.

Referring now to FIGS. 10D and 10E, wherein FIG. 10D illustrates a front view of a legacy hydrofoil system, and FIG. 10E illustrates a front view of the disclosed hydrofoil system, both are shown in vertical positions. Here the only forces in play are the wings' lifting forces in opposition to gravity. As with the defects identified in the legacy hydrofoil systems as described and illustrated in FIGS. 10B and 10C, other defects inherent in the legacy systems are illustrated here. The horizontal wings as illustrated on the legacy hydrofoil system in FIG. 10D present a defined non-variable wing area that must be forced through the water. It is broadly understood that a given submerged mass moving at increasing speed will eventually cavitate as pressure created by the fixed, non-variable area of the mass ultimately forces the liquid water to vaporize. This results in catastrophic failure for the legacy hydrofoil systems, because once the water is vaporized, the vapor displaces the laminar flow of water on both the upper and lower sides of the wing destroying any lift that had been produced. The present disclosure overcomes this problem by presenting surface-piercing dihedral wings. As speed through the water increases with the present disclosed hydrofoil system, the wings will gradually rise out of the water, thereby reducing friction, since less mass or wing area will need to be forced through the water. Additionally, the curved design of the concave dihedral wings will ensure that they are unlikely to ever completely leave the water regardless of speed since the vertical portion of the wings are closest to where they meet or are attached to the fuselage, depending on the embodiment, thereby preventing the catastrophic failure that is a common problem inherent to the design of the legacy hydrofoil systems.

Figure 11A:
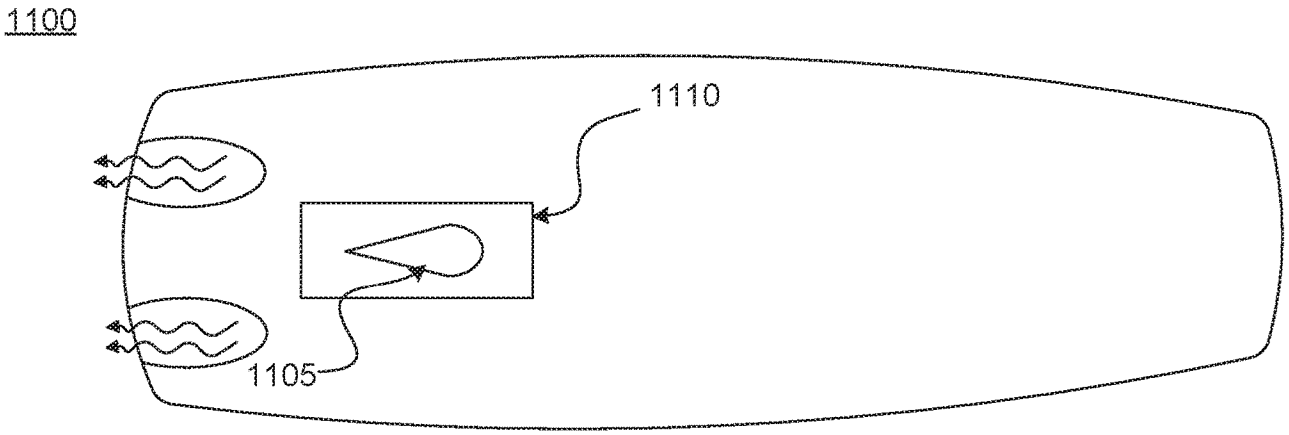
FIG. 11A illustrates a bottom-up view of an exemplary surfboard for a hydrofoil system, according to some embodiments of the present disclosure.
Figure 11B:
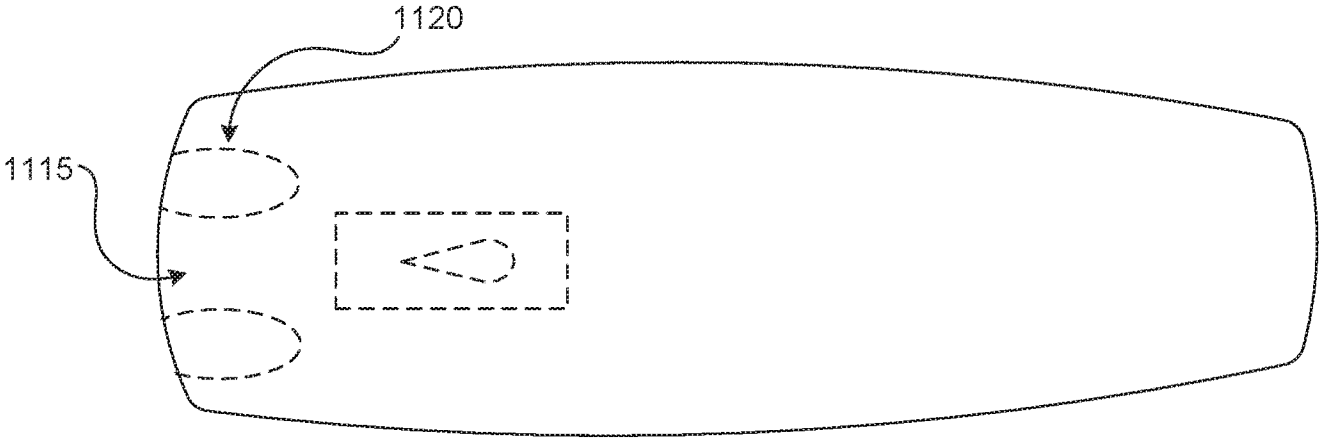
FIG. 11B illustrates a top-down view of an exemplary surfboard for a hydrofoil system, according to some embodiments of the present disclosure.

Referring now to FIG. 11A and FIG. 11B, a bottom-up view of an exemplary surfboard 1115 for a hydrofoil system 1100 and a top-down view of an exemplary surfboard 1115 for a hydrofoil system 1100 are illustrated, respectively. In some aspects, a surfboard 1115 may comprise channels 1120 that may guide water flow through the channels as the hydrofoil system 1100 may gain momentum, until the surfboard 1115 may be lifted above the water line. In some embodiments, the surfboard 1115 may be connected to the hydrofoil device, such as illustrated in FIG. 1 and FIG. 2, through a strut 1105 that may extend perpendicular to the surfboard 1115, wherein the strut 1105 may be secured to the surfboard 1115 through a base 1110.

Figure 12A:
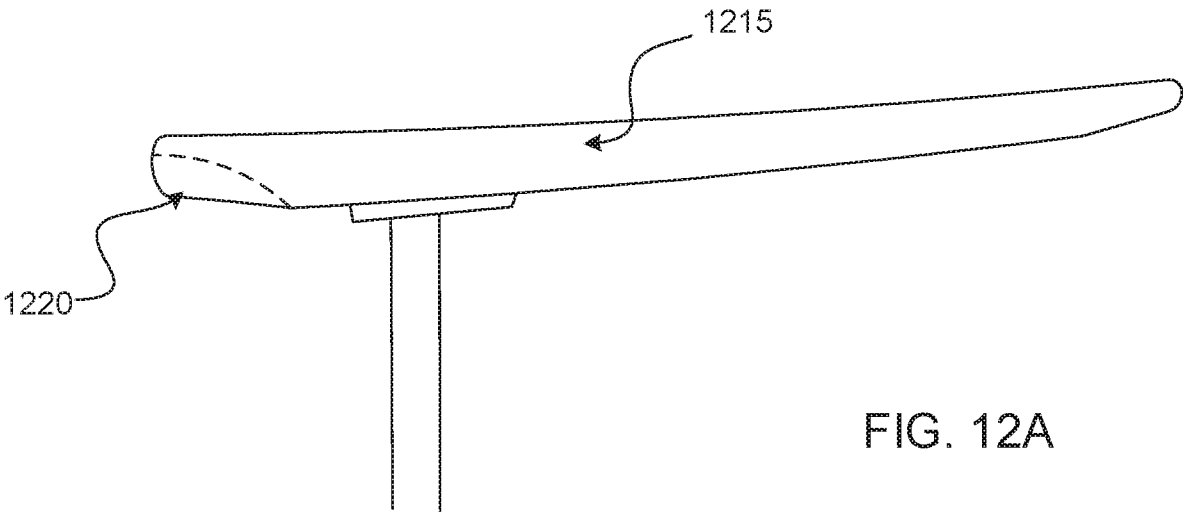
FIG. 12A illustrates a side view of an exemplary surfboard for a hydrofoil system, according to some embodiments of the present disclosure.
Figure 12B:
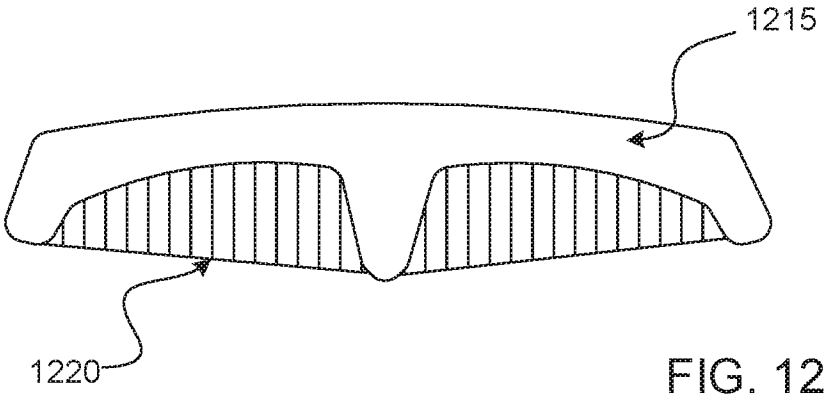
FIG. 12B illustrates a back view of an exemplary surfboard for a hydrofoil system, according to some embodiments of the present disclosure.

Referring now to FIG. 12A and FIG. 12B, a side view of an exemplary surfboard 1215 for a hydrofoil system and a back view of an exemplary surfboard 1215 for a hydrofoil system are illustrated, respectively. In some aspects, the surfboard 1215 may comprise channels 1220 located at the aft portion of the surfboard 1215. In some embodiments, the channels 1220 may comprise a grooved surface, which may increase the effectiveness of the channels 1220.

Figure 13A:
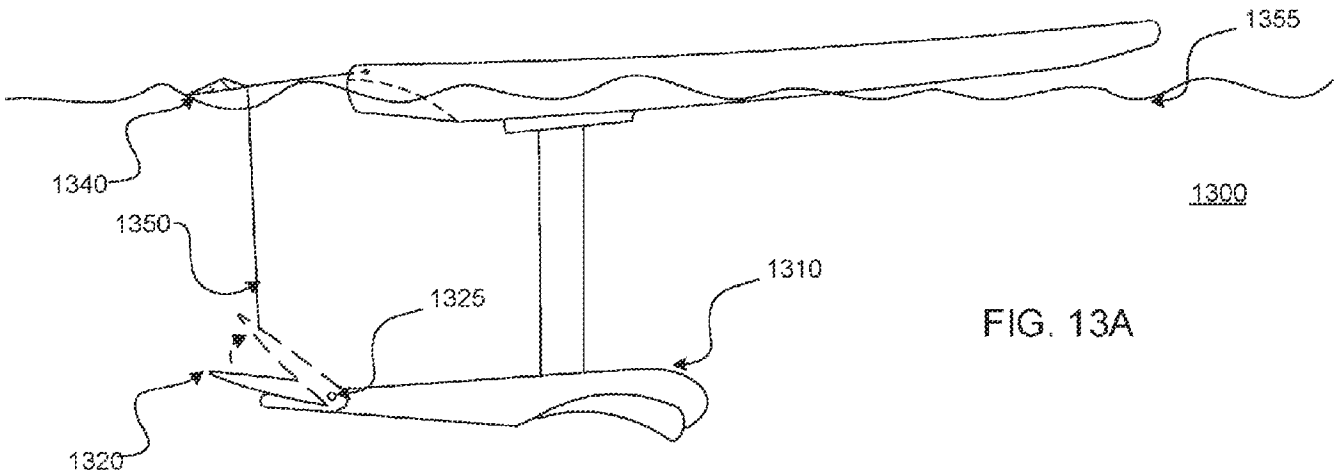
FIG. 13A illustrates an exemplary hydrofoil device with sensor in a resting state, according to some embodiments of the present disclosure.
Figure 13B:
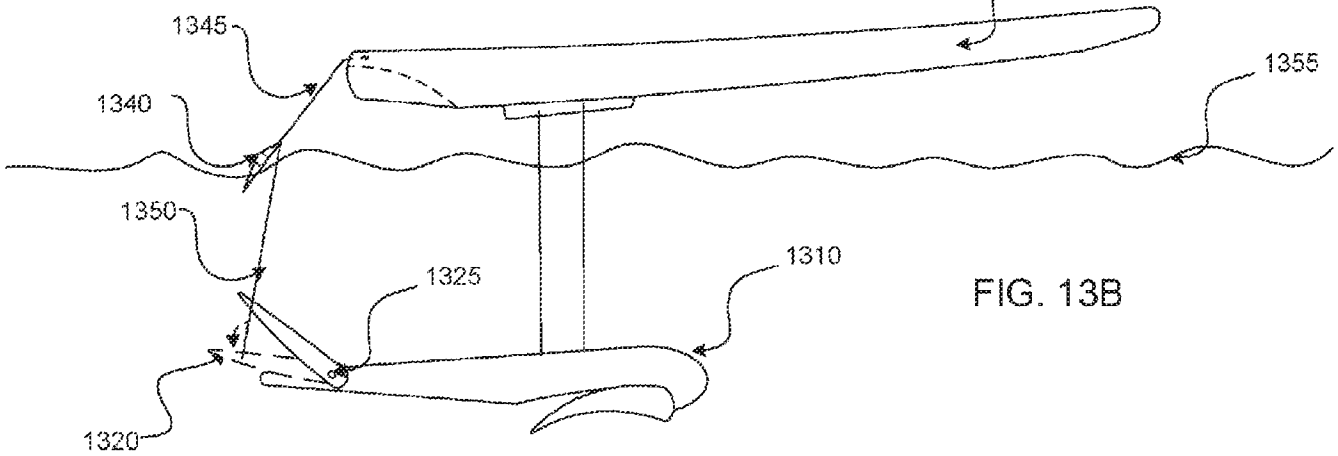
FIG. 13B illustrates an exemplary hydrofoil device with sensor in a lifting state, according to some embodiments of the present disclosure.

Referring now to FIG. 13A and FIG. 13B, side views of an exemplary hydrofoil system 1300 with sensor 1340 are illustrated. In some aspects, a hydrofoil device 1310 may comprise a back wing 1320 that may be connected to the fuselage through a hinge 1325. In some embodiments, the angle of the back wing 1320 may be at least partially controlled by a sensor 1340, which may be connected to an aft portion of the surfboard 1330 through a connection rod 1350.

In some implementations, a control line 1350 may extend from the sensor 1340 or the connection line 1345 to the back wing 1320. In some aspects (not shown), the sensor 1340 may control the position of the back wing 1320 through wireless communication, such as radio frequency (RF), infrared, Bluetooth, near field communication, or other wireless mechanisms.

In some aspects, such as illustrated in FIG. 13A, when the surfboard 1330 is in contact with the water surface 1355, the sensor 1340 may float on the water surface 1355 and may be positioned parallel to the surfboard 1330, which may draw the connection line 1345 up causing the back wing 1320 to pivot. Pulling the back wing 1320 up may cause the hydrofoil device 1310 to lift. In some aspects, such as illustrated in FIG. 13B, the lift may cause the surfboard 1330 to glide over the water surface 1355. As the surfboard 1330 rises out of the water, the connection rod 1345 may shift to almost perpendicular as the sensor 1340 remains on the water surface 1355, which may lower the control line 1350 allowing the back wing 1320 to return to a neutral position.

Figure 13C:
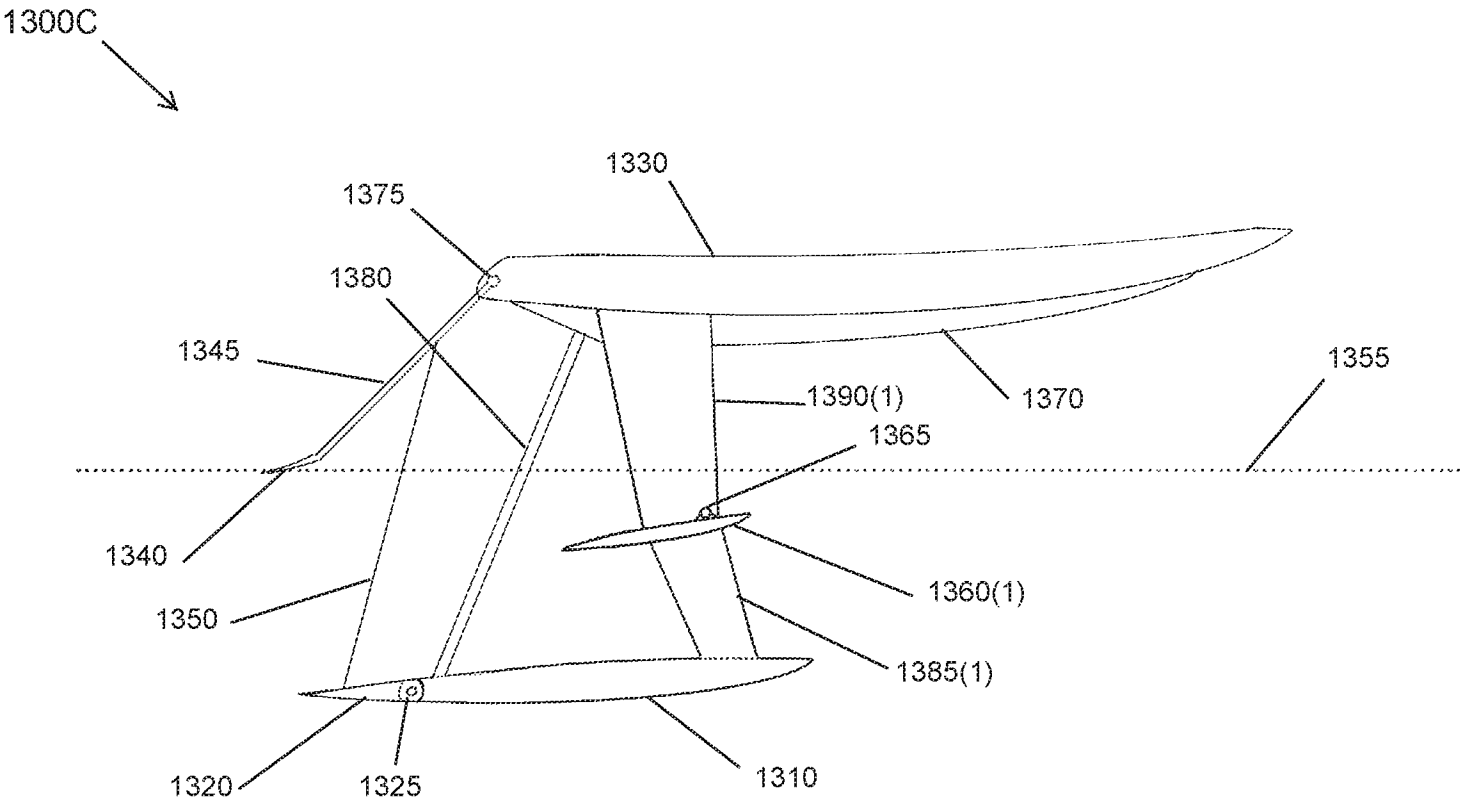
FIG. 13C illustrates a side view of an exemplar of a hydrofoil system according to some embodiments of the present disclosure.

Referring now to FIG. 13C; a right side or starboard side view of an exemplar of a hydrofoil system is illustrated. This depicts a foiling system at low foiling speed, according to some embodiments of the present disclosure. Low foiling speed is apparent in the present disclosure because the horizontal lifting wings 1360(1) and 1360(2) (not shown) are fully submerged below the surface 1355. These horizontal wings may be hinged 1365 and thus may pivot within a predetermined range which may create a propelling force when plunged down into the water. This exemplar illustrates both anhedral wings 1390(1) and 1390(2) (not shown), extending outward and down from lower surface 1370 of the vessel 1330. This lower surface area may be narrower than the vessel or surfboard in order to reduce wetted planing surface area at speed across the surface and, alternatively to allow the operator to more easily plunge the narrower surface into the water to facilitate the propelling effect of the horizontal wings 1360(1). Additional propelling force is created by the dihedral lower wings 1385(1) and 1385(2) (not shown) and the anhedral upper wings 1390(1) and 1390(2) (not shown). This occurs inherently through the foil shape of these high-aspect wings, which are somewhat analogous to the more low-aspect horizontal wings in that the chord thickness of the foil is forward of the center of the angled wings, as with the horizontal wings. The upper anhedral wings are connected to the lower dihedral wings which may be attached to a fuselage 1310 as shown in this exemplar. The sensor 1410 is depicted here as skimming on the surface of the water, as further discussed in the detailed description of FIG. 14. A sensor may be attached by a rod 1345 (FIG. 14A; 1405) to a hinge 1375 on the vessel 1330, which may in turn operate a thin rope or wire 1350 to lift the back wing 1320 which may then adjust the fore and aft angle of the fuselage, thereby setting the angle of attack of the front wings 1360(1) and 1360(2) (not shown) while gliding, depending on the height of the vessel above the water. A second vertical strut 1380 extends from the lower surface 1370 of the vessel and may be attached to the back of the fuselage 1310. As utilized in present disclosure, as depicted, this may create additional structural strength not found in the legacy hydrofoil systems. Curved dihedral lower wings 1385(1) and 1385(2) (not shown) extend from where they connect to the upper anhedral wings 1390(1) and 1390(2) (not shown). A second vertical strut 1380 may be attached to the base 1370, which is attached to the bottom of the vessel 1330. The back wing 1320 may be low-aspect and is shown here attached by a hinge 1325 to the back of the fuselage 1310, according to some embodiments of the present disclosure.

Figure 13D:
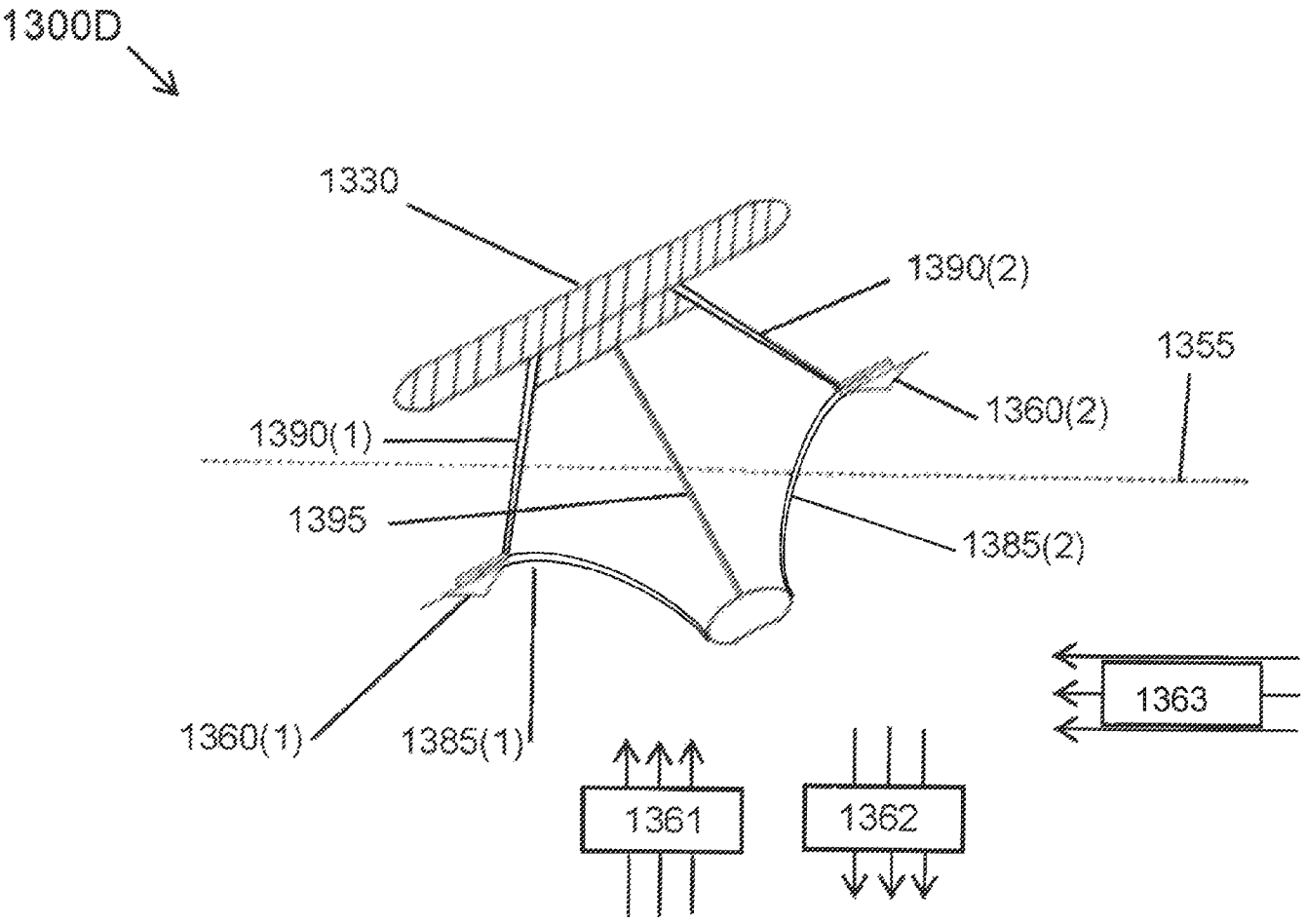
FIG. 13D illustrates a front view of an exemplar of a hydrofoil system where it is raked over to starboard according to some embodiments of the present disclosure.

Referring now to FIG. 13D, which illustrates a front view of an exemplar of a hydrofoil system wherein the vessel 1330 is raked over to starboard, with one horizontal wing 1360 fully submerged while the other horizontal wing is fully exposed. This angle may occur while carving through a turn, or it may occur when angled away from an outside lateral force 1363 as when a boat or a kite is pulling the hydrofoil system. An important aspect of the present device is that the submerged curved dihedral lower wing 1385(1) may exert a vertical force 1361 in direct opposition to gravitational pull 1362, even when the vessel 1330 is raked over as depicted. This solves a serious limitation inherent in the legacy hydrofoil systems wherein the lifting wings are orthogonally oriented to the fuselage, and thus provide efficient vertical lift only when horizontal to the surface of the water. These horizontal lifting wings in the legacy hydrofoil systems also rely on a single vertical strut that is relatively thick and long, sometimes over 42 inches in length (e.g. such as found on racing kiteboards). The structural limitations of the legacy hydrofoil systems are overcome by the disclosed hydrofoil system: Specifically the anhedral upper wings 1390(1) and 1390(2) and dihedral lower wings 1385 along with the first strut 1395 and the second strut (not shown) create additional contact points between the fuselage, beyond the single contact points in the legacy hydrofoil systems. The depicted hydrofoil system with both the curved dihedral wings 1385(1) and 1385(2) and the straight anhedral wings 1390(1) and 1390(2), together with the first vertical strut 1395 and the second vertical strut 1380 also overcome the problem of inherently greater relative friction resulting from the single thicker and longer struts utilized in the legacy hydrofoil systems.

Figure 13E:
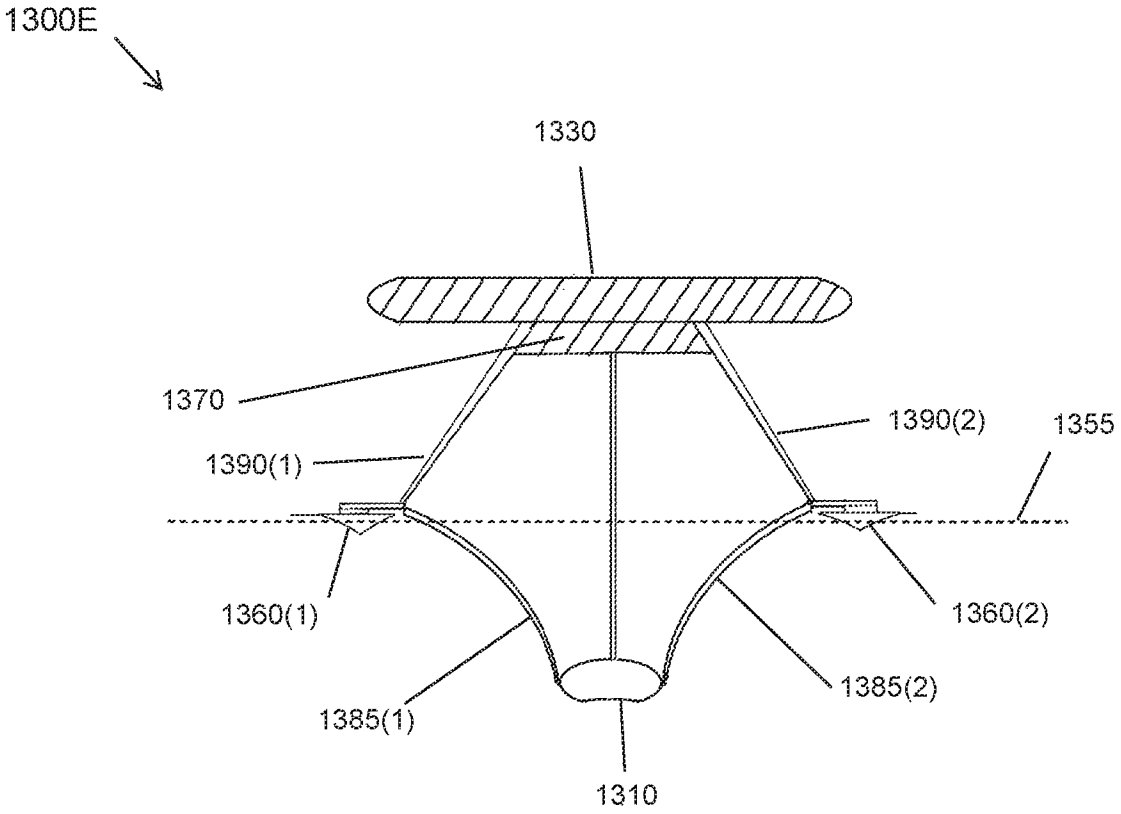
FIG. 13E illustrates a front view of an exemplar of a hydrofoil system according to some embodiments of the present disclosure.

Referring now to FIG. 13E, which illustrates a front view of an exemplar of a hydrofoil system, at a speed wherein both of the horizontal wings 1360 are planing on the surface of the water 1355 while the anhedral wings 1390(1) and 1390(2) are substantially out of the water. It is also foiling on the two curved dihedral lower wings 1360(1) and 1360(2) according to some embodiments of the present disclosure. While the deck of the vessel 1330 is relatively horizontal to the surface of the water, the shape of the horizontal low-aspect wings 1360(1) and 1360(2) causes them to plane on surface, which is similar to how water-skis plane on the surface of water. The flattened fuselage 1310, as depicted in the present disclosure may also generate a vertical force as a lifting-body, as the fuselage moves through the water according to some embodiments of the present disclosure.

Figure 13F:
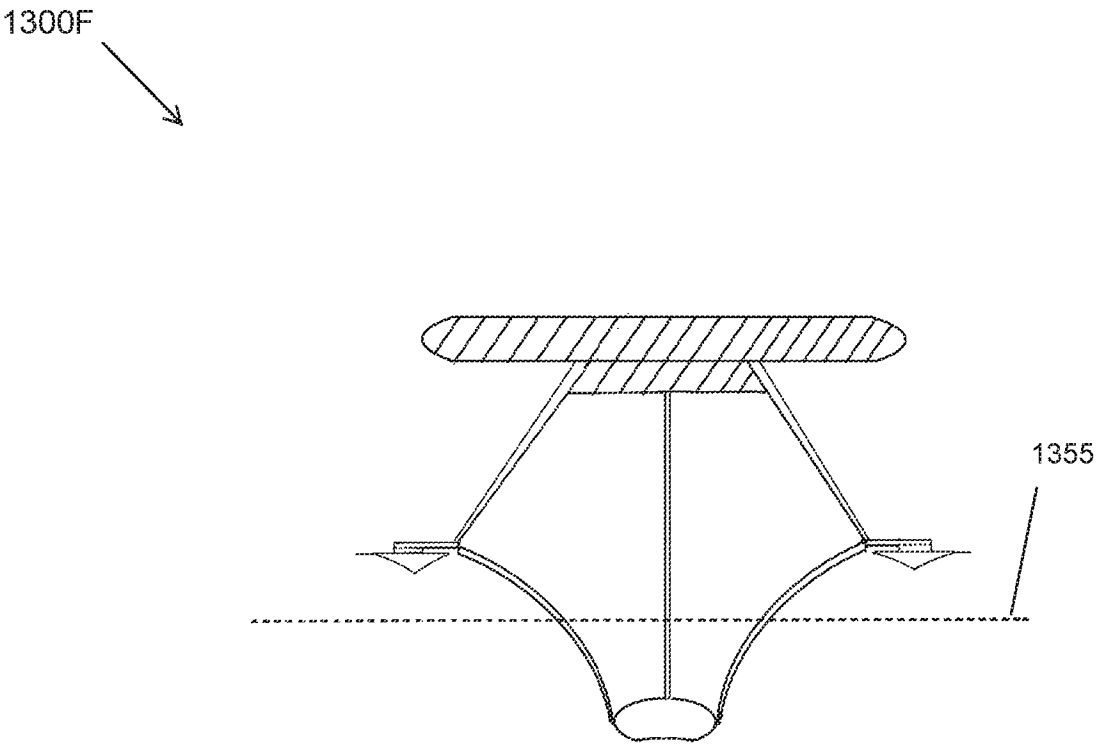
FIG. 13F illustrates a front view of an exemplar of a hydrofoil system according to some embodiments of the present disclosure.

Referring now to FIG. 13F which illustrates a front view of an exemplar of a hydrofoil system, while it is at maximum speed with both of the horizontal wings clear of the water's surface 1355 with the fuselage and the back wing (not shown) are fully submerged according to some embodiments of the present disclosure.

Referring now to FIG. 13G1 which illustrates a front view of an exemplar of a hydrofoil system, while it is near maximum velocity with both of the horizontal wings clear of the water's surface 1355 with a minimal non-buoyant fuselage 1396 submerged, while it is running solely on the curved dihedral lower wings which reduce friction as they rise further above the surface with an increase in speed. Moreover, because of the curved dihedral shape of the lower wings, it is unlikely that the minimal non-buoyant fuselage 1396 and its back wing (not shown) will leave the water; which would result in serious if not complete loss of control. This overcomes an inherent defect in legacy hydrofoil systems wherein once their horizontal wings leave the water, the entire hydrofoil system is clear of the water, resulting in catastrophic loss of control. This will be avoided according to some embodiments of the present disclosure.

Referring now to FIG. G2 which illustrates a front view of an exemplar of a hydrofoil system as depicted in FIG. G1, except in this figure there is a high-aspect horizontal wing 1397 mounted between where the anhedral upper wings meet the dihedral lower wings. This creates additional vertical lift at lower speeds while adding structural strength and stability as a cross-member according to some embodiments of the present disclosure. The vertical front and back struts are not included in the present disclosure. The back wing of the fuselage is not shown.

Figure 13H:
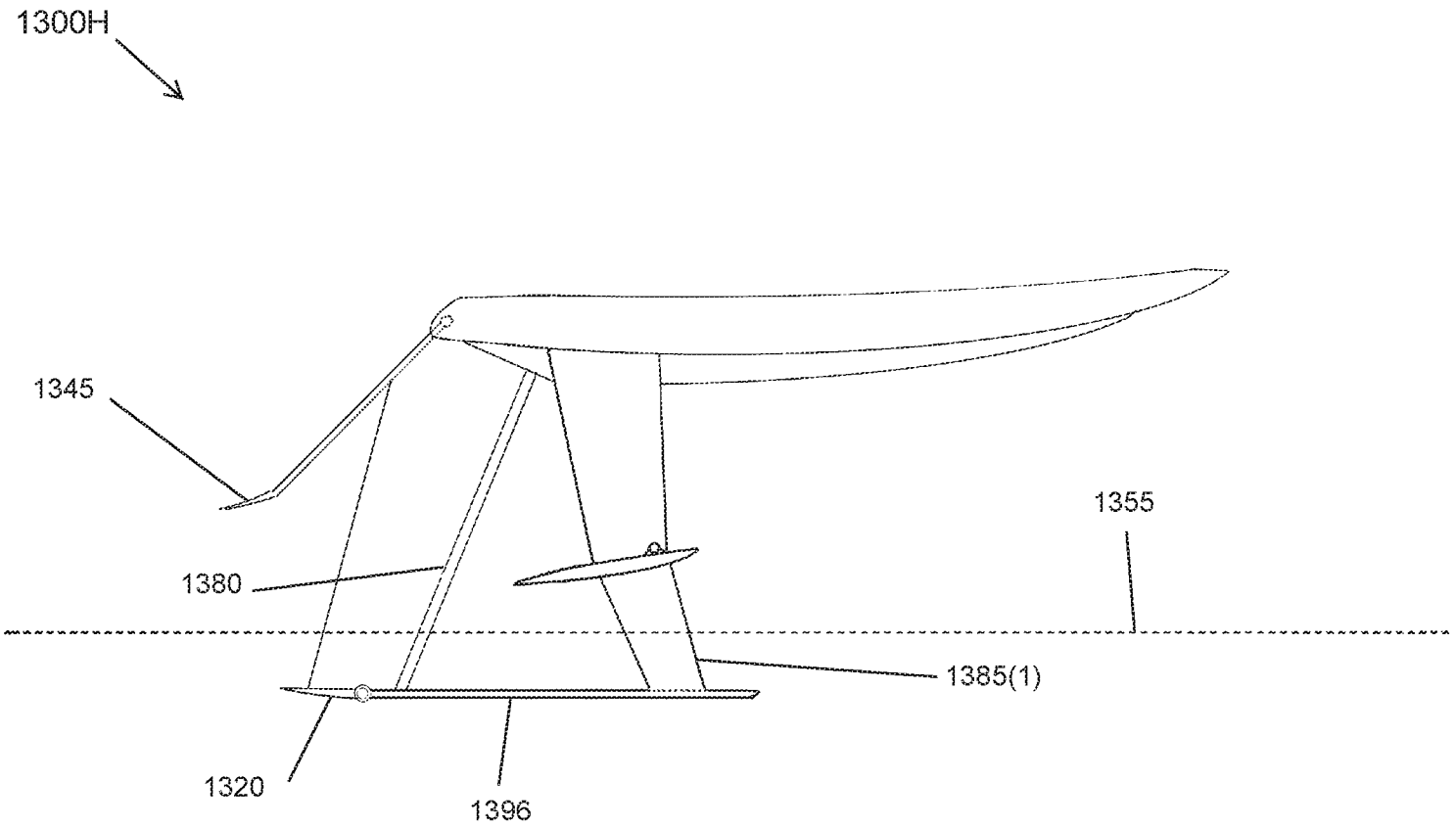
FIG. 13H illustrates a side view of an exemplar of a hydrofoil system with a minimum volume fuselage according to some embodiments of the present disclosure.

Referring now to FIG. 13H which illustrates a side view of an exemplar of a hydrofoil system. It is shown near maximum velocity with both of the horizontal wings clear of the water's surface 1355 with a minimal non-buoyant fuselage 1396 submerged, while it is running solely on the curved dihedral lower wings 1385 which may reduce their wetted surface area and thus friction, as it rises further. The height sensor 1345 and the second strut 1360 are also depicted in the present disclosure. Once the sensor is clear of the water, as depicted, the rider must rely on both the lateral and horizontal stability inherent in the curved lower wings as they pass through the water at great speed. The pressure of the water as it flows along both sides of the wings as they glide through the water at great speed provide sufficient stability for the rider to maintain control of the hydrofoil system. The back wing 1320 is illustrated at its lowest angle, now perpendicular with the fuselage. This minimizes friction since this streamlines the fuselage according to some embodiments of the present disclosure.

Referring now to FIG. 13I1 which illustrates a side view of an exemplar of a hydrofoil system, while it is near maximum velocity with both of the horizontal wings clear of the water's surface 1355 with a minimal non-buoyant fuselage 1396 submerged. The curvatures of the lower dihedral wings result in both a reduction in lift and in friction, thus allowing the rider to maintain control with a minimum of the hydrofoil system under water. This exemplar demonstrates that no vertical struts are necessary according to some embodiments of the present disclosure.

Referring now to FIG. 13I2 which illustrates a side view of an exemplar of a hydrofoil system, while it is near maximum velocity with both of the horizontal wings clear of the water's surface 1355 with a minimal non-buoyant fuselage submerged. The starboard wing of the pair of anhedral wings 1391 is defined by the checked pattern. This figure illustrates non-hinged horizontal wings (also depicted in FIG. 13I4). However, the present disclosure depicts the system gliding on vertical lift solely being generated by the lower dihedral wings 1385(1) and 1385(2) (not shown). Moreover, the pair of dihedral wings in the present disclosure are tapered to narrow where they attach to the fuselage so as to reduce lift as the system rises out of the water, thereby allowing the rider to maintain control at very high speed according to some embodiments of the present disclosure.

Referring now to FIG. 13I3 which illustrates a closeup elevated side view of an exemplar of dihedral wings 1385(1) and 1385(2) depicting how they are tapered to where they are attached to a fuselage according to some embodiments of the present disclosure. This tapering further reduces the friction that they would create while moving through the water.

Referring now to FIG. 13I4 which illustrates a front view of an embodiment of FIG. 13I2 depicting the dihedral lower wings flaring into horizontal wings at their upper tips 1361(1) and 1361(2) according to some embodiments of the present disclosure. An embodiment with a minimally non-buoyant fuselage is depicted, as it is submerged below the surface 1355. The back wing 1320 is shown as being attached at the back of the fuselage. Such a configuration has (1) an upper pair of anhedral wings extending from the surfboard as well as (2) a lower pair of dihedral wings connectable to the minimal non-buoyant fuselage 1396.

Referring now to FIG. 13I5 which illustrates a side view of an exemplar of a hydrofoil system with both upper anhedral wings (shown as the patterned area) and lower dihedral wings, but no fuselage. The lower dihedral wings may be connected at their lowest tips 1395 primarily for structural reasons. A back wing 1321 is attached to a vertical angled strut 1380 extending from the bottom of the foilboard according to some embodiments of the present disclosure.

Referring now to FIG. 13I6 which illustrates a side view of an exemplar of a hydrofoil system with both upper anhedral wings shown as the patterned area, and lower dihedral wings. The lower dihedral wings may be connected at their tips 1395. A back wing is attached to a vertical angled strut 1380 extending from the bottom of the foilboard. The vertical angled strut is further attached to the back of a fuselage 1381 that extends from the back of a high-aspect horizontal wing (not shown) that runs between where the upper anhedral wings meet the lower dihedral wings according to some embodiments of the present disclosure.

Referring now to FIG. 13I6 which illustrates a side view of an exemplar of a hydrofoil system, at the high-speed stage wherein the wings are fully exposed above the surface according to some embodiments of the present disclosure. The curvature and the taper of the lower dihedral wings 1385 result in both a reduction in lift and in friction, thus allowing the rider to maintain control with a minimum of the hydrofoil system under water. This exemplar depicts only the lower dihedral wings and the upper anhedral wings (shown as patterned), the optional horizontal cross wing, if present, is not shown. The optional first strut, if present, is also not shown. The present disclosure depicts the back wing in a non-hinged, fixed position.

Referring now to FIG. 13I7 which illustrates a side view of an exemplar of a hydrofoil system with both upper anhedral and lower dihedral wings. The lower dihedral wings are connected at their tips 1395. A back wing is attached to a vertical angled strut 1380 extending from the bottom of the foilboard. The vertical angled strut is attached to a fuselage 1381 that extends from the back of a high-aspect horizontal wing (not shown) that runs between where the upper anhedral wings meet the lower dihedral wings. The lower dihedral wings on the present disclosure flare out substantially at their tips 1382(1) and 1382(2) not shown, according to some embodiments of the present disclosure.

Referring now to FIG. 13I8 which illustrates a front view of an exemplar of a hydrofoil system with both upper anhedral and lower dihedral wings. The lower dihedral wings 1382(1) and 1382(2) are connected at their tips. A back wing 1321 is attached to a vertical angled strut 1380 extending from the bottom of the foilboard. The vertical angled strut 1380 is attached to a fuselage 1381 that extends from the back of a high-aspect horizontal wing 1397 that runs between where the upper anhedral wings meet the lower dihedral wings 1382(1) and 1382(2). The lower dihedral wings on the present disclosure flare out substantially at their tips 1382(1) and 1382(2) according to some embodiments of the present disclosure.

Referring now to FIG. 13I9 which illustrates a side view of an exemplar of a hydrofoil system with straight anhedral wings extending from the bottom of the foilboard (shown by the patterned area). A minimal fuselage 1381 runs from the back of a high-aspect wing 1397 that connects the anhedral wings approximately at their mid-point according to some embodiments. A back wing 1321 is attached to a vertical angled strut 1380 extending from the bottom of the foilboard which is also attached to the back of a minimal fuselage 1381 according to some embodiments of the present disclosure.

Referring now to FIG. 13I10 which illustrates a front view of an exemplar of a hydrofoil system with straight anhedral wings 1362(1) and 1362(2) extending from the bottom of the foilboard. A minimal fuselage 1381 runs from the back of a high-aspect wing 1397 that connects the anhedral wings. A back wing 1321 is attached to a vertical angled strut 1380 extending from the bottom of the foilboard according to some embodiments of the present disclosure.

Referring now to FIG. 13I11 which illustrates a front view of an exemplar of a hydrofoil system raked over to starboard with straight anhedral wings 1362(1) and 1362(2) extending from the bottom of the foilboard. A minimal fuselage 1381 runs from the back of a high-aspect wing 1397 that connects the anhedral wings. A back wing 1321 is attached to a vertical angled strut 1380 extending from the bottom of the foilboard according to some embodiments of the present disclosure. This figure depicts the vertical lift 1361 created by the horizontal wing 1381 in opposition to gravity 1362. A lateral force 1363 is created by the anhedral wing 1382(1), in opposition to an outside lateral force created by the pull of a boat or a kite, or other implement. This disclosure depicts a hydrofoil system that may reduce lift when carving a turn since the anhedral wing 1382(1) is now more vertical and thus creating less vertical lift 1361, and thus generating more lateral opposing force 1363. Additionally, the horizontal high aspect wing is now at an angle, thus creating less horizontal lift lift in opposition to force of gravity 1362, while creating more lateral force 1363. This may allow the rider to have more control when carving a turn, as overall vertical lift is reduced, and correspondingly more resistance against lateral forces are generated as the engaged anhedral foil is more deeply submerged.

Referring now to FIG. 13I12 which illustrates a front view of an exemplar of a hydrofoil system with short straight anhedral wings which may be buoyant 1363(1) and 1363(2) extending from the bottom of the foilboard. A minimal fuselage 1381 runs from the back of a high-aspect wing 1397 that connects the anhedral wings from their wingtips. A back wing 1321 is attached to a vertical angled strut 1380 extending from the bottom of the foilboard and attached to the back of the fuselage 1381 according to some embodiments of the present disclosure. This embodiment may result in a hydrofoil system that wherein if the horizontal foil reaches the surface, the back wing will still be submerged and thus engaged, reducing the chance of a catastrophic loss of control.

Referring now to FIG. 13I13 which illustrates a front view of an exemplar of a hydrofoil system which may have buoyant relatively short straight anhedral wings 1362(1) and 1362(2) extending from the bottom of the foilboard. A minimal fuselage 1381 runs through a high-aspect wing 1397 that connects the anhedral wings at their tips. Attached to this connection point are two low-aspect wings 1360(1) and 1362(2) that may act as lifting bodies when submerged and as planing surfaces when skimming on the surface, that may also be mounted on hinges. The hinges would allow a propelling forward force should the rider exert a pumping force to the foilboard. The propelling force would augment the propelling force that would also be caused by the downward thrusting of the anhedral wings 1362(1) and 1362(2). A back wing 1321 is attached to a vertical angled strut 1380 extending from the bottom of the foilboard while also attached to the back of the fuselage 1381 according to some embodiments of the present disclosure. This figure illustrates the present hydrofoil system with the two horizontal wings planing on the surface of the water 1355.

Referring now to FIG. 13I14 which illustrates a front view of an exemplar of a hydrofoil system with one of the buoyant straight anhedral wings 1362(1) extending from the bottom of the foilboard and submerged. This wing is creating a lateral force while carving in a turn, or in opposition to an opposing lateral pulling force, or while simply carving against a centrifugal force. A minimal fuselage 1381 runs through a high-aspect wing 1397 that connects the anhedral wings at their tips. Attached to this connection point are two low-aspect wings that may act as lifting bodies and planing surfaces, that may be mounted on hinges. This may also allow a propelling forward force, should the rider exert a pumping force to the board while it is horizontal. The propelling force of the low-aspect wings would augment the propelling force that would also be caused by plunging the anhedral wings down into the water. A back wing 1321 is attached to a vertical angled strut 1380 extending from the bottom of the foilboard and attached at the back of the fuselage 1381 according to some embodiments of the present disclosure. This figure shows that even with the fuselage on the surface of the water, the back wing 1321 is still submerged and creating both stability and setting the angle of attack of the horizontal wing 1397 according to some embodiments of the present disclosure. Additionally, even while raked over to starboard, the horizontal wing is still creating some vertical lift with the submerged portions.

Referring now to FIG. 13J1 which illustrates an exemplar of a legacy hydrofoil system with no braking ability. As shown, the legacy system has a fixed back wing which has no ability to alter position. Further, the should the rider angle the fuselage upwards, as is being demonstrated by the disclosed device, the horizontal lifting wing would breach the surface, and suffer a loss of lift, resulting in catastrophic failure. Referring now to FIG. 13J2, which illustrates the disclosed device wherein the fuselage has been angled upwards, the curved dihedral wings will be unlikely to breach the surface, thereby retaining laminar flow over at least a portion of the wing surfaces. The braking function of the hinged back wing is illustrated as the fuselage is angled upwards, the lower forward portion of the back wing emerges from where it was tucked in behind the fuselage in the slip-stream of the fuselage (shown in detail in FIG. 13K) As the lower forward portion of the back wing emerges it interrupts the laminar flow of water along the bottom of the fuselage, and together with the back portion of the wing it creates a braking effect that may also force the fuselage back to the horizontal, as the foilboard rider releases pressure on their back foot. No braking systems exist in the legacy hydrofoil systems. The disclosed braking system may also allow for dynamic loading of a kite that is being used to tow the disclosed hydrofoil system, and thereby allow for bursts of acceleration that the legacy hydrofoil systems are not capable of.

Figure 13K:
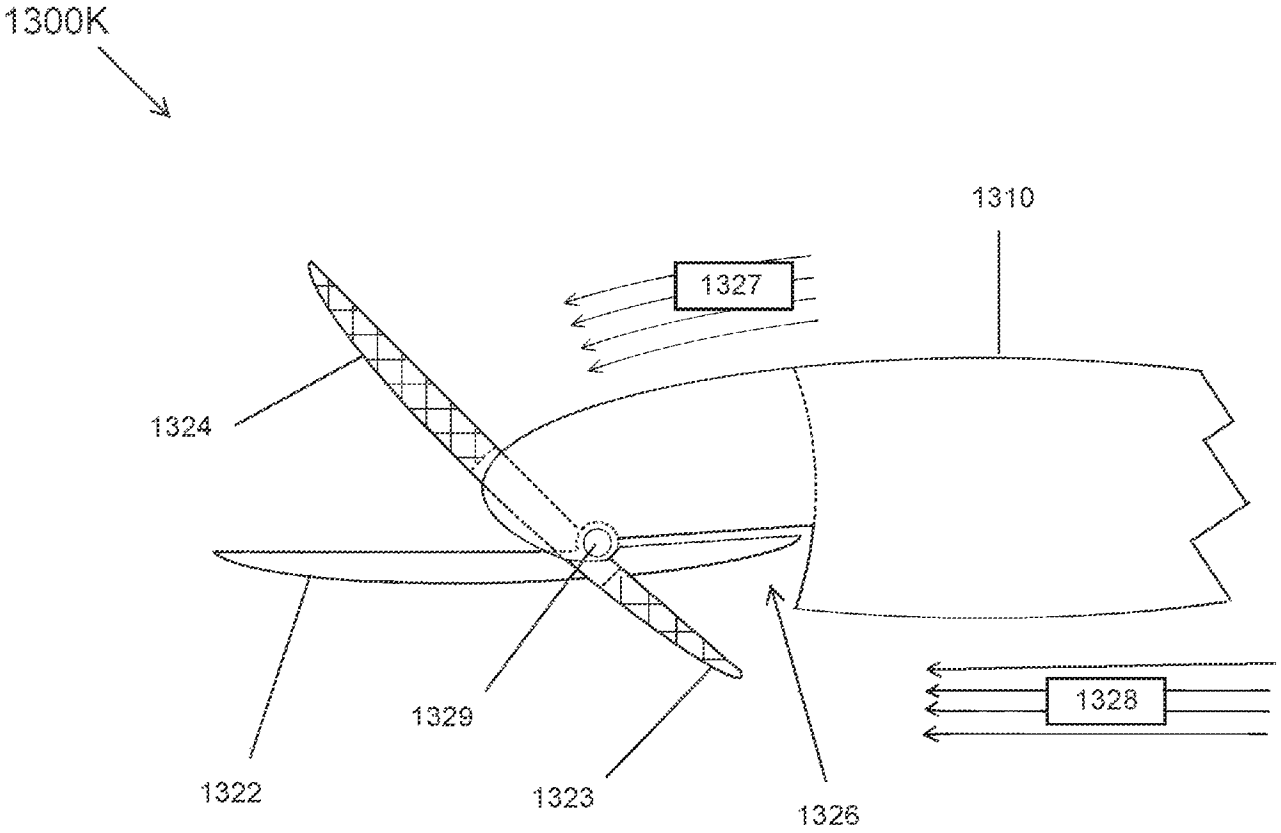
FIG. 13K illustrates a side view of an exemplar of a back wing with a braking element, according to some embodiments of the present disclosure.

Referring now to FIG. 13K which illustrates a side view of a hinged 1329 back wing 1324 with a forward portion braking element 1323. This is a low-aspect wing mounted on a hinge 1329 at the back of a fuselage 1310. As with the present disclosure, the angle of this wing may or may not be adjusted by a sensor skimming on the surface. As illustrated in this embodiment the braking element may engage should the foilboard rider angle the fuselage 1310 upwards from its normal position horizontal with the surface. This would be accomplished by lifting the front foot and keeping weight on the back foot. Not only would this have a breaking effect as the forward portion of the wing disrupts the laminar flow 1328 along the bottom of the fuselage 1310, the leverage of this action would also help to prevent the lifting wings from breaching the surface. Having the lifting wing breach the surface is the most common inadequacy of the legacy hydrofoil systems in use by foilboarders. The force against the back portion 1324 of the low aspect wing by the laminar flow 1327 over the top of the fuselage 1310 may serve to balance the force against the braking portion 1323. Another problem solved by this element of the device is that the legacy foilboarder hydrofoil systems have no brakes. The present disclosure allows the rider to more quickly stop their forward motion, and thus has safety benefits. Moreover, when utilizing a kite, this allows the foilboard rider to create a counterforce to the kite which allows for a dynamic loading of the kite. The low aspect wing may also streamline itself with the fuselage to maximize the efficiency of the hydrofoil device as it travels through the water, when the braking portion is out of the laminar flow as depicted by the position of the wing horizontally 1322 according to some embodiments of the present disclosure.

Figure 13L:
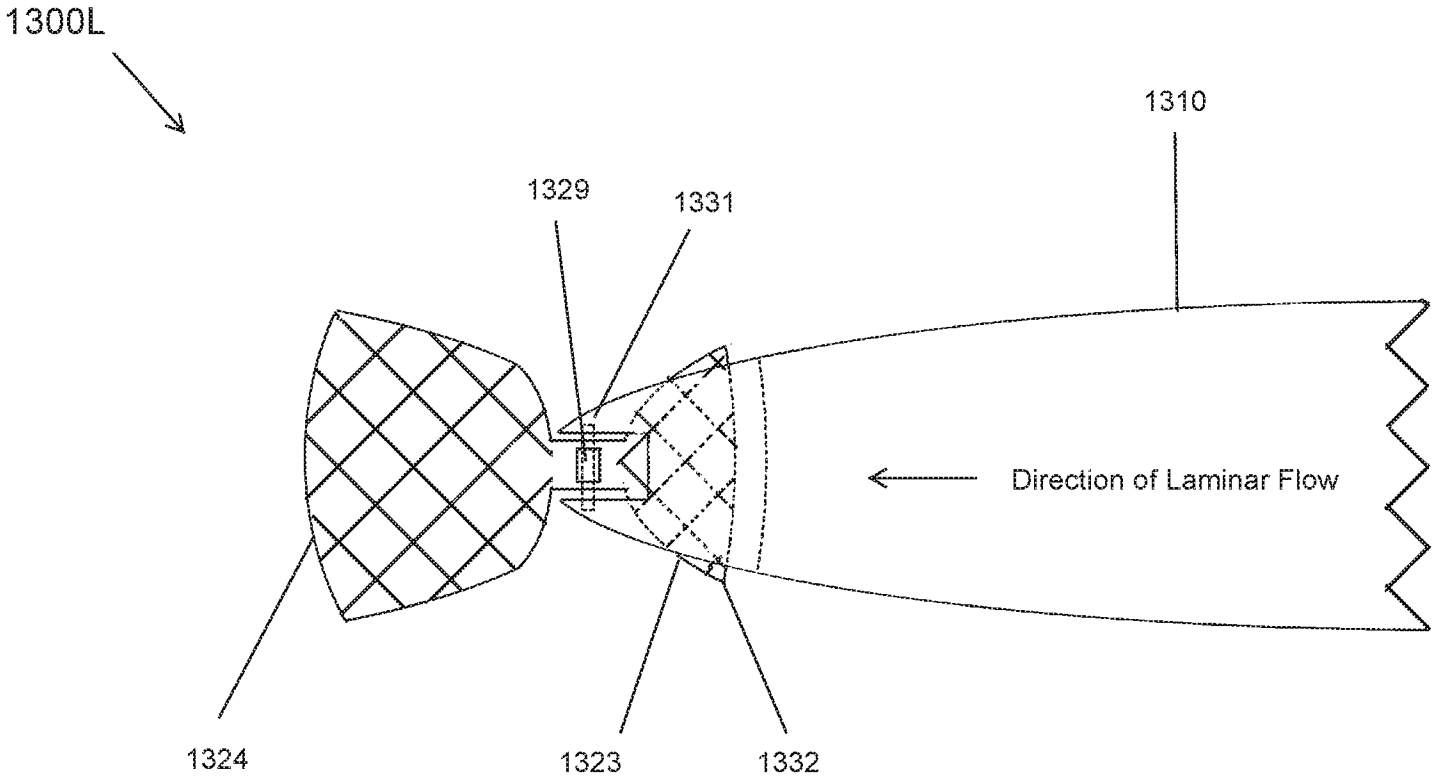
FIG. 13L illustrates a top-down view of an exemplar of a back wing with a braking element, according to some embodiments of the present disclosure.

Referring now to FIG. 13L, which illustrates a top-down view of the hinged low-aspect braking back wing. The back portion of the wing 1324 is in the laminar stream coming across the top of the hydrofoil fuselage 1310, while the portion of the wing 1323 forward of the hinge 1329, which rides on the axle 1331 gets forced into the laminar stream coming across the bottom of the fuselage. This is what creates the desired braking effect. Additional elements include the tips (e.g., tip 1332) of the forward portion of the wing, which may be upswept on either side of the leading edges, so as to pin the forward portion of the wing out of the laminar flow, as the laminar flow down the sides of the fuselage create this pinning force according to some embodiments of the present disclosure.

Figure 14A:
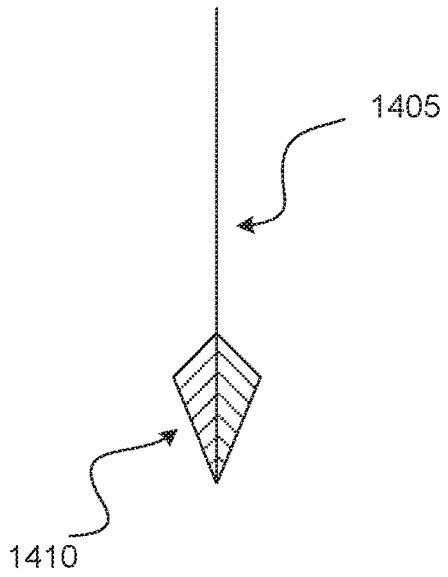
FIG. 14A illustrates a top-down view of an exemplary sensor for use in conjunction with a hydrofoil system, according to some embodiments of the present disclosure.
Figure 14B:
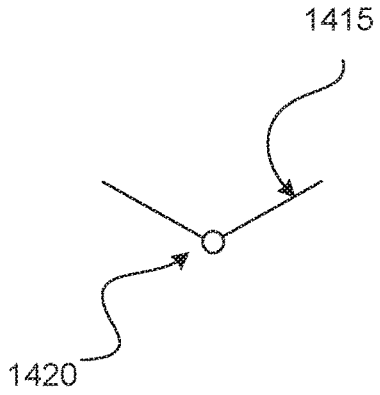
FIG. 14B illustrates a cross section view of an exemplary sensor for use in conjunction with a hydrofoil system, according to some embodiments of the present disclosure.
Figure 14C:
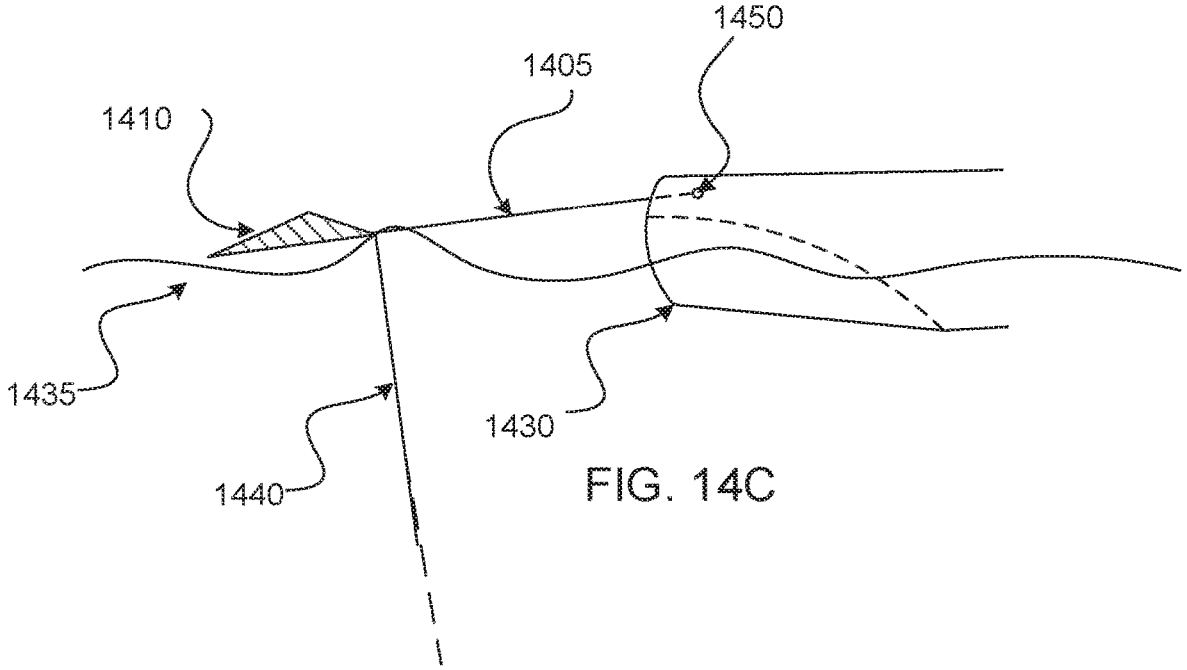
FIG. 14C illustrates a side view of an exemplary sensor for use in conjunction with a hydrofoil system, according to some embodiments of the present disclosure.

Referring now to FIG. 14A, FIG. 14B and FIG. 14C, various views of an exemplary sensor 1410 for use in conjunction with a hydrofoil system. In some aspects, the sensor 1410 may comprise an arrow shape, which may limit the drag effect the sensor 1410 may have on the hydrofoil system as it glides over a water surface 1435. In some embodiments, the sensor 1410 may comprise a buoyant core 1420 that allows the sensor 1410 to float on the surface of the water. In some implementations, the sensor 1410 may be connected by a rod 1405 that may be anchored to the aft portion of a surfboard 1430. In some embodiments, the mechanical control line 1440 may extend from the base of the sensor 1410.

Figure 15:
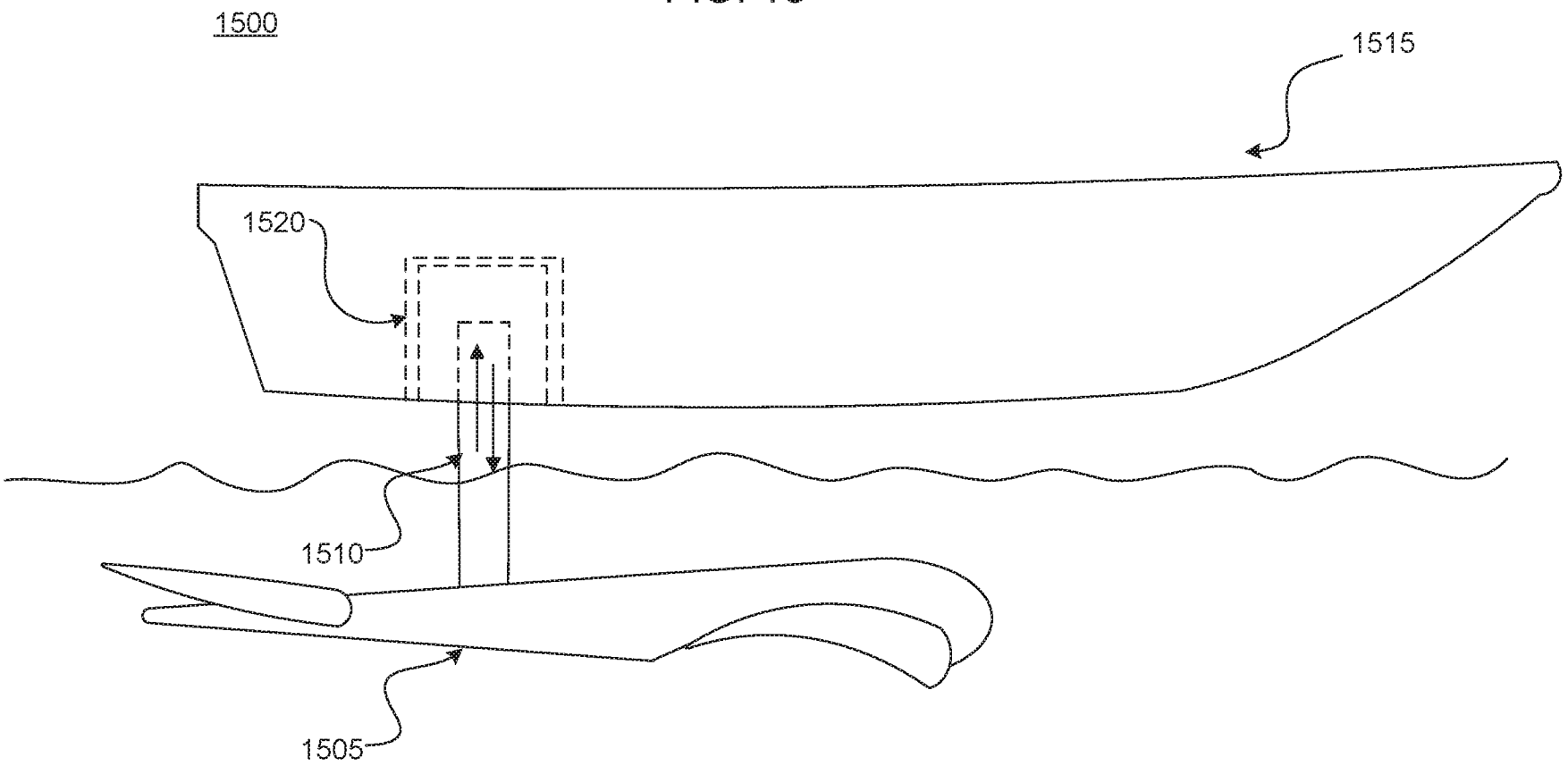
FIG. 15 illustrates an alternate exemplary hydrofoil system, according to some embodiments of the present disclosure

Referring now to FIG. 15, a side view of an alternate exemplary hydrofoil system 1500 is illustrated. In some aspects, a hydrofoil device 1505 may be connected to a boat 1515. In some embodiments, the strut 1510 of the hydrofoil device 1505 may extend into the hull 1520 of the boat 1515. In some implementations, the strut 1510 may be manually or automatically manipulated, such as through connection to a motor. In some embodiments, the hydrofoil device 1505 may be actively controlled, such as through connection to a power source and communication device. In some aspects, the boat 1515 may further comprise a lead ballast that may be shifted to provide a counterbalance, effectively substituting the ability of a rider of a surfboard to actively shift weight as a hydrofoil system glides through water.

Figure 16A:
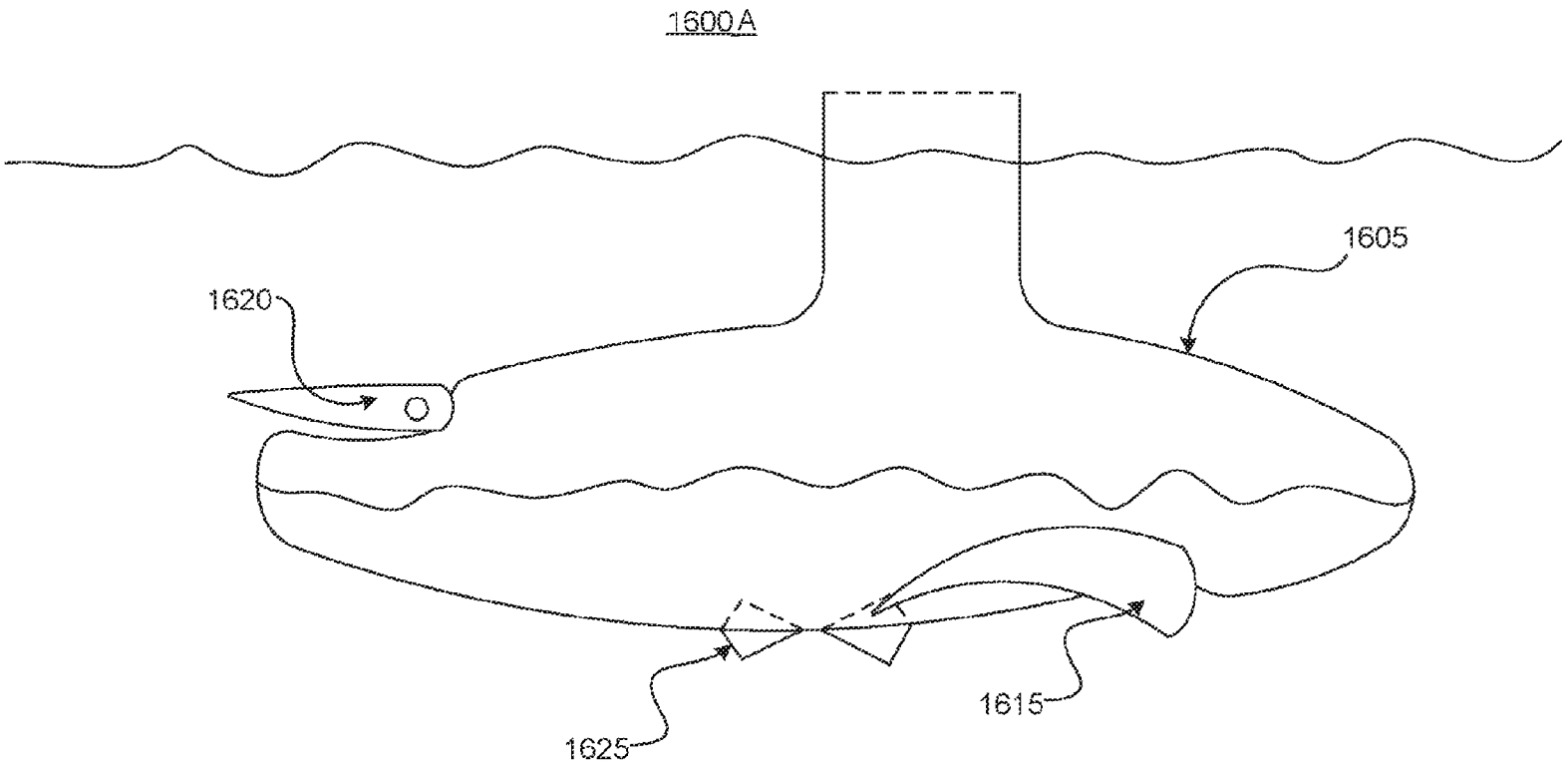
FIG. 16A illustrates an exemplary commercial hydrofoil device, according to some embodiments of the present disclosure.

Referring now to FIG. 16A, a side view of a commercial hydrofoil device 1600 is illustrated. In some embodiments, a commercial hydrofoil device 1600 may comprise a wide fuselage 1605 with a valve 1625 that may control the intake and purging of water into the fuselage 1605, wherein the water level within the fuselage 1605 may adjust the buoyancy of the commercial hydrofoil device 1600A. In some aspects, the commercial hydrofoil device 1600A may comprise a back wing 1620 and a front wing 1615 that may be independently manipulated.

Referring now to FIG. 16B1, which illustrates a side view of a hydrofoil device with a wide fuselage 1605 wherein the submerged portions of the fuselage can be filled with water which can be purged with air as described in FIG. 16A above. The fuselage 1605 illustrated here may further comprise a coating of varying depths of both hydrophobic elements and hydrophilic elements as depicted by the cross-hatched area 1605. The raised surfaces may be hydrophilic while the surfaces that are closer to the actual outer skin of the fuselage may be hydrophobic. This may serve to trap the air that is being emitted from orifices within a low-pressure area 850 just behind the nose-cone 845. The back wing 1620 may be adjusted by a surface-skimming sensor, not shown. The front wing may comprise two separate wings 1615(1) and 1615(2) (not shown) extending orthogonally from the coated fuselage 1605. Hinge-points for both the back wing 1625 and for the front wings 1635 are also depicted. Not visible in this embodiment may be an axle connecting the wings on either side of the fuselage so that they act in concert according to some embodiments of the present disclosure. Moreover, these wings are designed to pivot within a predetermined range to create both their propulsive and lifting effects.

Referring now to FIG. 16B2, which illustrates both a top-down close up view and a side view cross-section of the combined hydrophobic and hydrophilic coating element labeled 1605 previously in FIG. 16B1. The hydrophobic surfaces 1606 that are closest to the skin of the fuselage of the exemplar hydrofoil system illustrated in FIG. 16B1 are identified by label 1606, while the raised hydrophobic surfaces are labeled as 1607. As seen from above, the raised surfaces appear as diamond shaped, similar to fish scales. However, with the closer side view it is apparent that the diamond shapes are arranged at an angle away from the direction of laminar flow. This allows air bubbles 1608 to become trapped in the hydrophobic groves 1606 residing just behind the raised sides of the diamond shaped structures 1606. This element serves to function as a friction reducing element as the disclosed system's hydrofoil passes through the water as the air is trapped by the coating along the fuselage, according to some embodiments. This element may operate in a similar manner as to what penguins employ to escape an ambush by a waiting leopard seal in the Antarctic.

Figure 16C:
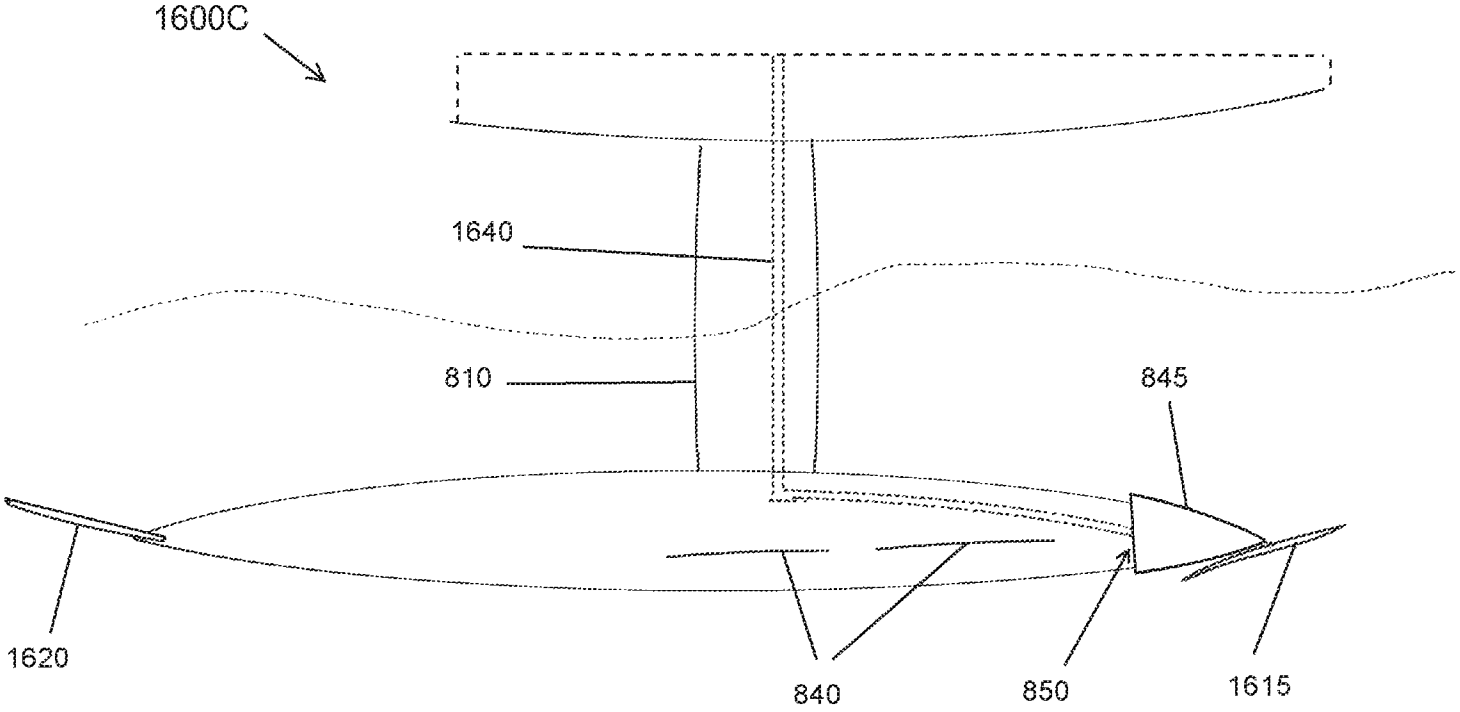
FIG. 16C illustrates an exemplar of a hydrofoil device with air induction according to some embodiments of the present disclosure.

Referring now to FIG. 16C, which illustrates a side view of a hydrofoil system is illustrated with two propelling wings 840 extending orthogonally from the sides of the fuselage. The front gliding wing 815 is depicted attached to a nose cone 845 that may be filled with air and contain orifices that may also release the air into the low pressure zones 850 behind the nose cone 845, wherein the air then may coat an outer hydrophobic and hydrophilic portion (not shown) of the fuselage to reduce the friction of the fuselage through the water. The air may be introduced from the surface of the board, or deck of the foilboard via channels or hoses 1640 through a vertical strut 810 according to some embodiments of the present disclosure.

Figure 16D:
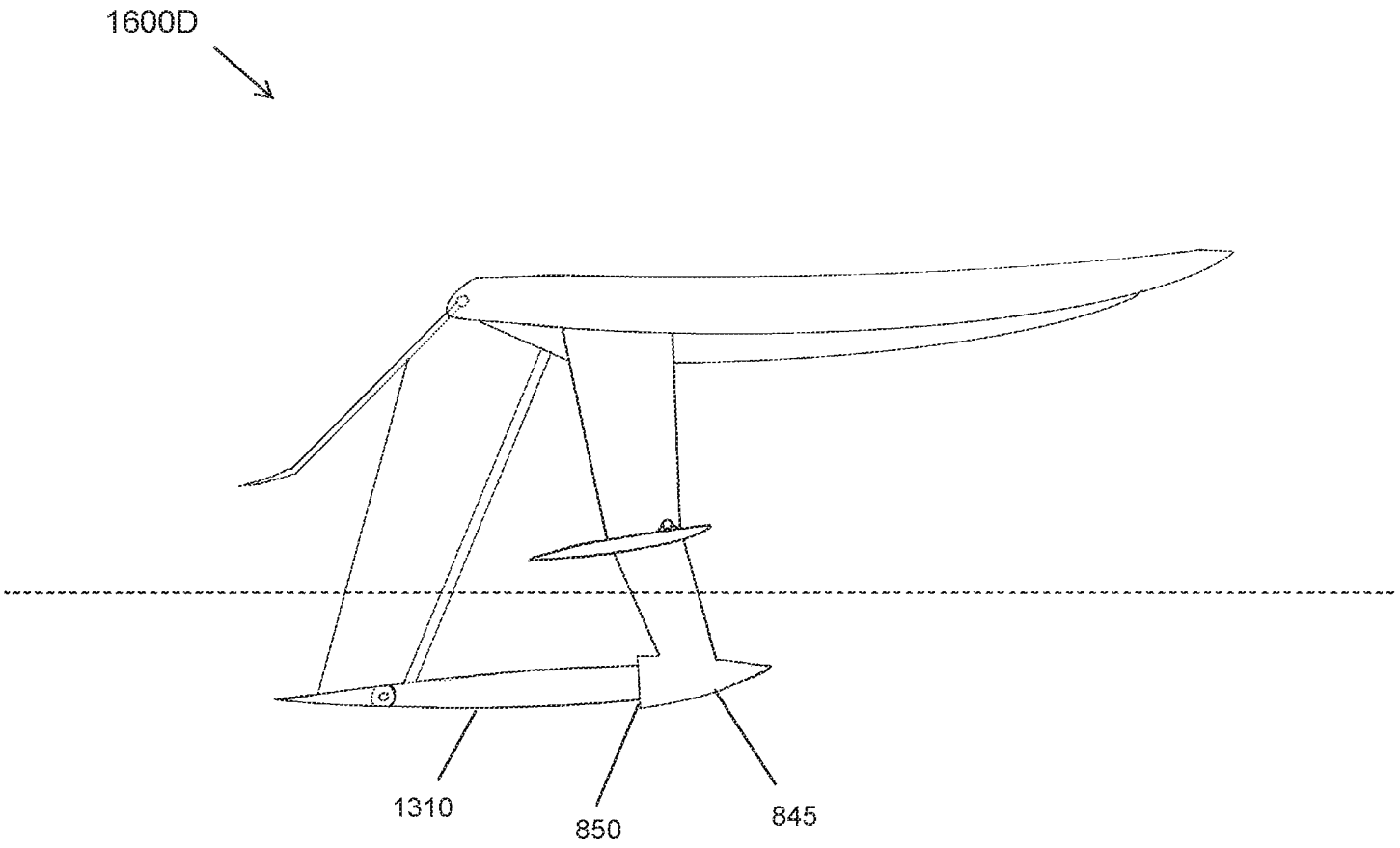
FIG. 16D illustrates a side-view exemplar of a hydrofoil device air induction according to some embodiments of the present disclosure.

Referring now to FIG. 16D, which illustrates a side view of a hydrofoil system is illustrated with a fuselage 1310 with a nose cone 845 that may be filled with air and contain orifices that may also release the air into the low pressure zones 850 behind the nose cone 845, wherein the air then may coat an outer hydrophobic and hydrophilic portion (not shown) of the fuselage to reduce the friction of the fuselage through the water. The air may be introduced from the surface of the board, or deck of the foilboard via channels or hoses (not shown) through a vertical strut (not shown) or though the anhedral and dihedral wings, according to some embodiments of the present disclosure.

Figure 16E:
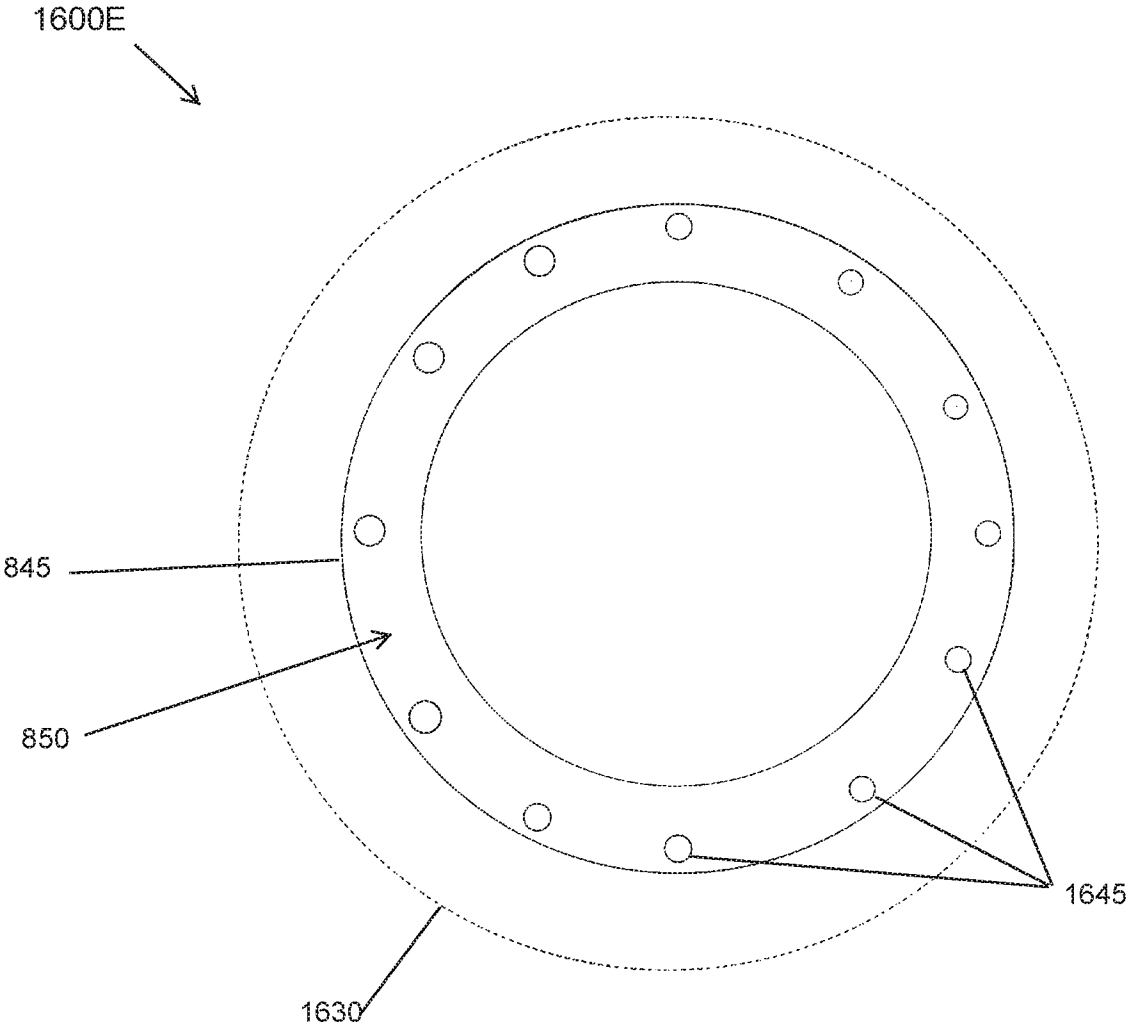
FIG. 16E illustrates a view forward of a nose cone element from the midpoint of the fuselage according to some embodiments of the present disclosure.

Referring now to FIG. 16E, which illustrates a rear-forward view of a nose cone 845 with air orifices 1645 is illustrated in this possible exemplar. The orifices 1645 are within the low-pressure zone behind the nose cone 845 that extends past the skin of the fuselage 1630 which terminates forward in a point. Here, the outer skin of the widest part of the fuselage is illustrated by the dotted line 1630 according to some embodiments of the present disclosure.

Figure 16F:
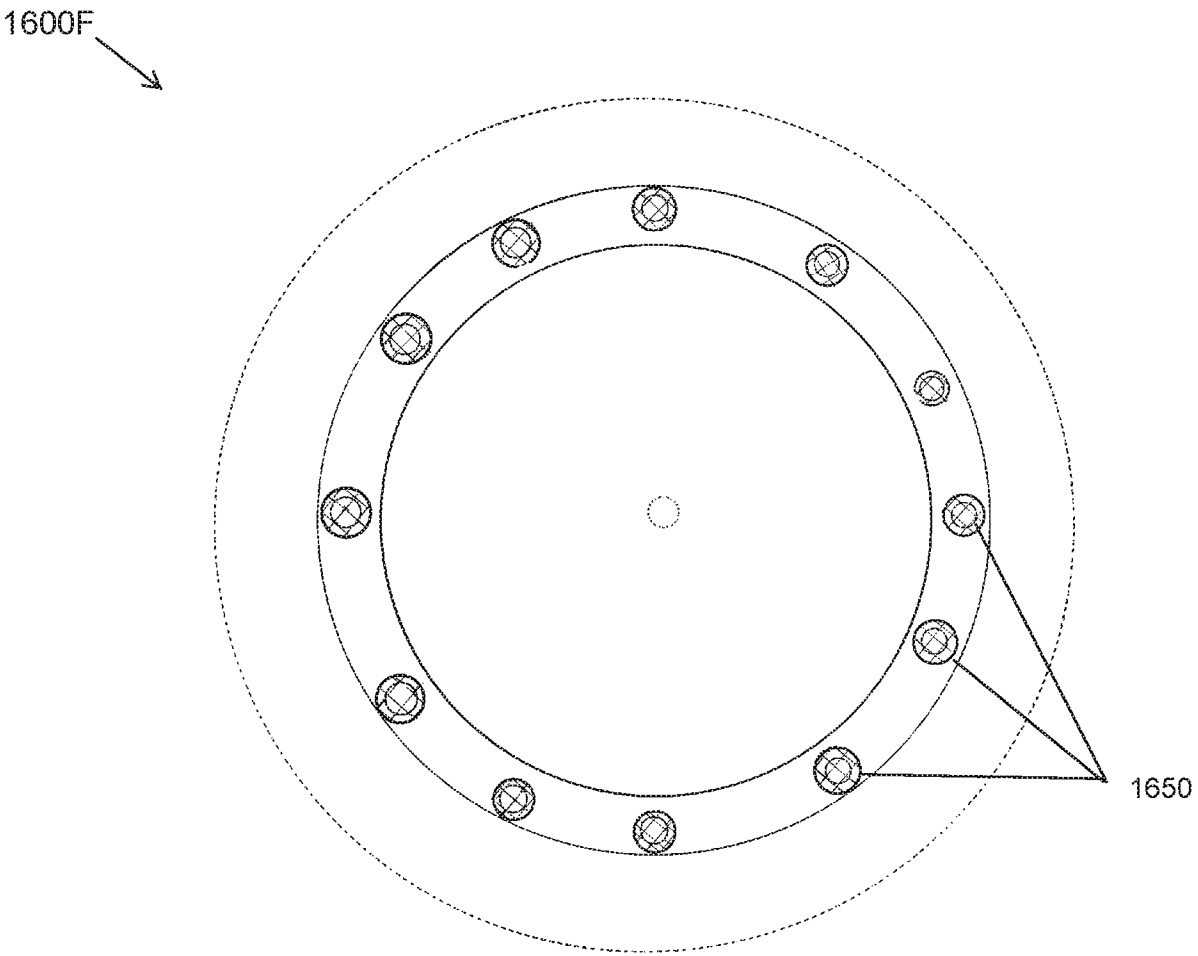
FIG. 16F illustrates a view forward of a nose cone element from the midpoint of the fuselage according to some embodiments of the present disclosure.

Referring now to FIG. 16F, which illustrates a rear-forward view of a nose cone 845 with air orifices. Here the orifices are covered with non-return air valves which may be in the form of flexible rubber caps 1650 as shown according to some embodiments of the present disclosure.

Figure 16G:
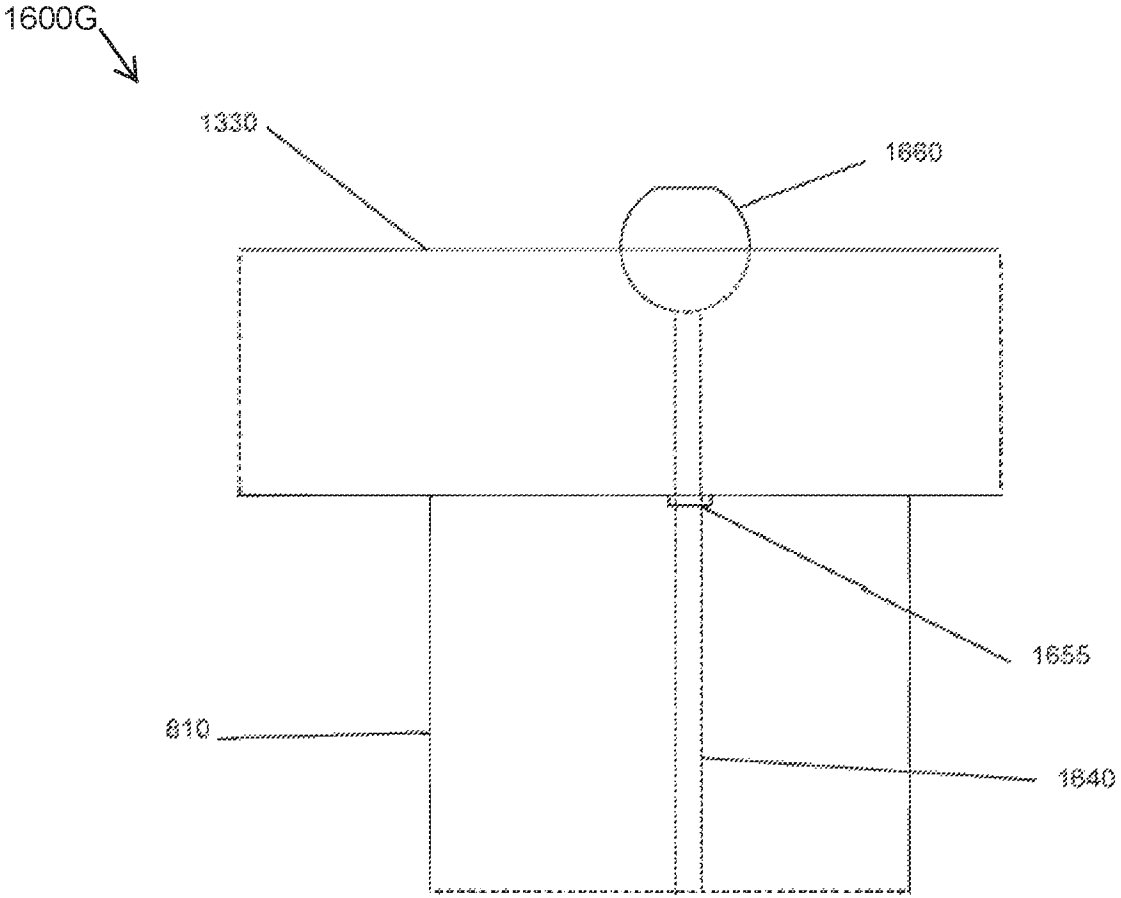
FIG. 16G illustrates a side view of an exemplar of an air-priming element according to some embodiments of the present disclosure.

Referring now to FIG. 16G, which illustrates a flexible priming bulb on the deck of a foilboard. The flexible priming bulb may be activated when the foilboard rider steps onto it, thereby forcing air down through the channel or hose 1640 contained within a vertical strut 810, this air will then reach a low-pressure area (not shown) at the front of the fuselage (not shown) and then coat a special surface on the fuselage to reduce friction through the water according to some embodiments.

Figure 16H:
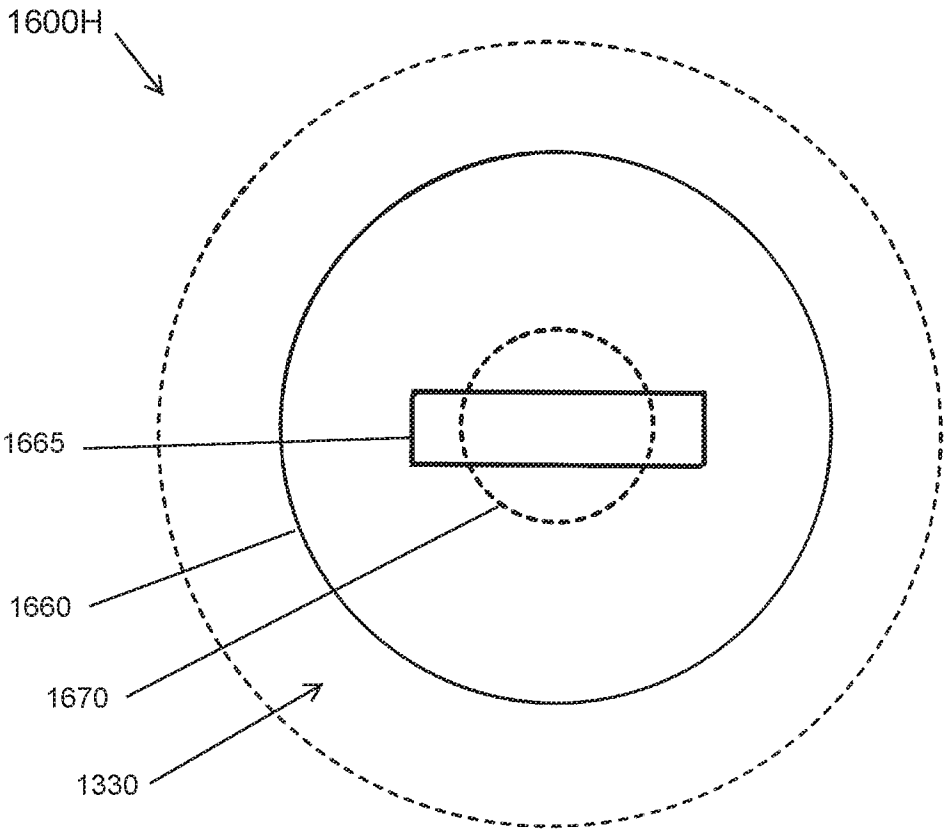
FIG. 16H illustrates a top-down view of an exemplar of an air-priming element according to some embodiments of the present disclosure.

Referring now to FIG. 16H, which illustrates a top-down view of the priming bulb 1660 where it is mounted on the deck 1330 of the foilboard. The bulb comprises an orifice 1665 at the top which allows for air input and also serves as a one-way valve when stepped on and sealed by the sole of a foot that may be a bare foot, or a foot covered in a rubber wetsuit booty. When the flexible bulb is stepped on it will trap air that will be forced down an orifice 1670 and into a channel or tube which then leads the air down to a nose cone which releases the air to coat the fuselage of the hydrofoil system according to some embodiments.

Figures 17A, 17B:
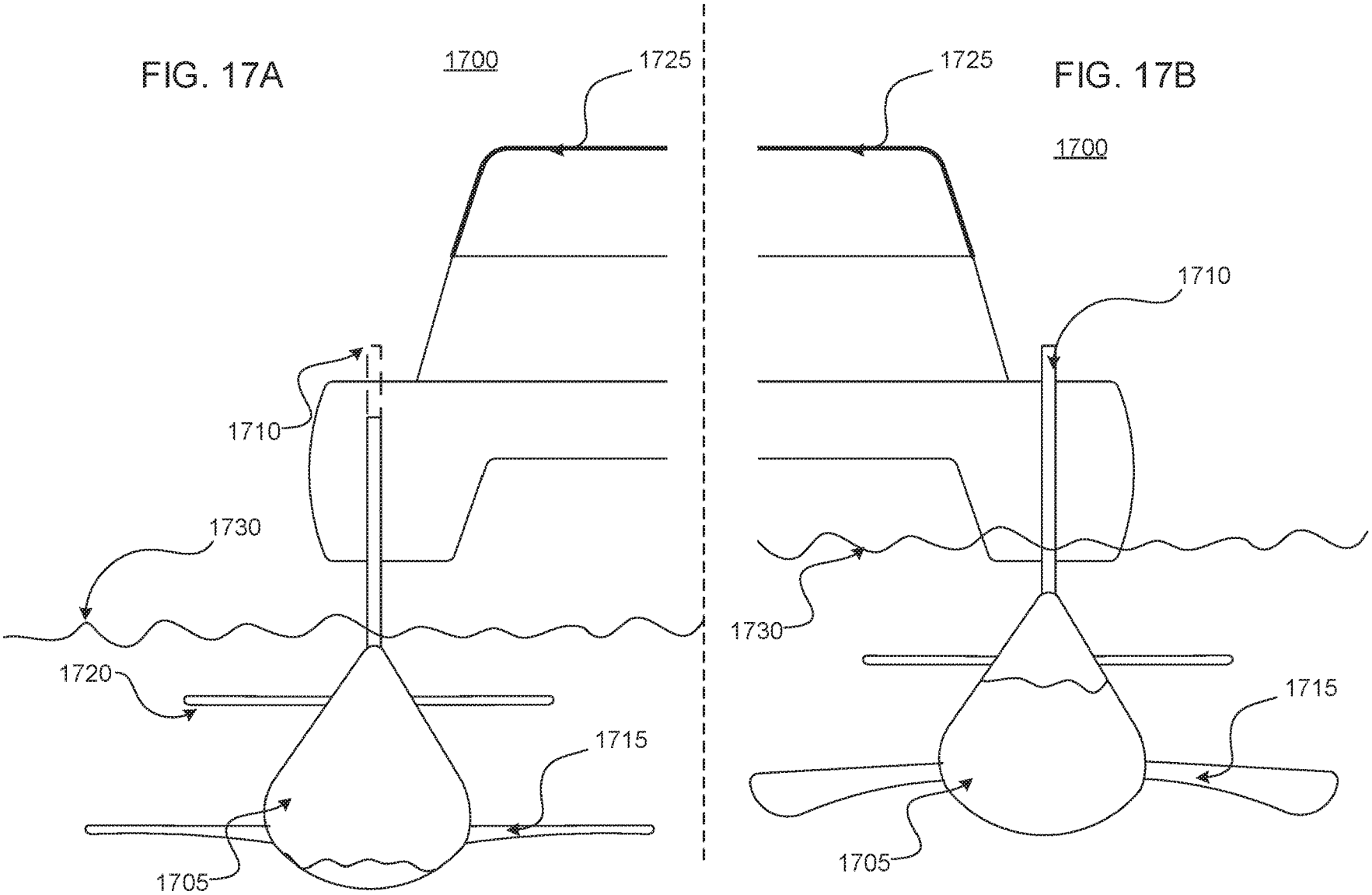
FIG. 17A illustrates an exemplary commercial hydrofoil system in a lifting state, according to some embodiments of the present disclosure.
FIG. 17B illustrates an exemplary commercial hydrofoil system in a resting state, according to some embodiments of the present disclosure.

Referring now to FIG. 17A and FIG. 17B, front views of a commercial hydrofoil system 1700 are illustrated. In some aspects, a commercial vessel 1725 may be propelled by a series of commercial hydrofoil devices 1705-1720. In some embodiments, a commercial hydrofoil system 1700 may comprise a fuselage 1705 with adjustable buoyancy connected to the commercial vessel through a strut 1710 that may extend through the hull of the commercial vessel 1725.

In some aspects, such as illustrated in FIG. 17A, the fuselage 1705 may have increased buoyancy in gliding mode, wherein the commercial vessel 1725 glides over the water surface 1730 and the front wing 1715 and back wing 1720 may be in cruise position. In some embodiments, such as illustrated in FIG. 17B, the fuselage 1705 may have decreased buoyancy in resting and rising mode, wherein the commercial vessel 1725 may be in contact with the water surface 1730. In rising mode, the front wing 1715 may pivot to direct water flow and cause lift of the commercial hydrofoil system.

Figure 18:
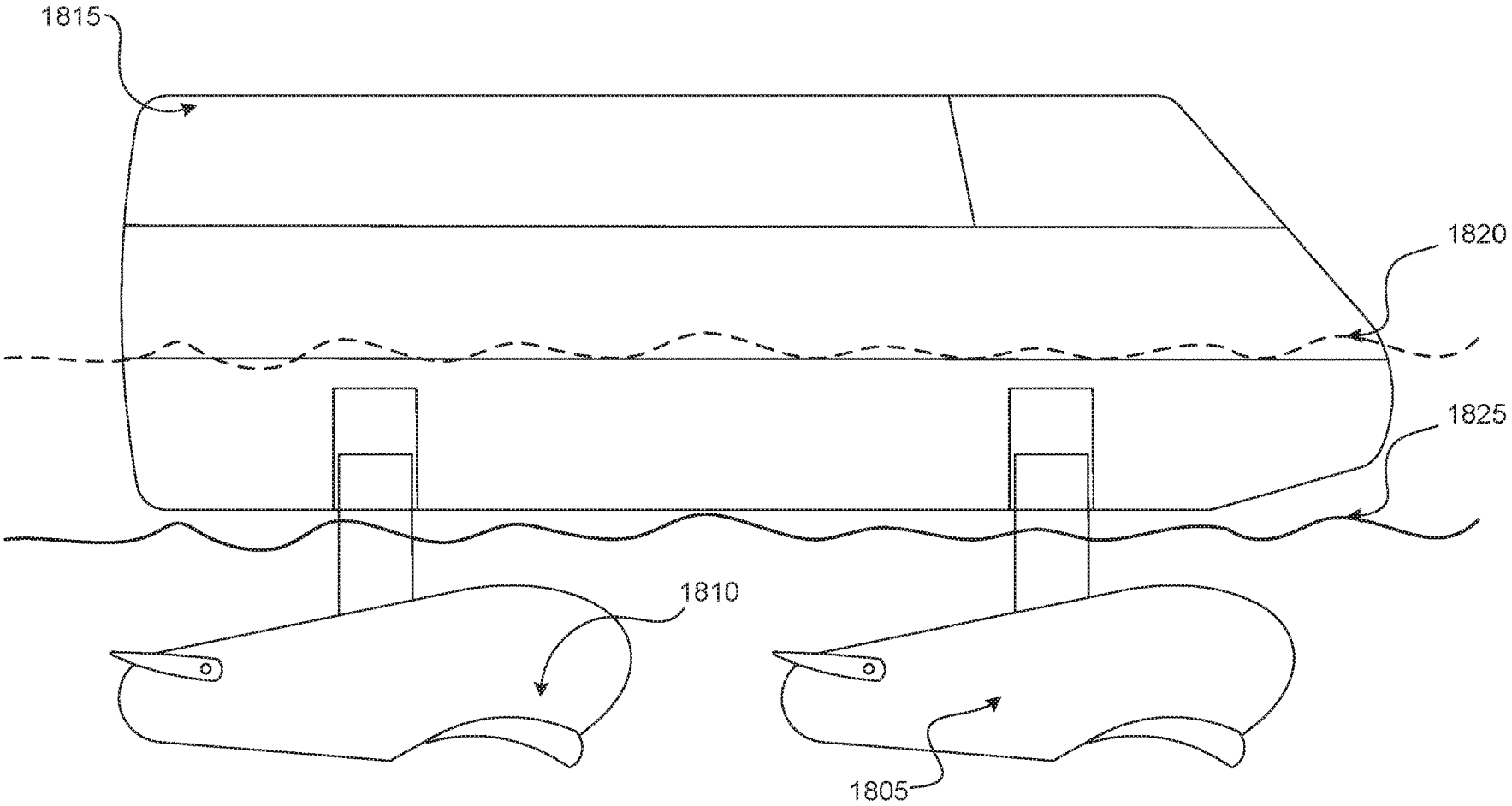
FIG. 18 illustrates a side view of an exemplary commercial hydrofoil system, according to some embodiments of the present disclosure.

Referring now to FIG. 18, a side view of an exemplary commercial hydrofoil system 1800 is illustrated. In some aspects, a commercial hydrofoil system 1800 may comprise a commercial vessel 1815 propelled by a plurality of hydrofoil devices 1805, 1810. In some embodiments, the commercial hydrofoil system 1800 may comprise four hydrofoil devices 1805, 1810 with two positioned on each side of the hull of the commercial vessel 1815. In some aspects (not shown), the commercial hydrofoil system 1800 may comprise two hydrofoil devices with one positioned on each side of the hull, wherein each hydrofoil device may be connected to the commercial vessel 1815 through at least two struts. In some implementations, the hydrofoil system 1800 may allow the commercial vessel 1815 to operate at different water levels, such as under a water surface 1820 and hovering above the water surface 1825.

A number of embodiments of the present disclosure have been described. While this specification contains many specific implementation details, there should not be construed as limitations on the scope of any disclosures or of what may be claimed, but rather as descriptions of features specific to particular embodiments of the present disclosure.

Certain features that are described in this specification in the context of separate embodiments can also be implemented in combination or in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order show, or sequential order, to achieve desirable results. In certain implementations, multitasking and parallel processing may be advantageous. Nevertheless, it will be understood that various modifications may be made without departing from the spirit and scope of the claimed disclosure.

What is claimed is:

1. A hydrofoil device connected to a vessel comprising:
- a front wing comprising:
  - a convex upper surface,
  - a concave lower surface, and
- a hinge point;
- a back wing;
- a fuselage comprising:
  - an elongated body, wherein the front wing is connected by the hinge point to a forward portion of the elongated body, and wherein the back wing is connected to an aft portion of the elongated body, and wherein the front wing pivots within a range; and
- a strut connectable to the elongated body and connectable to the vessel.

2. The hydrofoil device of claim 1, wherein the back wing further comprises a back hinge.

3. The hydrofoil device of claim 2, wherein the back wing is manually adjustable to control an angle of the back wing.

4. The hydrofoil device of claim 2, wherein the back hinge allows the back wing to fluctuate within a predefined range.

5. The hydrofoil device of claim 1, wherein the front wing comprises flexible hydrons.

6. The hydrofoil device of claim 1, wherein at least a portion of the hydrofoil device comprises a buoyant material.

7. The hydrofoil device of claim 1, wherein the fuselage is comprised of carbon fiber or other rigid composite materials.

8. The hydrofoil device of claim 1, wherein at least a portion of one or both the front wing and the back wing are comprised of a buoyant material.

9. The hydrofoil device of claim 8, wherein the back wing is comprised of a concave upper surface and a convex lower surface.

10. A hydrofoil device connected to a surfboard comprising:
- a front wing comprising:
  - a convex upper surface,
  - a concave lower surface,
  - a hinge point;
- a back wing;
- a fuselage comprising:
  - an elongated body, wherein the front wing is connected by the hinge point to a forward portion of the elongated body, and wherein the back wing is connected to an aft portion of the elongated body, and wherein the front wing pivots within a range; and
- a strut connected to the elongated body and connectable to the surfboard.

11. The hydrofoil device of claim 10, where the hinge point is located on the front wing.

12. The hydrofoil device of claim 10, wherein at least a portion of one or both the front wing and the back wing includes a semi-flexible material.

13. The hydrofoil device of claim 10, wherein the back wing further comprises a concave upper surface and convex lower surface.

14. The hydrofoil device of claim 10, wherein the front wing further comprises one or more flexible hydrons.

15. The hydrofoil device of claim 10, wherein the fuselage comprises an adjustable buoyancy.

16. The hydrofoil device of claim 10, wherein the strut comprises a base, wherein the base is connectable to the surfboard.

17. The hydrofoil device of claim 10, wherein at least a portion of one or more of the front wing, the back wing, the fuselage, and the strut, comprise a buoyant material.

18. The hydrofoil device of claim 17, wherein the buoyant material allows the hydrofoil device to float when in water.

19. The hydrofoil device of claim 10, wherein the surfboard comprises a plurality of channels on an undersurface of the surfboard.

20. The hydrofoil device of claim 19, wherein the plurality of channels form a grooved surface.

* * * * *